US006252616B1

(12) United States Patent
Okazaki et al.

(10) Patent No.: US 6,252,616 B1
(45) **Date of Patent: *Jun. 26, 2001**

(54) LIQUID EJECTION METHOD, HEAD AND APPARATUS IN WHICH AN AMOUNT OF LIQUID EJECTED IS CONTROLLED

(75) Inventors: Takeshi Okazaki, Sagamihara; Toshio Kashino, Chigasaki; Hiroshi Tajika, Yokohama; Kouichi Omata, Kawasaki; Aya Yoshihira, Yokohama; Kiyomitsu Kudo, Kawasaki; Masao Kato, Yokohama; Yoshie Asakawa, Nagano-ken; Hitoshi Tsuboi, Tokyo, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/872,627

(22) Filed: Jun. 9, 1997

(30) Foreign Application Priority Data

| | | |
|---|---|---|
| Jun. 7, 1996 | (JP) | 8-146318 |
| Jul. 5, 1996 | (JP) | 8-178939 |
| Jul. 12, 1996 | (JP) | 8-183665 |

(51) Int. Cl.[7] ..... B41J 2/05
(52) U.S. Cl. ..... 347/65; 347/14
(58) Field of Search ..... 347/65, 63, 57, 347/17, 14, 12, 60

(56) References Cited

U.S. PATENT DOCUMENTS

| | | | |
|---|---|---|---|
| 4,480,259 | 10/1984 | Kruger et al. . | |
| 4,538,160 | 8/1985 | Uchiyama . | |
| 4,553,173 * | 11/1985 | Kawamura | 358/283 |

(List continued on next page.)

FOREIGN PATENT DOCUMENTS

| | | | |
|---|---|---|---|
| 2059613 | 7/1992 | (CA) . | |
| 43 42 643 | 3/1995 | (DE) | B41J/2/005 |
| 0 436 047 | 7/1991 | (EP) | B41J/2/055 |

(List continued on next page.)

OTHER PUBLICATIONS

Patent Abstracts of Japan, vol. 1989, JP1–063185, Mar. 9, 1989.

*Primary Examiner*—Joan Pendegrass
(74) *Attorney, Agent, or Firm*—Fitzpatrick, Cella, Harper & Scinto

(57) ABSTRACT

A liquid ejection method involves supplying liquid along a heat generating element disposed along a flow path from upstream of the heat generating element, applying heat generated by the heat generating element to the thus supplied liquid to generate a bubble, thus moving a free end of a movable member having the free end adjacent the ejection outlet side by pressure produced by the bubble, the movable member facing the heat generating element, supplying, to a heat generating element for applying thermal energy to the bubble generating region, a driving pulse divided into a first pulse and an adjacent second pulse with interval time therebetween, pre-heating the liquid by the first pulse to an extent insufficient to eject liquid through the ejection outlet, and generating a bubble by heating the liquid by the second pulse to eject the liquid through the ejection outlet. The method also includes ejecting liquid in an amount determined by controlling a degree of pre-heating of the liquid by changing at least one of a width of the first pulse or the interval time. The change rate of the ejection amount of the liquid increases non-linearly with an increase of the width of the first pulse or an increase of the interval time period. Recording heads and apparatuses control the ejection amount of liquid in like manner.

66 Claims, 50 Drawing Sheets

U.S. PATENT DOCUMENTS

| | | | | |
|---|---|---|---|---|
| 4,723,129 | | 2/1988 | Endo et al. . | |
| 5,132,702 | * | 7/1992 | Shiozaki | 347/12 |
| 5,166,699 | | 11/1992 | Yano et al. | 347/17 |
| 5,278,585 | | 1/1994 | Karz et al. | 347/65 |
| 5,625,384 | | 4/1997 | Numata et al. . | |
| 5,648,802 | * | 7/1997 | Abe | 347/29 |
| 5,745,132 | * | 4/1998 | Hirabayashi | 347/14 |
| 5,821,962 | * | 10/1998 | Kudo | 347/65 |
| 5,861,895 | * | 1/1999 | Tajika | 347/14 |
| 5,867,200 | * | 2/1999 | Tajima | 347/13 X |

FOREIGN PATENT DOCUMENTS

| | | | |
|---|---|---|---|
| 0 501 707 | 9/1992 | (EP) | B41J/2/355 |
| 0 505 154 | 9/1992 | (EP) | B41J/2/07 |
| 0 506 016 | 9/1992 | (EP) | B41J/2/365 |
| 0 625 425 | 11/1994 | (EP) | B41J/2/36 |
| 0 626 265 | 11/1994 | (EP) | B41J/2/195 |
| 0 630 752 | 12/1994 | (EP) | B41J/2/05 |
| 0 655 337 | 5/1995 | (EP) | B41J/2/205 |
| 0 670 219 | 9/1995 | (EP) | B41J/2/05 |
| 0 671 268 | 9/1995 | (EP) | B41J/2/01 |
| 0 686 506 | 12/1995 | (EP) | B41J/2/195 |
| 0 694 392 | 1/1996 | (EP) | B41J/2/05 |
| 0 709 213 | 5/1996 | (EP) | B41J/2/195 |
| 55-81172 | 6/1980 | (JP) | B41J/3/04 |
| 61-69467 | 4/1986 | (JP) | B41J/3/04 |
| 63-199972 | 8/1988 | (JP) | F16K/15/14 |
| 2-255349 | 10/1990 | (JP) | B41J/2/36 |
| 7-4109 | 1/1995 | (JP) | E04H/6/30 |

* cited by examiner

| PRINT MODE | REC DENSITY | PRINT PATH | | DOT ARRANGEMENT | |
|---|---|---|---|---|---|
| | | Bk | Col | Bk | Col |
| Fast | 360dpi | ONE PATH, SINGLE | ONE PATH, SINGLE | 70<br>360×360 | 40<br>360×360 |
| Norm. | 360dpi | TWO PATHS, SINGLE | TWO PATHS, DBL | 70<br>360×360 | 40<br>360×360 |
| | 360dpi 3-level | TWO PATHS, SINGLE (HALF PIXEL OFFSET) | TWO PATHS, DBL (HALF PIXEL OFFSET) | 45 45<br>720×720-h | 25 25<br>720×720-h |
| HQ | 360dpi 5-level | 4 PATHS, SINGLE (HALF PIXEL OFFSET) (4 PATH PRINT) | 4 PATHS, SINGLE (HALF PIXEL OFFSET) (4 PATH PRINT) | 25 25 25 25<br>720×720-f | 15 15 15 15<br>720×720-f |

FIG. 56

LIQUID EJECTION METHOD, HEAD AND APPARATUS IN WHICH AN AMOUNT OF LIQUID EJECTED IS CONTROLLED

FIELD OF THE INVENTION AND RELATED ART

The present invention relates to a liquid ejecting head, a liquid ejecting apparatus, using the liquid ejecting head and a liquid ejection method, wherein desired liquid is ejected by generation of the bubble by applying thermal energy to the liquid.

More particularly, it relates to a liquid ejecting head having a movable member movable by generation of a bubble, and a head cartridge using the liquid ejecting head, and liquid ejecting device using the same. It further relates to a liquid ejecting method and recording method for ejection the liquid by moving the movable member using the generation of the bubble.

The present invention is applicable to equipment such as a printer, a copying machine, a facsimile machine having a communication system, a word processor having a printer portion or the like, and an industrial recording device combined with various processing device or processing devices, in which the recording is effected on a recording material such as paper, thread, fiber, textile, leather, metal, plastic resin material, glass, wood, ceramic and so on.

In this specification, "recording" means not only forming an image of letter, figure or the like having specific meanings, but also includes forming an image of a pattern not having a specific meaning.

An ink jet recording method of so-called bubble jet type is known in which an instantaneous state change resulting in an instantaneous volume change (bubble generation) is caused by application of energy such as heat to the ink, so as to eject the ink through the ejection outlet by the force resulted from the state change by which the ink is ejected to and deposited on the recording material to form an image formation. As disclosed in U.S. Pat. No. 4,723,129, a recording device using the bubble jet recording method comprises an ejection outlet for ejecting the ink, an ink flow path in fluid communication with the ejection outlet, and an electrothermal transducer as energy generating means disposed in the ink flow path.

With such a recording method is advantageous in that, a high quality image, can be recorded at high speed and with low noise, and a plurality of such ejection outlets can be posited at high density, and therefore, small size recording apparatus capable of providing a high resolution can be provided, and color images can be easily formed. Therefore, the bubble jet recording method is now widely used in printers, copying machines, facsimile machines or another office equipment, and for industrial systems such as textile printing device or the like.

With the increase of the wide needs for the bubble jet technique, various demands are imposed thereon, recently.

For example, an improvement in energy use efficiency is demanded. To meet the demand, the optimization of the heat generating element such as adjustment of the thickness of the protecting film is investigated. This method is effective in that a propagation efficiency of the generated heat to the liquid is improved.

In order to provide high image quality images, driving conditions have been proposed by which the ink ejection speed is increased, and/or the bubble generation is stabilized to accomplish better ink ejection. As another example, from the standpoint of increasing the recording speed, flow passage configuration improvements have been proposed by which the speed of liquid filling (refilling) into the liquid flow path is increased.

Japanese Laid Open Patent Application No. SHO-63-199972 or the like discloses a flow passage structure as shown in FIGS. 45, (*a*), (*b*). The invention of the flow passage structure and the head manufacturing method disclosed in the publication, is particularly directed to the backward liquid generated in accordance with generation of a bubble (the pressure propagated away from the ejection outlet namely toward the liquid chamber 12). The back wave is known as energy loss since it is not propagated toward the ejection direction.

FIGS. 61, (*a*) and (*b*) disclose a valve 10 spaced from a generating region of the bubble generated by the heat generating element 2 in a direction away from the ejection outlet 11.

In FIG. 61, (*b*), this valve 10, is so manufactured from a plate that it has an initial position where it looks as if it stick on the ceiling of the flow path 3, and is deflected downward into the flow path 3 upon the generation of the bubble. Thus, the energy loss is suppressed by controlling a part of the backward wave by the valve 10.

However, with this structure, if the consideration is made as to the time when the bubble is generated in the flow path 3 having the liquid to be ejected, the suppression of a part of the backward wave by the valve 10 is not desirable.

The backward wave per se is not contributable to the ejection. At the time when the backward wave is generated inside the flow path 3, the pressure directly contributable to the ejection has already make the liquid ejectable from the flow path 3, as shown in FIG. 61, (*a*). Therefore, even if the backward wave is suppressed, the ejection is not significantly influenced, much less even if a part thereof is suppressed.

On the other hand, in the bubble jet recording method, the heating is repeated with the heat generating element contacted with the ink, and therefore, a burnt material is deposited on the surface of the heat generating element due to burnt deposit of the ink. However, the amount of the deposition may be large depending on the materials of the ink. If this occurs, the ink ejection becomes unstable. Even when it the liquid to be ejected is easily deteriorated by the heat, or is not sufficiently formed into a bubble, the liquid is desirably ejected without deterioration of the liquid.

From this standpoint, Japanese Laid Open Patent Application No. SHO-61-69467, Japanese Laid Open Patent Application No. SHO-55-81172 and U.S. Pat. No. 4,480,259 disclose that different liquids are used for the liquid generating the bubble by the heat (bubble generating liquid) and for the liquid to be ejected (ejection liquid). In these publications, the ink as the ejection liquid and the bubble generation liquid are completely separated by a flexible film of silicone rubber or the like so as to prevent direct contact of the ejection liquid to the heat generating element while propagating the pressure resulting from the bubble generation of the bubble generation liquid to the ejection liquid by the deformation of the flexible film. The prevention of the deposition of the material on the surface of the heat generating element and the increase of the selection latitude of the ejection liquid are accomplished, by such a structure.

However, with this structure in which the ejection liquid and the bubble generation liquid are completely separated, the pressure by the bubble generation is propagated to the ejection liquid through the expansion-contraction deformation of the flexible film, and therefore, the pressure is absorbed by the flexible film to quite a high degree. In addition, the deformation of the flexible film is not so large, and therefore, the energy use efficiency and the ejection force are deteriorated although the some effect is provided by the provision between the ejection liquid and the bubble generation liquid.

Furthermore, it has been found that consideration is to be preferably made to the heat generating region for forming the bubble, for example, the structural elements such as a movable member or a liquid flow path influential to the growth of the bubble downstream of the center line passing through the center of the area of the electrothermal transducer with respect to the flow direction of the liquid or downstream of the center of the area in the surface influential to the bubble generation.

As to such technique, the assignee of this application has filed Japanese Laid-open Patent Application No. Hei-7-4109.

SUMMARY OF THE INVENTION

Accordingly, it is a principal object of the present invention to provide a liquid ejection method and apparatus, wherein a pressure of the liquid is more efficiently applied to the movable member so that ejection amount and an ejection speed of the liquid are further stabilized, and the control property of the ejection amount of the liquid is further improved.

It is another object of the present invention to provide a liquid ejecting apparatus and a liquid ejecting method wherein heat accumulation of the liquid on the heat generating element is significantly reduced while the ejection efficiency and the ejection pressure are improved, and satisfactory ejection of the liquid is carried out by reduction of the residual bubble on the heat generating element.

It is a further object of the present invention to provide a liquid ejecting method and a liquid ejecting apparatus wherein inertia of the liquid in a direction opposite from the liquid supply direction due to backward wave is suppressed, and simultaneously, the meniscus retraction is reduced by a valve function of the movable member so that refiling frequency is increased to improve the printing speed or the like.

It is a further object of the present invention to provide a liquid ejecting apparatus and a liquid ejection method wherein an amount of accumulated material on the heat generating element is reduced, and the ejection efficiency and the ejection power are high enough with wider range of usable ejection liquid.

It is a yet further object of the present invention to provide a liquid ejecting apparatus and a liquid ejecting method wherein the liquid to be ejected can be selected from a wide range.

A liquid ejection method includes the steps of supplying liquid along a heat generating element disposed along a flow path from upstream of the heat generating element, applying heat generated by the heat generating element to the thus supplied liquid to generate a bubble, thus moving a free end of a movable member having the free end adjacent the ejection outlet side by pressure produced by the generation of the bubble, the movable member being disposed facing the heat generating element, supplying, to a heat generating element for applying thermal energy to the bubble generating region, a driving pulse divided into a first pulse and an adjacent second pulse with interval time therebetween, preheating the liquid by the first pulse to an extent insufficient to eject the liquid through the ejection outlet, and generating a bubble by heating the liquid by the second pulse to eject the liquid through the ejection outlet. The method also involves ejecting liquid in an amount which is determined by controlling a degree of pre-heating of the liquid by changing at least one of a width of the first pulse or the interval time. The change rate of the ejection amount of the liquid increases non-linearly with an increase of the width of the first pulse or an increase of the interval time period.

The invention also pertains to a liquid ejection method involving preparing a head including a first liquid flow path in fluid communication with a liquid ejection outlet, a second liquid flow path having a bubble generation region and a movable member disposed between the first liquid flow path and the bubble generation region and having a free and adjacent the ejection outlet side, generating a bubble in the bubble generation region to displace the free end of the movable member into the first liquid flow path by pressure produced by the generation of the bubble, thus guiding the pressure toward the ejection outlet of the first liquid flow path by the movement of the movable member to eject the liquid, supplying, to a heat generating element for applying thermal energy to the bubble generating region, a driving pulse divided into a first pulse and an adjacent second pulse with interval time therebetween, and pre-heating the liquid by the first pulse to an extent insufficient to eject liquid through the ejection outlet. Other steps include generating a bubble by heating the liquid by the second pulse to eject the liquid through the ejection outlet, and ejecting the liquid in an amount which is determined by controlling a degree of pre-heating of the liquid by changing at least one of the width of the first pulse or the interval time, wherein the change rate of the ejection amount of the liquid increases non-linearly with an increase of the width of the first pulse or an increase of the interval time period.

Other aspects of the invention concerns a liquid ejecting apparatus having a liquid ejection head including an ejection outlet for ejecting the liquid, a heat generating element for generating the bubble in the liquid by applying heat to the liquid, a liquid flow path having a supply passage for supplying the liquid to the heat generating element from upstream thereof and a movable member disposed faced to the heat generating element and having a free end adjacent the ejection outlet, the free end of the movable member being moved by pressure produced by the generation of the bubble to guide the pressure toward the ejection outlet. A supplying means supplies to a heat generating element for applying thermal energy to the bubble generating region a driving pulse divided into a first pulse and an adjacent second pulse with interval time therebetween, thus preheating the liquid by the first pulse to an extent insufficient to eject liquid through the ejection outlet, and thus generating a bubble by heating the liquid by the second pulse to eject the liquid through the ejection outlet, and a control means controls the ejection amount of the liquid by controlling a degree of pre-heating of the liquid by changing at least one of a pulse width of the first pulse or the interval time. The change rate of the ejection amount of the liquid increases non-linearly with an increase of the width of the first pulse or an increase of the interval time period.

A liquid ejection apparatus according to this invention has a liquid ejection head including a first liquid flow path in fluid communication with a liquid ejection outlet, a second liquid flow path having a bubble generation region and a movable member disposed between the first liquid flow path and the bubble generation region and having a free and adjacent the ejection outlet side. A bubble is generated in the bubble generation region to displace the free end of the movable member into the first liquid flow path by pressure produced by the generation of the bubble, thus guiding the pressure toward the ejection outlet of the first liquid flow path by the movement of the movable member to eject the liquid. Also provides is a means for supplying, to a heat generating element for applying thermal energy to the bubble generating region, a driving pulse divided into a first pulse and an adjacent second pulse with interval time therebetween, thus pre-heating the liquid by the first pulse to an extent not sufficient to eject liquid through the ejection outlet, and thus generating a bubble by heating the liquid by the second pulse to eject the liquid through the ejection outlet. A control means controls the ejection amount of the liquid by controlling a degree of pre-heating of the liquid by changing at least one of a pulse width of the first pulse or the interval time, wherein the change rate of the ejection amount of the liquid increases non-linearly with an increase of the width of the first pulse or an increase of the interval time period.

In addition, a liquid ejection method employing this invention includes the steps of preparing a liquid ejection head including an ejection outlet for ejecting the liquid, a heat generating element for generating the bubble in the liquid by applying heat to the liquid, a liquid flow path having a supply passage for supplying liquid to the heat generating element from upstream thereof, and a movable member disposed facing the heat generating element and having a free end adjacent the ejection outlet, the free end of the movable member being moved by pressure produced by the generation of the bubble to guide the pressure toward the ejection outlet, and detecting means for detecting a state quantity of the liquid influential to an ejection amount of the liquid. Another step involves ejecting liquid in an amount which is determined by controlling a pulse width of the driving pulse for the heat generating element in accordance with an output of the detecting means, wherein the change rate of the ejection amount of the liquid increases non-linearly with an increase of the width of the driving pulse.

A further method according to this invention is a liquid ejection method involving providing a liquid ejection head including a first liquid flow path in fluid communication with a liquid ejection outlet, a second-liquid flow path having a bubble generation region and a movable member disposed between the first liquid flow path and the bubble generation region and having a free end adjacent the ejection outlet side, wherein a bubble is generated in the bubble generation region to displace the free end of the movable member into the first liquid flow path by pressure produced by the generation of the bubble, thus guiding the pressure toward the ejection outlet of the first liquid flow path by the movement of the movable member to eject the liquid, a heat generating element for applying thermal energy to the bubble generation region upon supply thereto of a driving pulse, and detecting means for detecting a state quantity of the liquid influential to an ejection amount of the liquid. Another step involves ejecting liquid in an amount which is determined by controlling a pulse width of the driving pulse for the heat generating element in accordance with an output of the detecting means, wherein the change rate of the ejection amount of the liquid increases non-linearly with an increase of the width of the driving pulse.

Furthermore, this invention relates to a liquid ejection method involving preparing a liquid ejection head including an ejection outlet for ejecting the liquid, a heat generating element for generating the bubble in the liquid by applying heat to the liquid, a liquid flow path having a supply passage for supplying the liquid to the heat generating element from upstream thereof, a movable member disposed faced to the heat generating element and having a free and adjacent the ejection outlet, the free end of the movable member being moved by pressure produced by the generation of the bubble to guide the pressure toward the ejection outlet and detecting means for detecting a state to an ejection quantity of the liquid influential amount of the liquid. Other steps concern predicting a state quantity of the liquid influential to an ejection amount of the liquid on the basis of a frequency of ejecting operations of the liquid, and ejecting liquid in an amount which is determined by controlling the pulse width of a driving pulse for the heat generating element on the basis of the predicted amount, wherein the change rate of the ejection amount of the liquid increases non-linearly with an increase of the width of the driving pulse.

Yet another method provides for preparing a liquid ejection-head including a first liquid flow path in fluid communication with a liquid ejection outlet, a second liquid flow path having a bubble generation region and a movable member disposed between the first liquid flow path and the bubble generation region and having a free and adjacent the ejection outlet side, wherein a bubble is generated in the bubble generation region to displace the free end of the movable member into the first liquid flow path by pressure produced by the generation of the bubble, thus guiding the pressure toward the ejection outlet of the first liquid flow path by the movement of the movable member to eject the liquid, a heat generating element for applying thermal energy to the bubble generation region upon supply thereto of a driving pulse, and detecting means for detecting a state quantity of the liquid influential to an ejection amount of the liquid. Other steps include predicting a state quantity of the liquid influential to an ejection amount of the liquid on the basis of a frequency of ejecting operations of the liquid and ejecting liquid in an amount determined b y controlling the pulse width of a driving pulse for the heat generating element on the basis of the predicted amount, wherein the change rate of the ejection amount of the liquid increases non-linearly with an increase of the width of the driving pulse.

Still another method includes the steps of preparing a head having a first liquid flow path in fluid communication with a liquid ejection outlet, a second liquid flow path having a bubble generation region and a movable member disposed between the first liquid flow path and the bubble generation region and having a free end adjacent the ejection outlet side, a heat generating element for applying heat to the bubble generation region upon application of a driving pulse thereto, wherein a bubble is generated in the bubble generation region to displace the free end of the movable member into the first liquid flow path by pressure produced by the generation of the bubble, thus guiding the pressure toward the ejection outlet of the first liquid flow path by the movement of the movable member to eject the liquid, the head including detecting means for detection of a state quantity, influential to an amount of the ejection, of the liquid in one of the first and second liquid passage, predicting a state quantity of the liquid influential to the ejection of the liquid in the other of the first and second liquid passages on the basis of an output of the detecting means, and ejecting liquid in an amount which is determined by controlling a pulse width of a driving pulse for the heat generating element in accordance with an output of the detecting means and the predicted amount, wherein the change rate of the ejection amount of the liquid increases non-linearly with an increase of the width of the driving pulse.

Also a part of this invention is a liquid ejection apparatus having a liquid ejection head including an ejection outlet for ejecting the liquid, a heat generating element for generating the bubble in the liquid by applying heat to the liquid; a liquid flow path having a supply passage for supplying the liquid to the generating element from upstream thereof, a movable member disposed faced to the heat generating element and having a free end adjacent the ejection outlet, the free end of the movable member being moved by pressure produced by the generation of the bubble to guide the pressure toward the ejection outlet, and detecting means for detecting a state quantity of the liquid influential to an ejection amount of the liquid. The apparatus also has a control means for controlling the ejection amount of the liquid by controlling the pulse width of a driving pulse for the heat generating element on the basis of an output of the detecting means, wherein the change rate of the ejection amount of the liquid increases non-linearly with an increase of the width of the driving pulse.

This invention also pertains to a liquid ejection apparatus with a liquid ejection head including a first liquid flow path in fluid communication with a liquid ejection outlet, a second liquid flow path having a bubble generation region and a movable member disposed between the first liquid flow path and the bubble generation region and having a free end adjacent the ejection outlet side, wherein a bubble is generated in the bubble generation region to-displace the free end of the movable member into the first liquid flow path by pressure produced by the generation of the bubble, thus guiding the pressure toward the ejection outlet of the first liquid flow path by the movement of the movable member to eject the liquid, a heat generating element for applying thermal energy to the bubble generation region upon supply thereto of a driving pulse, and detecting means for detecting a state quantity of the liquid influential to an ejection amount of the liquid. A control means controls the ejection amount of the liquid by controlling the pulse width of a driving pulse for the heat generating element on the basis of an output of the detecting means, wherein the change rate of the ejection amount of the liquid increases non-linearly with an increase of the width of the driving pulse.

A further apparatus according to this invention is a liquid ejection apparatus with a liquid ejection head including an ejection outlet for ejecting the liquid, a heat generating element for generating the bubble in the liquid by applying heat to the liquid, a liquid flow path having a supply passage for supplying the liquid to the heat generating element from upstream thereof, and a movable member disposed faced to the heat generating element and having a free end adjacent the ejection outlet, the free and of the movable member being moved by pressure produced by the generation of the bubble to guide the pressure toward the ejection outlet. A predicting means predicts a state quantity of the liquid influential to an ejection amount of the liquid on the basis of a frequency of ejecting operations of the liquid, and a control means controls the ejection amount of the liquid by controlling a pulse width of a driving pulse for the heat generating element on the basis of an output of the predicting means. The change rate of the ejection amount of the liquid increases non-linearly with an increase of the width of the driving pulse.

Another aspect of the invention is a liquid ejection apparatus having a liquid ejection head including a first liquid flow path in fluid communication with a liquid ejection outlet, a second liquid flow path having a bubble generation region and a movable member disposed between the first liquid flow path and the bubble generation region and having a free end adjacent the ejection outlet side, wherein a bubble is generated in the bubble generation region to displace the free end of the movable member into the first liquid flow path by pressure produced by the generation of the bubble, thus guiding the pressure toward the ejection outlet of the first liquid flow path by the movement of the movable member to eject the liquid, and a heat generating element for applying thermal energy to the bubble generation region upon supply thereto of a driving pulse. The apparatus also includes predicting means for predicting a state quantity of the liquid influential to an ejection amount of the liquid on the basis of a frequency of ejecting operations of the liquid and control means for controlling the ejection amount of the liquid by controlling a pulse width of a driving pulse for the heat generating element on basis of an output of the predicting means. The change rate of the ejection amount of the liquid increases non-linearly with an increase of the width of the driving pulse.

Also envisioned is a liquid ejection apparatus having a liquid ejection head including a first liquid flow path in fluid communication with a liquid ejection outlet, a second liquid flow path having a bubble generation region and a movable member disposed between the first liquid flow path and the bubble generation region and having a free and adjacent the ejection outlet side, and a heat generating element for applying heat to the bubble generation region upon application of a driving pulse thereto, wherein a bubble is generated in the bubble generation region to displace the free end of the movable member into the first liquid flow path by pressure produced by the generation of the bubble, thus guiding the toward the ejection outlet of the first liquid flow path by the movement of the movable member to eject the liquid. The head has detecting means for detection of a state quantity, influential to an amount of the ejection, of the liquid in one of the first and second liquid passage. The apparatus further contains predicting means for predicting a state quantity of the liquid influential to the ejection of the liquid in the other of the first and second liquid passages on the basis of an output of the detecting means and control means for controlling the ejection amount of the liquid by controlling a pulse width of a driving pulse for the heat generating element on the basis of an output of the predicting means and the output of the detecting means, wherein the change rate of the ejection amount of the liquid increases non-linearly with an increase of the width of the driving pulse.

According to an aspect of the present invention, a synergistic effect of the generated bubble and the movable member moved thereby, can be provided such that liquid at the neighborhood of the ejection outlet can be efficiently ejected, and therefore, the ejection efficiency is higher than in the conventional bubble jet type ejection method, head and the like.

According to an aspect of the present invention, the density non-uniformity can be corrected more than in conventional since the range of correction of the ejection amount is wider. Therefore, the liquid can be properly ejected.

In this specification, "upstream" and "downstream" are defined with respect to a general liquid flow from a liquid supply source to the ejection outlet through the bubble generation region (movable member).

As regards the bubble per se, the "downstream" is defined as toward the ejection outlet side of the bubble which directly function to eject the liquid droplet. More particularly, it generally means a downstream from the center of the bubble with respect to the direction of the general liquid flow, or a downstream from the center of the area of the heat generating element with respect to the same.

In this specification, "substantially sealed" generally means a sealed state in such a degree that when the bubble grows, the bubble does not escape through a gap (slit) around the movable member before motion of the movable member.

In this specification, "separation wall" may mean a wall (which may include the movable member) interposed to separate the region in direct fluid communication with the ejection outlet from the bubble generation region, and more specifically means a wall separating the flow path including the bubble generation region from the liquid flow path in direct fluid communication with the ejection outlet, thus preventing mixture of the liquids in the liquid flow paths.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 56 is an illustration of a result according to type 4 PWM control according to an embodiment of the present invention.

DESCRIPTION OF THE PREFERRED EMBODIMENTS

In this ejection system, the ejection power and the ejection efficiency are improved by controlling the propagation direction of the pressure produced by the bubble for ejecting the liquid and the growth direction of the bubble.

Figure 1A:
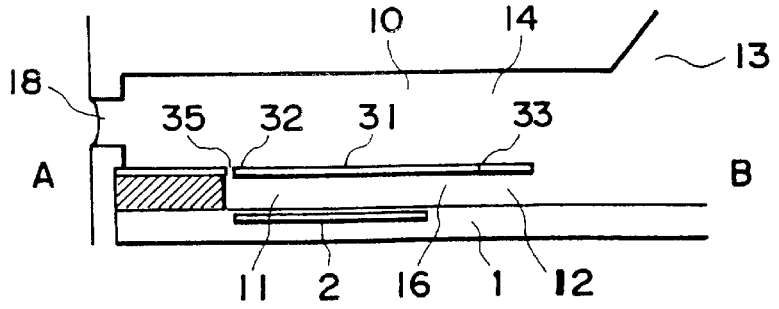
FIGS. 1(*a*)–(*d*) are is a schematic sectional views showing a liquid ejecting head according to a first embodiment of the present invention.
Figure 1B:
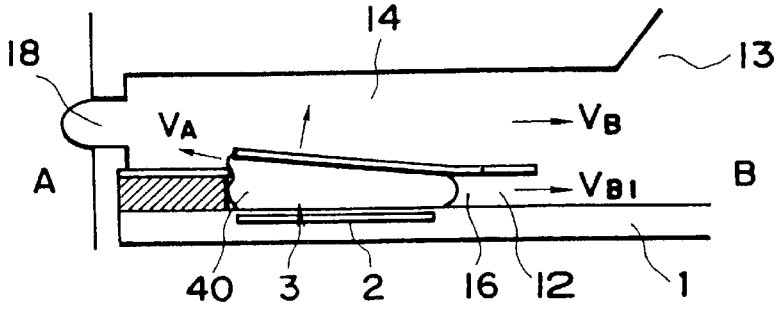
Figure 1C:
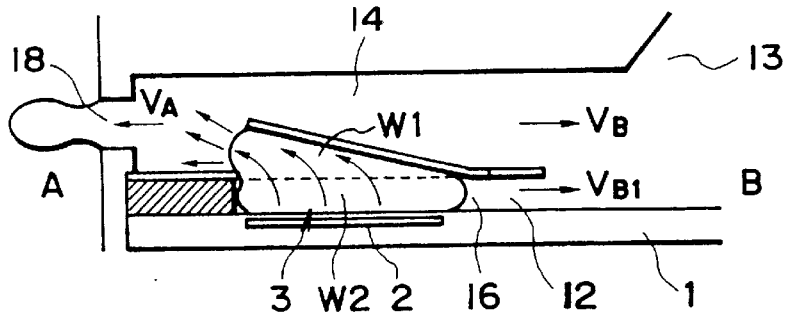
Figure 1D:
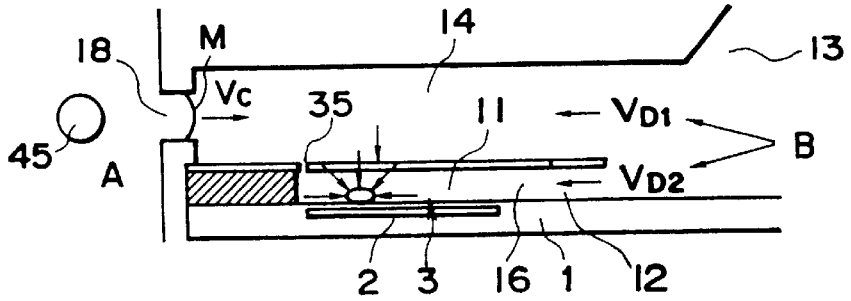
Figure 2:
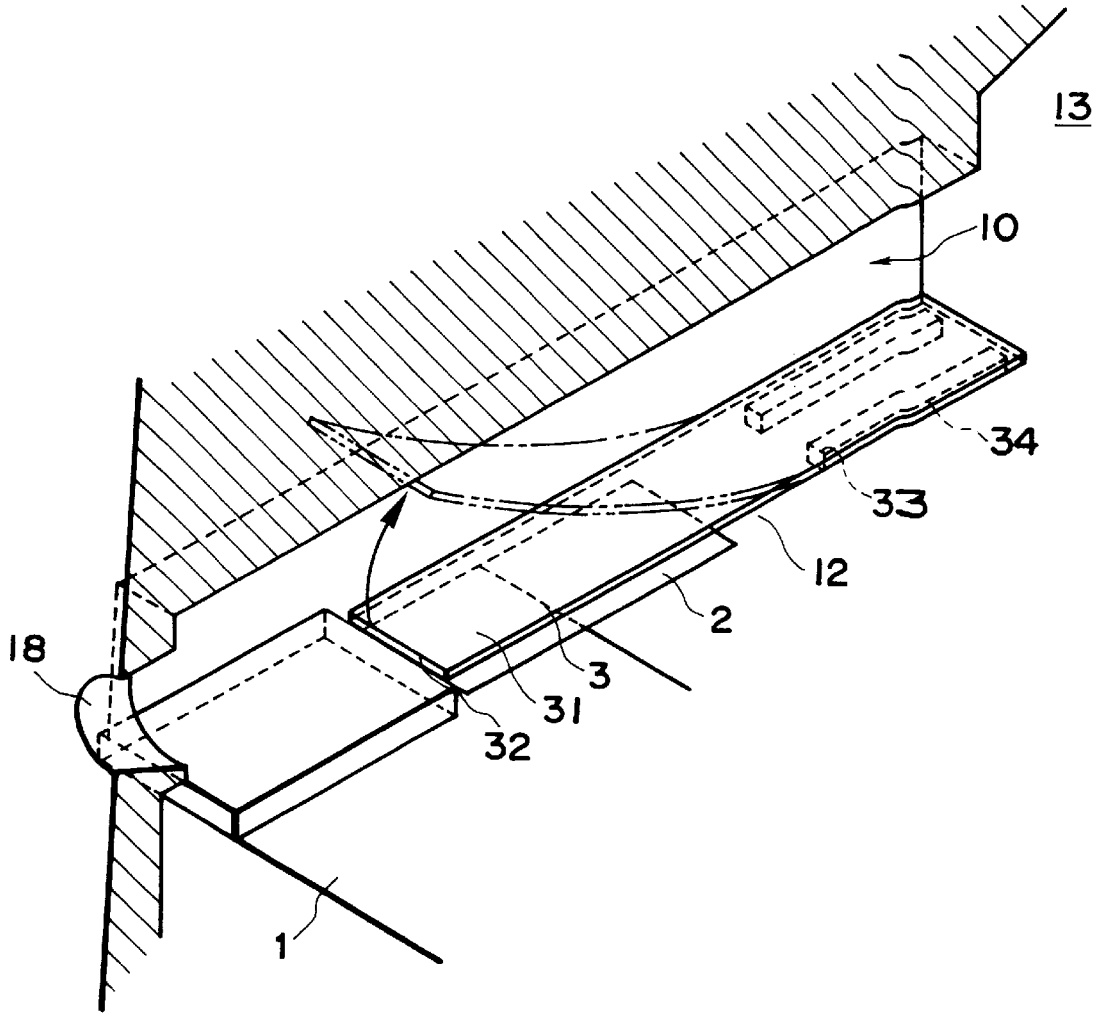
FIG. 2 is a partly broken perspective view of a liquid ejecting head according to the first embodiment of the present invention.

FIG. 1 is a schematic sectional view of a liquid ejecting head taken along a liquid flow path according to this embodiment, and FIG. 2 is a partly broken perspective view of the liquid ejecting head.

The liquid ejecting head of this embodiment comprises a heat generating element 2 (a heat generating resistor of 40 $\mu$m×105 $\mu$m in this embodiment) as the ejection energy generating element for supplying thermal energy to the liquid to eject the liquid, an element substrate 1 on which said heat generating element 2 is provided, and a liquid flow path 10 formed above the element substrate correspondingly to the heat generating element 2. The liquid flow path 10 is in fluid communication with a common liquid chamber 13 for supplying the liquid to a plurality of such liquid flow paths 10 which is in fluid communication with a plurality of the ejection outlets 18.

Above the element substrate in the liquid flow path 10, a movable member or plate 31 in the form of a cantilever of an elastic material such as metal is provided faced to the heat generating element 2. One end of the movable member is fixed to a foundation (supporting member) 34 or the like provided by patterning of photosensitivity resin material on the wall of the liquid flow path 10 or the element substrate. By this structure, the movable member is supported, and a fulcrum (fulcrum portion) is constituted.

The movable member 31 is so positioned that it has a fulcrum (fulcrum portion which is a fixed end) 33 in an upstream side with respect to a general flow of the liquid from the common liquid chamber 13 toward the ejection outlet 18 through the movable member 31 caused by the ejecting operation and that it has a free end (free end portion) 32 in a downstream side of the fulcrum 33. The movable member 31 is faced to the heat generating element 2 with a gap of 15 $\mu$m approx. as if it covers the heat generating element 2. A bubble generation region is constituted between the heat generating element and movable member. The type, configuration or position of the heat generating element or the movable member is not limited to the ones described above, but may be changed as long as the growth of the bubble and the propagation of the pressure can be controlled. For the purpose of easy understanding of the flow of the liquid which will be described hereinafter, the liquid flow path 10 is divided by the movable member 31 into a first liquid flow path 14 which is directly in communication with the ejection outlet 18 and a second liquid flow path 16 having the bubble generation region 11 and the liquid supply port 12.

By causing heat generation of the heat generating element 2, the heat is applied to the liquid in the bubble generation region 11 between the movable member 31 and the heat generating element 2, by which a bubble is generated by the film boiling phenomenon as disclosed in U.S. Pat. No. 4,723,129. The bubble and the pressure caused by the generation of the bubble act mainly on the movable member, so that the movable member 31 moves or displaces to widely open toward the ejection outlet side about the fulcrum 33, as shown in FIGS. 1, (*b*) and (*c*) or in FIG. 2. By the displacement of the movable member 31 or the state after the displacement, the propagation of the pressure caused by the generation of the bubble and the growth of the bubble per se are directed toward the ejection outlet.

Here, one of the fundamental ejection principles according to the present invention will be described. One of important principles of this invention is that the movable member disposed faced to the bubble is displaced from the normal first position to the displaced second position on the basis of the pressure of the bubble generation or the bubble per se, and the displacing or displaced movable member 31 is effective to direct the pressure produced by the generation of the bubble and/or the growth of the bubble per se toward the ejection outlet 18 (downstream side).

Figure 3:
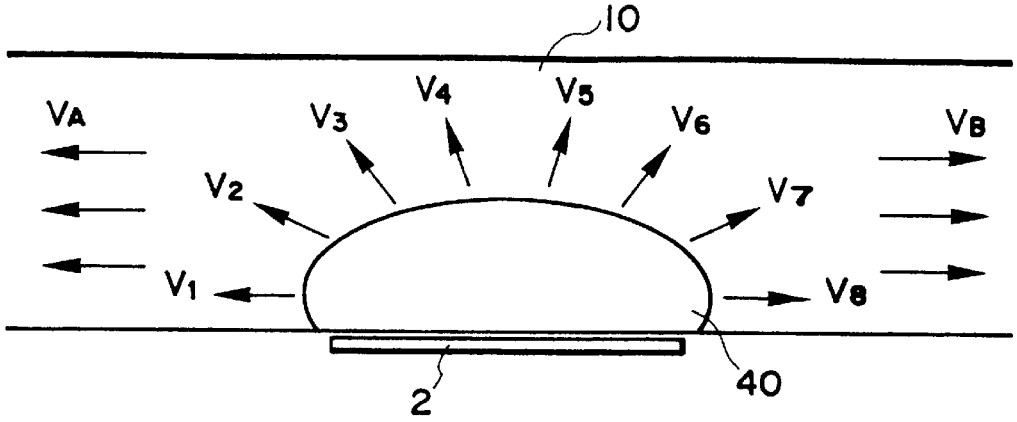
FIG. 3 PRIOR ART
FIG. 3 is a schematic view showing pressure propagation from a bubble in a conventional head.
Figure 4:
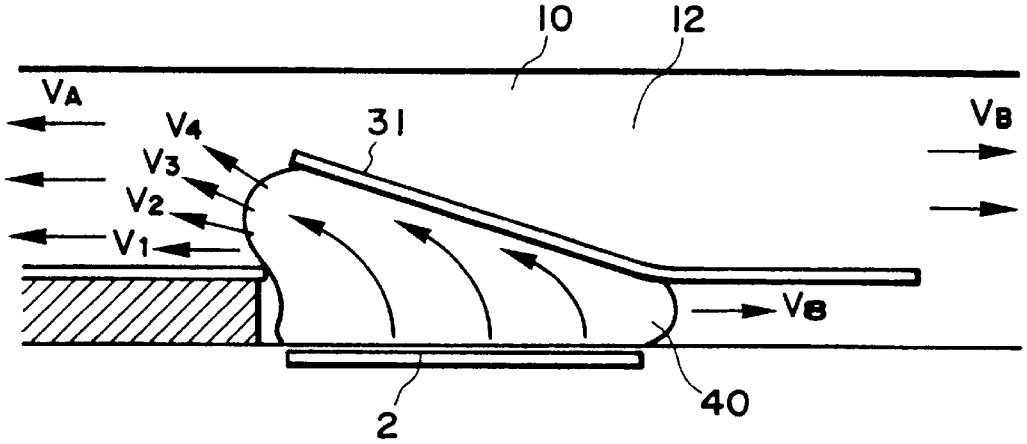
FIG. 4 is a schematic view showing a pressure propagation from a bubble in the head according to the first embodiment of the present invention.

More detailed description will be made with comparison between the conventional liquid flow passage structure not using the movable member (FIG. 3) and the present invention (FIG. 4). Here, the direction of propagation of the pressure toward the ejection outlet is indicated by $V_A$, and the direction of propagation of the pressure toward the upstream is indicated by $V_B$.

In a conventional head as shown in FIG. 3, there is not any structural element effective to regulate the direction of the propagation of the pressure produced by the bubble 40 generation. Therefore, the direction of the pressure propagation of the is normal to the surface of the bubble as indicated by V1–V8, and therefore, is widely directed in the passage. Among these directions, those of the pressure propagation from the half portion of the bubble closer to the ejection outlet (V1–V4) have the pressure components in the $V_A$ direction which is most effective for the liquid ejection. This portion is important since it directly contributable to the liquid ejection efficiency, the liquid ejection pressure and the ejection speed. Furthermore, the component V1 is closest to the direction of $V_A$ which is the ejection direction, and therefore, is most effective, and the V4 has a relatively small component in the direction $V_A$.

On the other hand, in the case of the present invention, shown in FIG. 4, the movable member 31 is effective to direct, to the downstream (ejection outlet side), the pressure propagation directions V1–V4 of the bubble which otherwise are toward various directions. Thus, the pressure propagations of bubble 40 are concentrated, so that the pressure of the bubble 40 is directly and efficiently contributable to the ejection.

The growth direction per se of the bubble is directed downstream similarly to to the pressure propagation directions V1–V4, and grow more in the downstream side than in the upstream side. Thus, the growth direction per se of the bubble is controlled by the movable member, and the pressure propagation direction from the bubble is controlled thereby, so that the ejection efficiency, ejection force and ejection speed or the like are fundamentally improved.

Referring back to FIG. 1, the ejecting operation of the liquid ejecting head in this embodiment will be described in detail.

FIG. 1, (*a*) shows a state before the energy such as electric energy is applied to the heat generating element 2, and therefore, no heat has yet been generated. It should be noted that the movable member 31 is so positioned as to be faced at least to the downstream portion of the bubble generated by the heat generation of the heat generating element. In other words, in order that the downstream portion of the bubble acts on the movable member, the liquid flow passage structure is such that the movable member 31 extends at least to the position downstream (downstream of a line passing through the center 3 of the area of the heat generating element and perpendicular to the length of the flow path) of the center 3 of the area of the heat generating element.

FIG. 1, (*b*) shows a state wherein the heat generation of heat generating element 2 occurs by the application of the electric energy to the heat generating element 2, and a part of of the liquid filled in the bubble generation region 11 is heated by the thus generated heat so that a bubble is generated through the film boiling.

At this time, the movable member 31 is displaced from the first position to the second position by the pressure produced by the generation of the bubble 40 so as to guide the propagation of the pressure toward the ejection outlet. It should be noted that, as described hereinbefore, the free end 32 of the movable member 31 is disposed in the downstream side (ejection outlet side), and the fulcrum 33 is disposed in the upstream side (common liquid chamber side), so that at least a part of the movable member is faced to the downstream portion of the bubble, that is, the downstream portion of the heat generating element.

FIG. 1, (*c*) shows a state in which the bubble 40 has further grown. By the pressure resulting from the bubble 40 generation, the movable member 31 is displaced further. The generated bubble grows more downstream than upstream, and it expands greatly beyond a first position (broken line position) of the movable member. Thus, it is understood that in accordance with the growth of the bubble 40, the movable member 31 gradually displaces, by which the pressure propagation direction of the bubble 40, the direction in which the volume movement is easy, namely, the growth direction of the bubble, are directed uniformly toward the ejection outlet, so that the ejection efficiency is increased. When the movable member guides the bubble and the bubble generation pressure toward the ejection outlet, it hardly obstructs propagation and growth, and can efficiently control the propagation direction of the pressure and the growth direction of the bubble in accordance with the degree of the pressure.

FIG. 1, (*d*) shows the bubble 40 contracting and extinguishing by the decrease of the internal pressure of the bubble after the film boiling.

The movable member 31 having been displaced to the second position returns to the initial position (first position) of FIG. 2, (*a*) by the restoring force provided by the spring property of the movable member per se and the negative pressure due to the contraction of the bubble. Upon the collapse of bubble, the liquid flows back from the common liquid chamber side as indicated by $V_{D1}$ and $V_{D2}$ and from the ejection outlet side as indicated by $V_C$ so as to compensate for the volume reduction of the bubble in the bubble generation region 11 and to compensate for the volume of the ejected liquid.

In the foregoing, the description has been made as to the operation of the movable member 31 with the generation of the bubble and the ejecting operation of the liquid now, the description will be made as to the refilling of the liquid in the liquid ejecting head of the present invention.

Referring to FIG. 1, liquid supply mechanism will be described.

When the bubble 40 enters the bubble collapsing process after the maximum volume thereof (FIG., (*c*)), a volume of the liquid enough to compensate for the collapsing bubbling volume flows into the bubble generation region from the ejection outlet 18 side of the first liquid flow path 14 and from the common liquid chamber side 13 of the second liquid flow path 16. In the case of conventional liquid flow passage structure not having the movable member 31, the amount of the liquid from the ejection outlet side to the bubble collapse position and the amount of the liquid from the common liquid chamber thereinto, correspond to the flow resistances of the portion closer to the ejection outlet than the bubble generation region and the portion closer to the common liquid chamber (flow path resistances and the inertia of the liquid).

Therefore, when the flow resistance at the supply port side is smaller than the other side, a large amount of the liquid flows into the bubble collapse position from the ejection outlet side with the result that the meniscus retraction is large. With the reduction of the flow resistance in the ejection outlet for the purpose of increasing the ejection efficiency, the meniscus M retraction increases upon the collapse of bubble with the result of longer refilling time period, thus making high speed printing difficult.

According to this embodiment, because of the provision of the movable member 31, the meniscus retraction stops at the time when the movable member returns to the initial position upon the collapse of bubble, and thereafter, the supply of the liquid to fill a volume W2 is accomplished by the flow $V_{D2}$ through the second flow path 16 (W1 is a volume of an upper side of the bubble volume W beyond the first position of the movable member 31, and W2 is a volume of a bubble generation region 11 side thereof). In the prior art, a half of the volume of the bubble volume W is the volume of the meniscus retraction, but according to this embodiment, only about one half (W1) is the volume of the meniscus retraction.

Additionally, the liquid supply for the volume W2 is forced to be effected mainly from the upstream ($V_{D2}$) of the second liquid flow path along the surface of the heat generating element side of the movable member 31 using the pressure upon the collapse of bubble, and therefore, more speedy refilling action is accomplished.

When the refilling using the pressure upon the collapse of bubble is carried out in a conventional head, the vibration of the meniscus is expanded with the result of the deterioration of the image quality. However, according to this embodiment, the flows of the liquid in the first liquid flow path 14 at the ejection outlet side and the ejection outlet side of the bubble generation region 11 are suppressed, so that the vibration of the meniscus is reduced.

Thus, according to this embodiment, the high speed refilling is accomplished by the forced refilling to the bubble generation region through the liquid supply passage 12 of the second flow path 16 and by the suppression of the meniscus retraction and vibration. Therefore, the stabilization of ejection and high speed repeated ejections are accomplished, and when the embodiment is used in the field of recording, the improvement in the image quality and in the recording speed can be accomplished.

The embodiment provides the following effective function. It is a suppression of the propagation of the pressure to the upstream side (back wave) produced by the generation of the bubble. The pressure due to the common liquid chamber 13 side (upstream) of the bubble generated on the heat generating element 2 mostly has resulted in force which pushes the liquid back to the upstream side (back wave). The back wave deteriorates the refilling of the liquid into the liquid flow path by the pressure at the upstream side, the resulting motion of the liquid and the resulting inertia force. In this embodiment, these actions to the upstream side are suppressed by the movable member 31, so that the refilling performance is further improved.

The description will be made as to a further characterizing feature and the advantageous effect.

The second liquid flow path 16 of this embodiment has a liquid supply passage 12 having an internal wall substantially flush with the heat generating element 2 (the surface of the heat generating element is not greatly stepped down) at the upstream side of the heat generating element 2. With this structure, the supply of the liquid to the surface of the heat generating element 2 and the bubble generation region 11 occurs along the surface of the movable member 31 at the position closer to the bubble generation region 11 as indicated by $V_{D2}$. Accordingly, stagnation of the liquid on the surface of the heat generating element 2 is suppressed, so that precipitation of the gas dissolved in the liquid is suppressed, and the residual bubbles not disappeared are removed without difficulty, and in addition, the heat accumulation in the liquid is not too much. Therefore, the stabilized bubble generation can be repeated at a high speed. In this embodiment, the liquid supply passage 12 has a substantially flat internal wall, but this is not limiting, and the liquid supply passage is satisfactory if it has an internal wall with such a configuration smoothly extended from the surface of the heat generating element that the stagnation of the liquid occurs on the heat generating element, and eddy flow is not significantly caused in the supply of the liquid.

The supply of the liquid into the bubble generation region may occur through a gap at a side portion of the movable member (slit 35) as indicated by $V_{D1}$. In order to direct the pressure upon the bubble generation further effectively to the ejection outlet, a large movable member covering the entirety of the bubble generation region (covering the surface of the heat generating element) may be used, as shown in FIG. 1. Then, the flow resistance for the liquid between the bubble generation region 11 and the region of the first liquid flow path 14 close to the ejection outlet is increased by the restoration of the movable member to the first position, so that the flow of the liquid to the bubble generation region 11 along $V_{D1}$ can be suppressed. However, according to the head structure of this embodiment, there is a flow effective to supply the liquid to the bubble generation region, the supply performance of the liquid is greatly increased, and therefore, even if the movable member 31 covers the bubble generation region 11 to improve the ejection efficiency, the supply performance of the liquid is not deteriorated.

Figure 5:
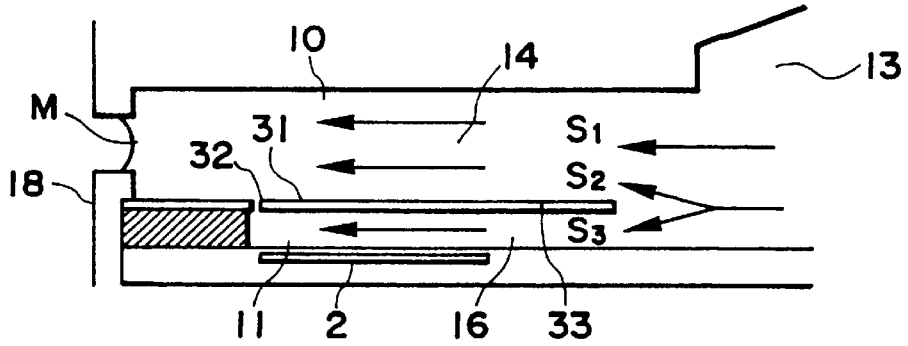
FIG. 5 is a schematic view illustrating flow of liquid in the head of the first embodiment.

The positional relation between the free end 32 and the fulcrum 33 of the movable member 31 is such that the free end is at a downstream position of the fulcrum as shown in FIG. 5, for example. With this structure, the function and effect of guiding the pressure propagation direction and the direction of the growth of the bubble to the ejection outlet side or the like-can be efficiently assured upon the bubble generation. Additionally, the positional relation is effective to accomplish not only the function or effect relating to the ejection but also the reduction of the flow resistance through the liquid flow path 10 upon the supply of the liquid thus permitting the high speed refilling. When the meniscus M retracted by the ejection as shown in FIG. 5, returns to the ejection outlet 18 by capillary force or when the liquid supply is effected to compensate for the collapse of bubble, the positions of the free end and the fulcrum 33 are such that the flows $S_1$, $S_2$ and $S_3$ through the liquid flow path 10 including the first liquid flow path 14 and the second liquid flow path 16, are not impeded.

More particularly, in this embodiment, as described hereinbefore, the free end 32 of the movable member 3 is faced to a downstream position of the center 3 of the area which divides the heat generating element 2 into an upstream region and a downstream region (the line passing through the center (central portion) of the area of the heat generating element and perpendicular to a direction of the length of the liquid flow path). The movable member 31 receives the pressure and the bubble which are greatly contributable to the ejection of the liquid at the downstream side of the area center position 3 of the heat generating element, and it guides the force to the ejection outlet side, thus fundamentally improving the ejection efficiency or the ejection force.

Further advantageous effects are provided using the upstream side of the bubble, as described hereinbefore.

Furthermore, it is considered that in the structure of this embodiment, the instantaneous mechanical movement of the free end of the movable member 31, contributes to the ejection of the liquid.

<Embodiment 2>

Figure 6:
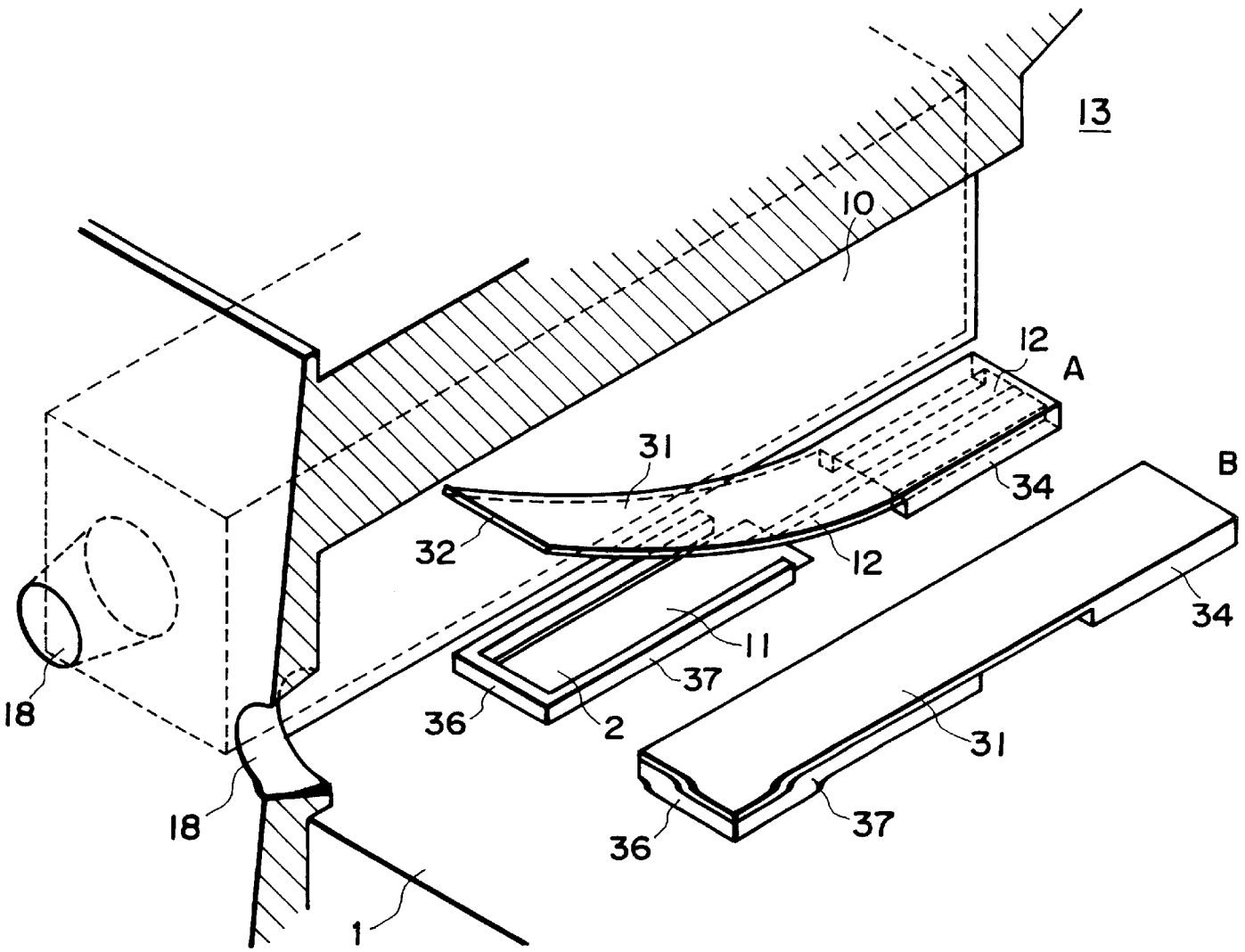
FIG. 6 is a partly broken perspective view of a liquid ejecting head according to a second embodiment of the present invention.

FIG. 6 shows a second embodiment. In FIG. 6, A shows a displaced movable member although bubble is not shown, and B shows the movable member in the initial position (first position) wherein the bubble generation region 11 is substantially sealed relative to the ejection outlet 18. Although not shown, there is a flow passage wall between A and B to separate the flow paths.

A foundation 34 is provided at each side, and between them, a liquid supply passage 12 is constituted. With this structure, the liquid can be supplied along a surface of the movable member faced to the heat generating element side and from the liquid supply passage having a surface substantially flush with the surface of the heat generating element or smoothly continuous therewith.

When the movable member 31 is at the initial position (first position), the movable member 31 is close to or closely contacted to a downstream wall 36 disposed downstream of the heat generating element 2 and heat generating element side walls 37 disposed at the sides of the heat generating element, so that the ejection outlet 18 side of the bubble generation region 11 is substantially sealed. Thus, the pressure produced by the bubble at the time of the bubble generation and particularly the pressure downstream of the bubble, can be concentrated on the free end side side of the movable member, without releasing the pressure.

In the process of the collapse of bubble, the movable member 31 returns to the first position, and the ejection outlet side of the bubble generation region 31 is substantially sealed, and therefore, the meniscus retraction is suppressed, and the liquid supply to the heat generating element is carried out with the advantages described hereinbefore. As regards the refilling, the same advantageous effects can be provided as in the foregoing embodiment.

In this embodiment, the foundation 34 for supporting and fixing the movable member 31 is provided at an upstream position away from the heat generating element 2, as shown in FIG. 2 and FIG. 6, and the foundation 34 has a width smaller than the liquid flow path 10 to supply the liquid to the liquid supply passage 12. The configuration of the foundation 34 is not limited to this structure, but may be anyone if smooth refilling is accomplished.

In this example, the clearance between the movable member 31 and the heat generating element 2 is 15 $\mu$m approx., but it may be different if the pressure produced by the bubble is sufficiently transmitted to the movable member.

Figure 7:
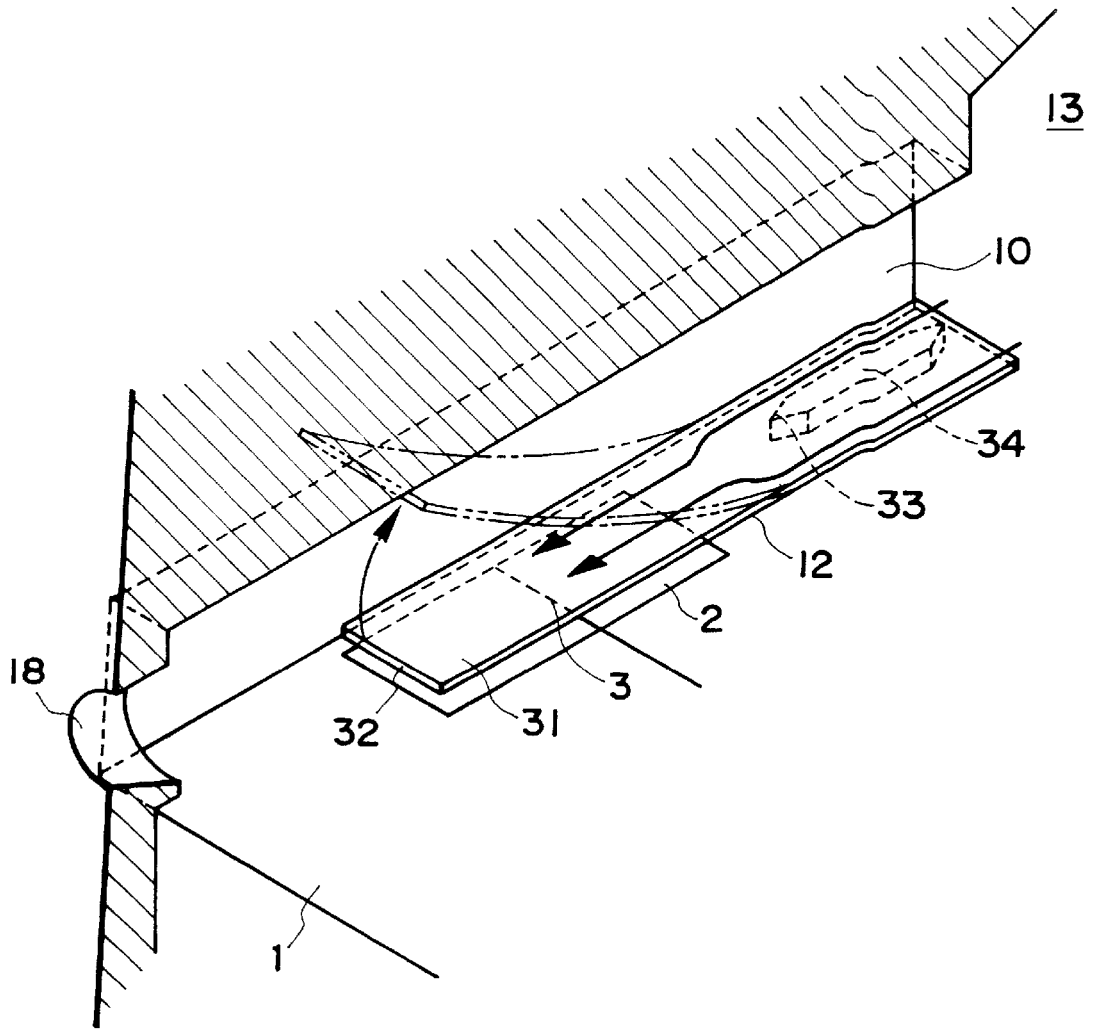
FIG. 7 is a partly broken perspective view of a liquid ejecting head according to a third embodiment of the present invention.

FIG. 7 shows one of the fundamental aspects of the present invention. FIG. 7 shows a positional relation among a bubble generation region, bubble and the movable member in one liquid flow path to further describe the liquid ejecting method and the refilling method according to an aspect of the present invention.

In the above described embodiment, the pressure by the generated bubble is concentrated on the free end of the movable member to accomplish the quick movement of the movable member and the concentration of the movement of the bubble to the ejection outlet side. In this embodiment, the bubble is relatively free, while a downstream portion of the bubble which is at the ejection outlet side directly contributable to the droplet ejection, is regulated by the free end side of the movable member.

More particularly, the projection (hatched portion) functioning as a barrier provided on the heat generating element substrate 1 of FIG. 2 is not provided in this embodiment. The free end region and opposite lateral end regions of the movable member do not substantially seal the bubble generation region relative to the ejection outlet region, but it opens the bubble generation region to the ejection outlet region, in this embodiment.

In this embodiment, the growth of the bubble is permitted at the downstream leading end portion of the downstream portions having direct function for the liquid droplet ejection, and therefore, the pressure component is effectively used for the ejection. Additionally, the upward pressure in this downstream portion (component forces $V_{B2}$, $V_{B3}$ and $V_{B4}$) acts such that the free end side portion of the movable member is added to the growth of the bubble at the leading end portion. Therefore, the ejection efficiency is improved similarly to the foregoing embodiments. As compared with the embodiment, this embodiment is better in the responsivity to the driving of the heat generating element.

The structure of this embodiment is simple, and therefore, the manufacturing is easy.

The fulcrum portion of the movable member 31 of this embodiment is fixed on one foundation 34 having a width smaller than that of the surface of the movable member. Therefore, the liquid supply to the bubble generation region 11 upon the collapse of bubble occurs along both of the lateral sides of the foundation (indicated by an arrow). The foundation may be in another form if the liquid supply performance is assured.

In the case of this embodiment, the existence of the movable member is effective to control the flow into the bubble generation region from the upper part upon the collapse of bubble, the refilling for the supply of the liquid is better than the conventional bubble generating structure having only the heat generating element. The retraction of the meniscus is also decreased thereby.

In a preferable modified embodiment of the third midification, both of the lateral sides (or only one lateral side) are substantially sealed for the bubble generation region 11. With such a structure, the pressure toward the lateral side of the movable member is also directed to the ejection outlet side end portion, so that the ejection efficiency is further improved.

Figure 8:
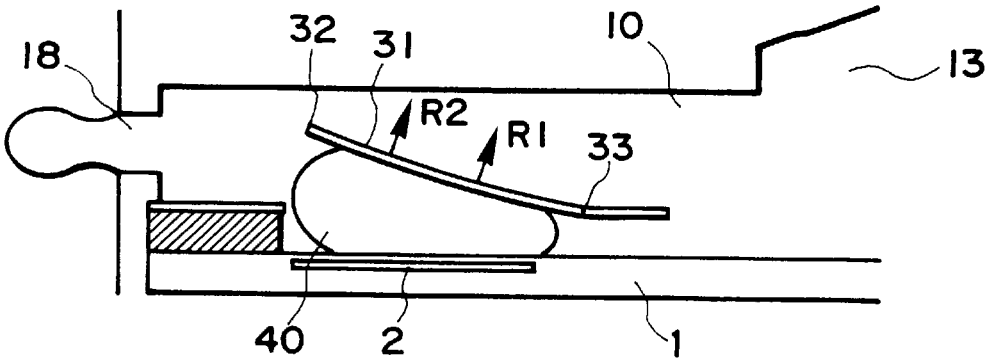
FIG. 8 is a sectional view of a liquid ejecting head according to a fourth embodiment of the present invention.

In the following embodiment, the ejection force for the liquid by the mechanical displacement is further improved. FIG. 8 is a cross-sectional view of this embodiment. In FIG. 8, the movable member is extended such that the position of the free end of the movable member 31 is positioned further downstream of the heat generating element. By this, the displacing speed of the movable member at the free end position is further increased, so that the generation of the ejection pressure by the displacement of the movable member is further improved.

In addition, the free end is closer to the ejection outlet side than in the foregoing embodiment, and therefore, the growth of the bubble can be concentrated toward the stabilized direction, thus assuring the better ejection.

In response to the growth speed of the bubble at the central portion of the pressure of the bubble, the movable member 31 displaces at a displacing speed R1. the free end 32 which is at a position further than this position from the fulcrum 33, displaces at a higher speed R2. Thus, the free end 32 mechanically acts on the liquid at a higher speed to increase the ejection efficiency.

The free end configuration is such that, as is the same as in FIG. 7, the edge is vertical to the liquid flow, by which the pressure of the bubble and the mechanical function of the movable member are more efficiently contributable to the ejection.

Figure 9A:
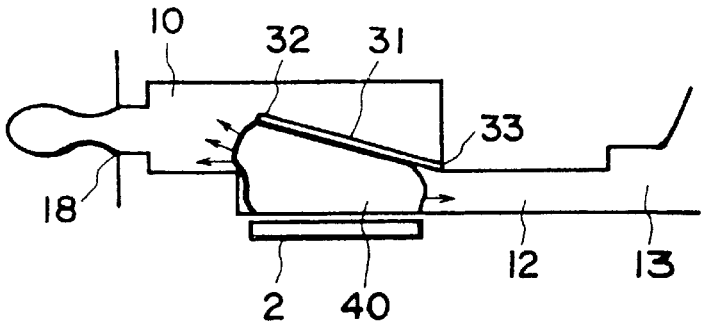
FIGS. 9(*a*)–(*c*) are is a schematic sectional views of a liquid ejecting head according to a fifth embodiment of the present invention.
Figure 9B:
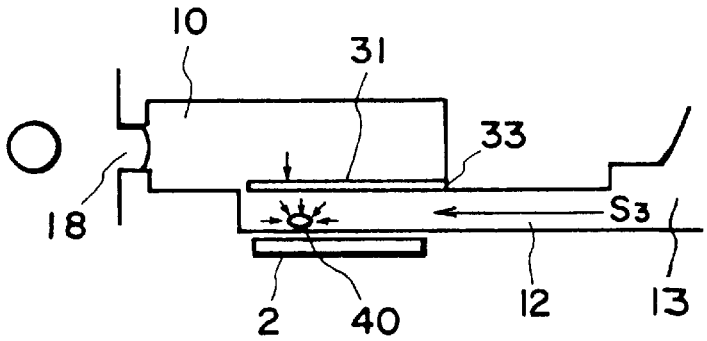
Figure 9C:
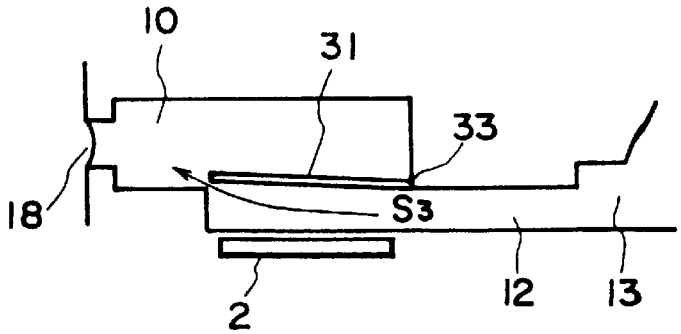

FIGS. 9, (*a*), (*b*) and (*c*) illustrate a fifth embodiment of ejection method of the present invention.

As is different from the foregoing embodiment, the region in direct communication with the ejection outlet is not in communication with the liquid chamber side, by which the structure is simplified.

The liquid is supplied only from the liquid supply passage 12 along the surface of the bubble generation region side of the movable member 31. The free end 32 of the movable member 31, the positional relation of the fulcrum 33 relative to the ejection outlet 18 and the structure of facing to the heat generating element 2 are similar to the above-described embodiment.

According to this embodiment, the advantageous effects in the ejection efficiency, the liquid supply performance and so on described above, are accomplished. Particularly, the retraction of the meniscus is suppressed, and a forced refilling is effected substantially thoroughly using the pressure upon the collapse of bubble.

FIG. 9, (*a*) shows a state in which the bubble generation is caused by the heat generating element 2, and FIG. 9, (*b*) shows the state in which the bubble is going to contract. At this time, the returning of the movable member 31 to the initial position and the liquid supply by $S_3$ are effected.

In FIG. 9, (*c*), the small retraction M of the meniscus upon the returning to the initial position of the movable member, is being compensated for by the refilling by the capillary force in the neighborhood of the ejection outlet 18.

The description will be made as to another example.

The ejection principle for the liquid in this embodiment is the same as in the foregoing embodiment. The liquid flow path has a multi-passage structure, and the liquid (bubble generation liquid) for bubble generation by the heat, and the liquid (ejection liquid) mainly ejected, are separated.

Figure 10:
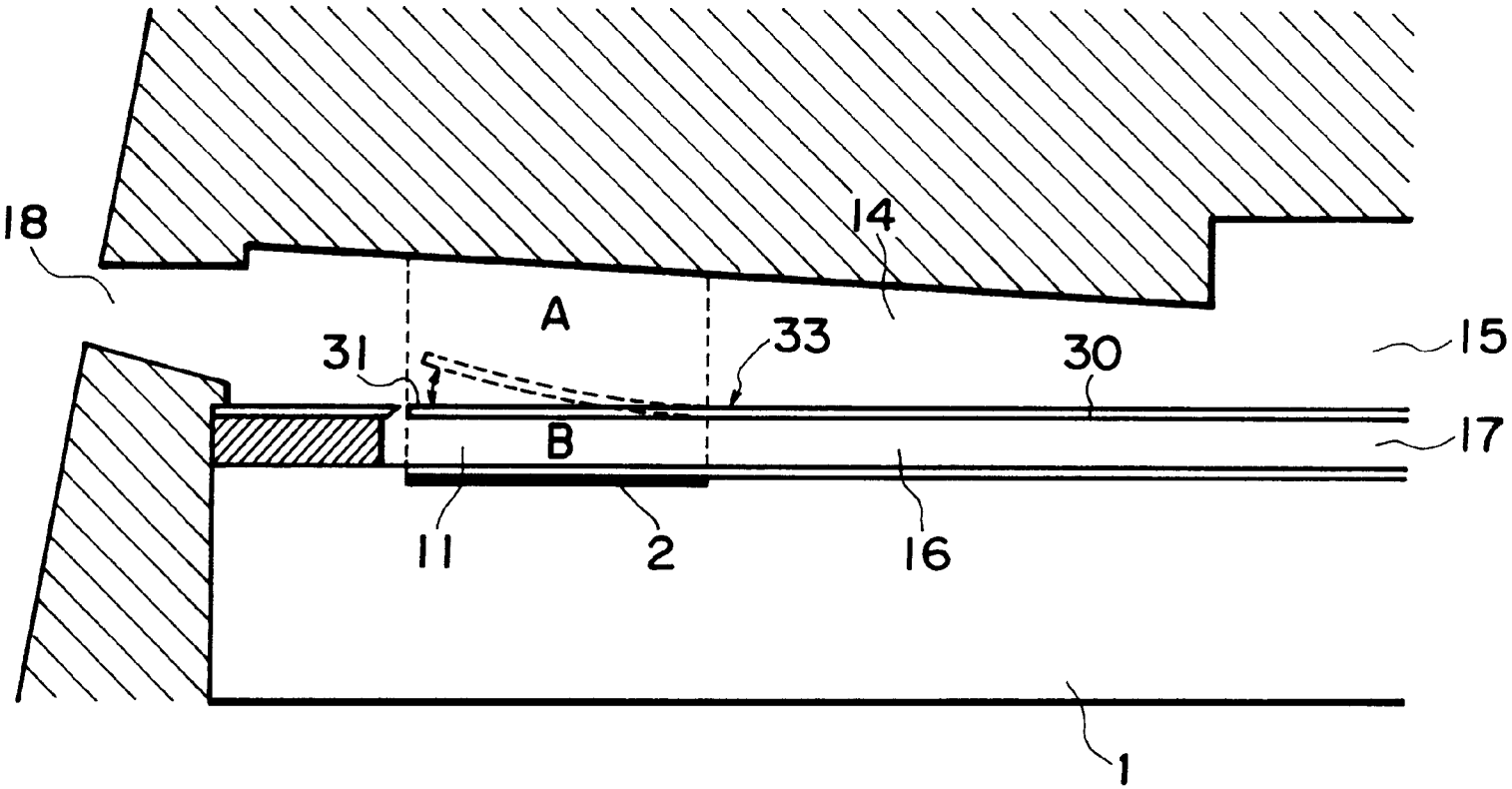
FIG. 10 is a sectional view of a liquid ejecting head (two-flow-path type) of a sixth embodiment of the present invention.

FIG. 10 is a sectional schematic view in a direction along the flow path of the liquid ejecting head of this embodiment.

In the liquid ejecting head of this embodiment, a second liquid flow path 16 for the bubble generation is provided on the element substrate 1 which is provided with a heat generating element 2 for supplying thermal energy for generating the bubble in the liquid, and a first liquid flow path 14 for the ejection liquid in direct communication with the ejection outlet 18 is formed thereabove.

The upstream side of the first liquid flow path is in fluid communication with a first common liquid chamber 15 for supplying the ejection liquid into a plurality of first liquid flow paths, and the upstream side of the second liquid flow path is in fluid communication with the second common liquid chamber for supplying the bubble generation liquid to a plurality of second liquid flow paths.

In the case that the bubble generation liquid and ejection liquid are the same liquids, the number of the common liquid chambers may be one.

Between the first and second liquid flow paths, there is a separation wall 30 of an elastic material such as metal so that the first flow path and the second flow path are separated. In the case that mixing of the bubble generation liquid and the ejection liquid should be minimum, the first liquid flow path 14 and the second liquid flow path 16 are preferably isolated by the partition wall. However, when the mixing to a certain extent is permissible, the complete isolation is not inevitable.

A portion of the partition wall in the upward projection space of the heat generating element (ejection pressure generation region including A and B (bubble generation region 11) in FIG. 10), is in the form of a cantilever movable member 31, formed by slits 35, having a fulcrum 33 at the common liquid chamber (15, 17) side and free end at the ejection outlet side (downstream with respect to the general flow of the liquid). The movable member 31 is faced to the surface, and therefore, it operates to open toward the ejection outlet side of the first liquid flow path upon the bubble generation of the bubble generation liquid (direction of the arrow in the Figure). In an example of FIG. 11, too, a partition wall 30 is disposed, with a space for constituting a second liquid flow path, above an element substrate 1 provided with a heat generating resistor portion as the heat generating element 2 and wiring electrodes 5 for applying an electric signal to the heat generating resistor portion.

As for the positional relation among the fulcrum 33 and the free end 32 of the movable member 31 and the heat generating element, are the same as in the previous example.

In the previous example, the description has been made as to the relation between the structures of the liquid supply passage 12 and the heat generating element 2. The relation between the second liquid flow path 16 and the heat generating element 2 is the same in this embodiment.

Figure 12A:
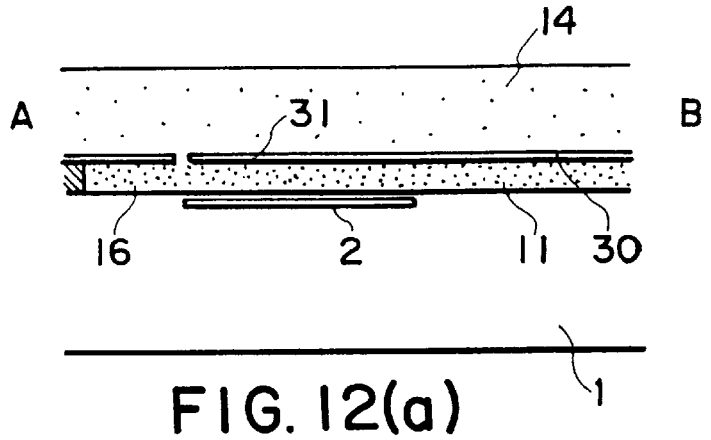
FIGS. 12(*a*) and 12(*b*) illustrate an operation of a movable member in a liquid ejecting head according to the sixth embodiment of the present invention.
Figure 12B:
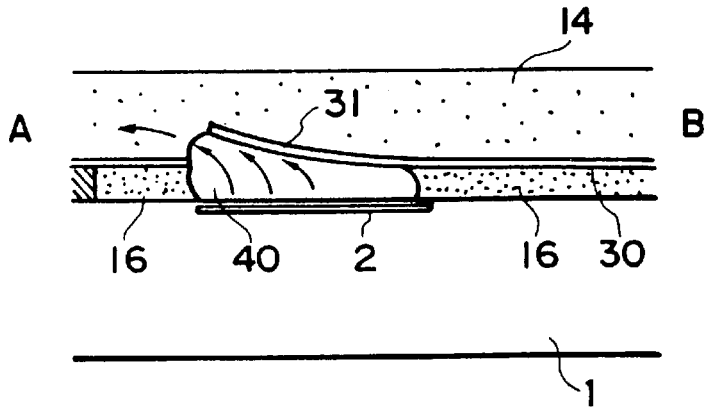

Referring to FIG. 12, the operation of the liquid ejecting head of this embodiment will be described.

The used ejection liquid in the first liquid flow path 14 and the used bubble generation liquid in the second liquid flow path 16 were the same water base inks.

By the heat generated by the heat generating element 2, the bubble generation liquid in the bubble generation region in the second liquid flow path generates a bubble 40, by film boiling phenomenon as described hereinbefore.

In this embodiment, the bubble generation pressure is not released in the three directions except for the upstream side in the bubble generation region, so that the pressure produced by the bubble generation is propagated concentratedly on the movable member 6 side in the ejection pressure generation portion, by which the movable member 6 is displaced from the position indicated in FIG. 12, (*a*) toward the first liquid flow path side as indicated in FIG. 12, (*b*) with the growth of the bubble. By the operation of the movable member, the first liquid flow path 14 and the second liquid flow path 16 are in wide fluid communication with each other, and the pressure produced by the generation of the bubble is mainly propagated toward the ejection outlet in the first liquid flow path (direction A). By the propagation of the pressure and the mechanical displacement of the movable member, the liquid is ejected through the ejection outlet.

Then, with the contraction of the bubble, the movable member 31 returns to the position indicated in FIG. 12, (*a*), and correspondingly, an amount of the liquid corresponding to the ejection liquid is supplied from the upstream in the first liquid flow path 14. In this embodiment, the direction of the liquid supply is codirectional with the closing of the movable member as in the foregoing embodiments, the refilling of the liquid is not impeded by the movable member.

The major functions and effects as regards the propagation of the bubble generation pressure with the displacement of the movable wall, the direction of the bubble growth, the prevention of the back wave and so on, in this embodiment, are the same as with the first embodiment, but the two-flow-path structure is advantageous in the following points.

The ejection liquid and the bubble generation liquid may be separated, and the ejection liquid is ejected by the pressure produced in the bubble generation liquid. Accordingly, a high viscosity liquid such as polyethylene glycol or the like with which bubble generation and therefore ejection force is not sufficient by heat application, and which has not been ejected in good order, can be ejected. For example, this liquid is supplied into the first liquid flow path, and liquid with which the bubble generation is in good order is supplied into the second path as the bubble generation liquid. An example of the bubble generation liquid a mixture liquid (1–2 cP approx.) of the anol and water (4:6). By doing so, the ejection liquid can be properly ejected.

Additionally, by selecting as the bubble generation liquid a liquid with which the deposition such as kogation does not remain on the surface of the heat generating element even upon the heat application, the bubble generation is stabilized to assure the proper ejections. The above-described effects in the foregoing embodiments are also provided in this embodiment, the high viscous liquid or the like can be ejected with a high ejection efficiency and a high ejection pressure.

Furthermore, liquid which is not durable against heat is ejectable. In this case, such a liquid is supplied in the first liquid flow path as the ejection liquid, and a liquid which is not easily altered in the property by the heat and with which the bubble generation is in good order, is supplied in the second liquid flow path. By doing so, the liquid can be ejected without thermal damage and with high ejection efficiency and with high ejection pressure.

In the foregoing, the description has been made as to the major parts of the liquid ejecting head and the liquid ejecting method according to the embodiments of the present invention. The description will now be made as to further detailed embodiments usable with the foregoing embodiments. The following examples are usable with both of the single-flow-path type and two-flow-path type without specific statement.

Figure 33:
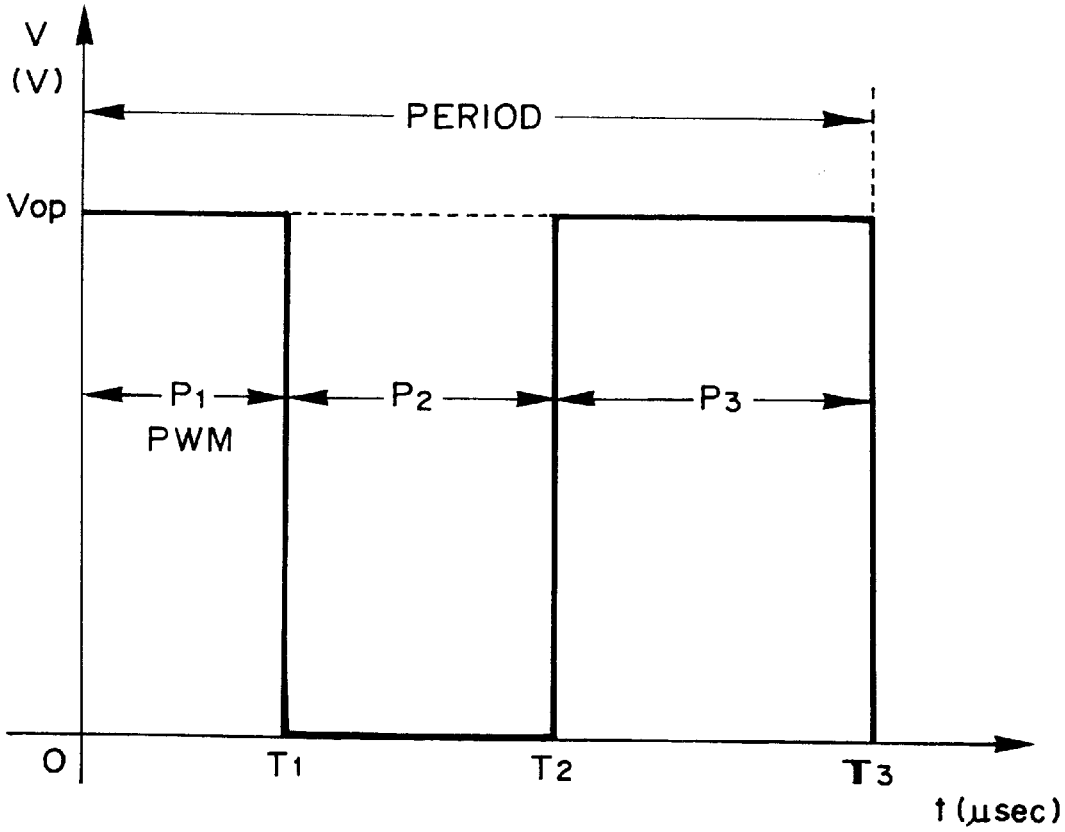
FIG. 33 shows an the a driving pulse for a liquid ejecting head, which is usable with the present invention.

FIG. 33 is illustrates divided pulses usable in this example.

In FIG. 33, $V_{OP}$ is a driving voltage; $P_1$ is a pulse width of a first pulse (pre-heating pulse) of divided heating pulses (driving pulses); $P_2$ is a pulse width of an interval time; $P_3$ is a second pulse (main heating pulse). $T_1$, $T_2$, and $T_3$ are timing for determining the widths $P_1$, $P_2$ and $P_3$. The driving voltage $V_{OP}$ is one of levels of electric energy necessary for generation of a bubble 40 in the ink by the heat generating element 2 as the electrothermal transducer supplied with the voltage, and is determined on the basis of the area, resistance, film structure of the heat generating element 2 and/or the liquid passage structure of the recording head. In the method of the modulation of the divided pulse width, the sequential pulses of the widths $P_1$, $P_2$ and $P_3$, are applied. The pre-heating pulse controls mainly the ink temperature in the liquid passage, and is used for the ejection amount control in this embodiment. This pulse width $P_1$ of the pre-heating pulse is such that no bubble generation occurs in the ink as the ejection liquid by the thermal energy generated by the heat generating element 2 with the application thereof.

The interval time $P_2$ is provided in order to avoid the interference between the pre-heating pulse and the main heating pulse and to uniform the temperature distribution of the ink in the ink liquid passage. The main heating pulse generates a bubble in the ink in the liquid passage to eject the ink through the ejection outlet 18, and the width $P_3$ thereof is determined on the basis of the area, resistance and/or film structure of the heat generating element 2, and/or the structure of the ink liquid passage of the recording head.

Figure 34:
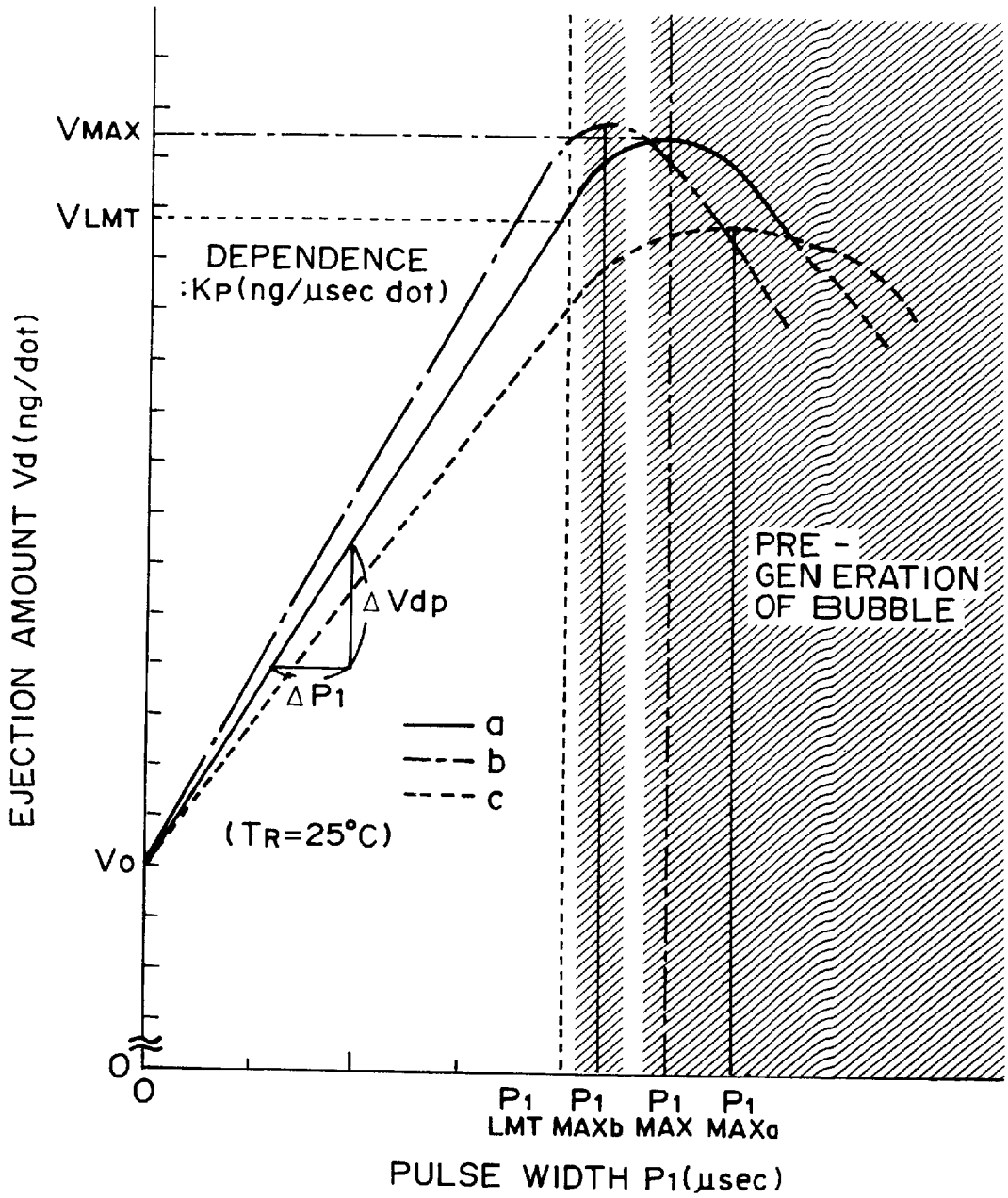
FIG. 34 is a diagram showing a relation between an ejection amount of a liquid ejecting head and a pulse width.

FIG. 34 is a diagram showing a dependence of the ejection amount of the ink upon the pre-heating pulse, wherein $V_0$ is an ejection amount with $P_1$=0 (μsec), and the value thereof is determined in accordance with the head structure. In this example, $V_0$=18.0 ng/dot.

As shown by a curve a in FIG. 34, the ejection amount $V_d$ linearly increases in accordance with increase of the pulse width $P_1$ of the pre-heating pulse from the pulse width $P_1$ to $P_{ILMT}$.

Within such a range in which the change of the ejection amount $V_d$ relative to the change of pulse width $P_1$ exhibits the linearity, that is, within the range to $P_{ILMT}$, the ejection amount can be controlled easily by changing the pulse width $P_1$. In this example shown by curve a, is the case of $P_{ILMT}$=1.87 (μs), and the ejection amount in this case is $V_{LMT}$=24.0 ng/dot. The pulse width $P_{IMAX}$ when the ejection amount $V_d$ is saturated, $P_{IMAX}$=2.1 μs, and the ejection amount $V_{MAX}$=25.5 ng/dot.

When the pulse width $P_1$ of the pre-heating pulse is larger than the $P_{IMAX}$, the ejection amount $V_d$ is smaller than $V_{MAX}$. This is because, when a pre-heating pulse having a pulse width in this range is applied, generation of fine bubbles occurs on the heat generating element 2 (the state immediately before the film boiling), and before the fine bubble collapse, the next main heating pulse is applied with the result that fine bubbles disturb the bubble generation of the main heating pulse, so that ejection amount is reduced. The range is called a pre-bubble generation region, in which the ejection amount control using the pre-heating pulse is difficult.

When the inclination of the line in the plots of the ejection amount vs. the pulse width in the range $P_1$=0–$P_{ILMT}$ (μs) is a pre-heating pulse dependence coefficient, it is:

$$K_P=\Delta V_{dP}/\Delta P_1 \text{ ng/}\mu\text{sec.dot}$$

This coefficient KP is independent from the temperature, and is determined in accordance with the head structure, driving condition, ink property the like. Namely, curves b, c, represent another recording head, and it will be understood that it is different if the recording head is different. Thus, a different recording head has a different upper limit $P_{ILMT}$ of the pulse width $P_1$ of the pre-heating pulse. Therefore, as will be described hereinafter, the upper limit is determined for each recording head to effect the ejection amount control. In the recording head and the ink having the property indicated by the curve a, $K_P$=3.209 ng/μsec·dot.

As another factors determines the ejection amount of the ink jet recording head, there is a temperature of the recording head (ink temperature).

Figure 35:
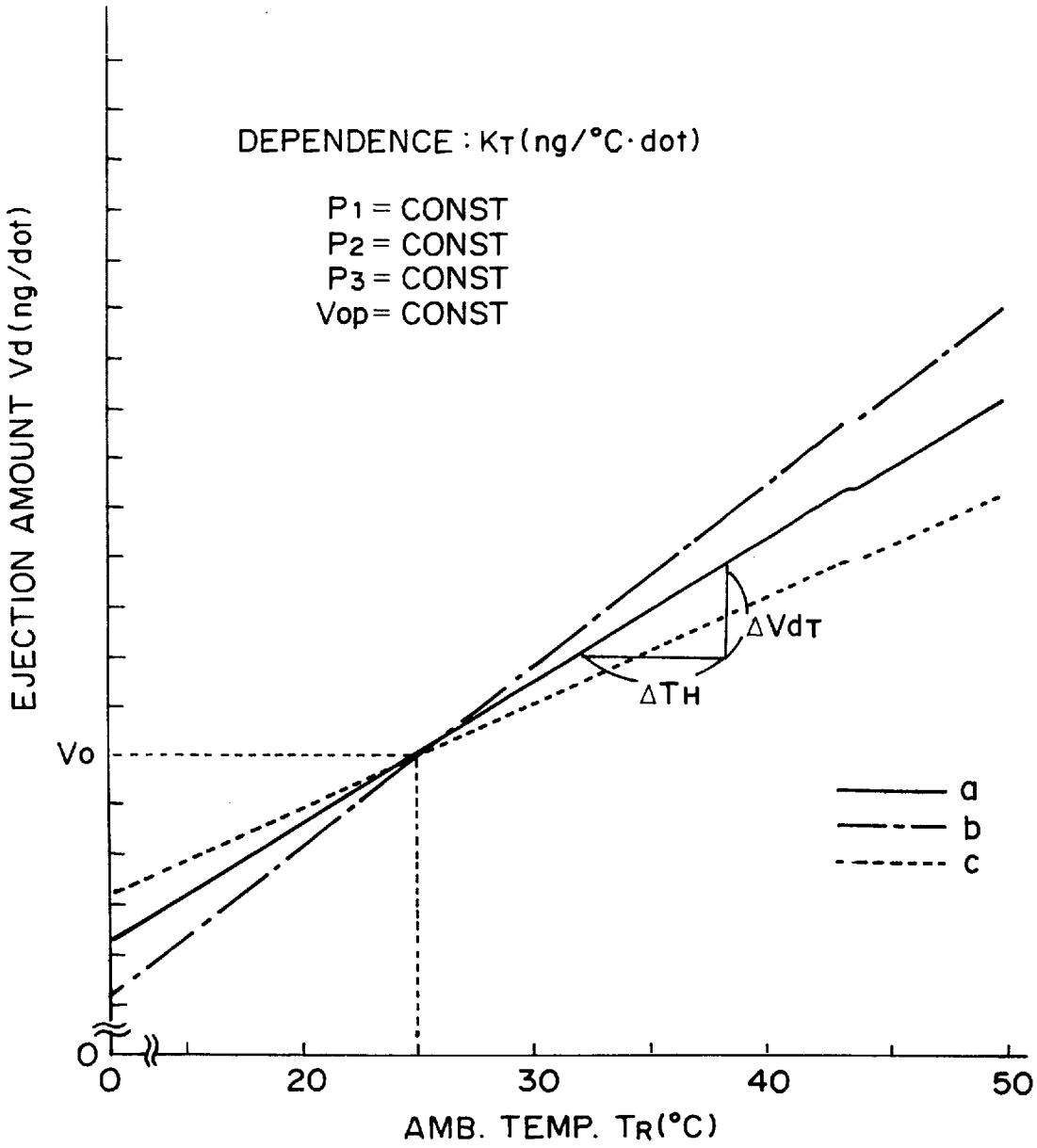
FIG. 35 is a diagram showing a relation between an ejection amount of a liquid ejecting head and a head temperature.

FIG. 35 is a diagram indicating a temperature dependence of the ejection amount. As will be understood from the curve a of FIG. 35, the ejection amount $V_d$ linearly increases in accordance with the increase of the ambient temperature $T_R$ (=head temperature $T_H$) of the recording head. When the inclination of this line is defined as a temperature dependence coefficient, it is:

$$K_T=\Delta V_{dT}/\Delta T_H(\text{ng/}^\circ\text{C}\cdot\text{dot}).$$

This coefficient $K_T$ is not dependent on the driving condition, and is determined by the structure of the head, ink property the like. In FIG. 35, curves b, c indicate the properties of other heads. In the recording head of this example, $K_T$=0.3 ng/°C·dot.

As a result, by the PWM (pulse width modulation) control of the pulse width of the pre-heating pulse, the ejection amount of the ink is positively controlled, by which the tone gradation of the print can be enhanced, and the ejection amount of the ink can be stabilized.

For example, the pre-heating pulse causes the heat generating element 2 to generate the heat not enough to eject the liquid, and the operational condition of the movable member 31 is improved, thus stabilizing the ejection amount and the ejection speed of the liquid. More particularly, the liquid in the bubble generating region 11 is pre-heated by the pre-pulse so that viscosity is decreased to provide the condition under which the transmission efficiency of the pressure to the movable member 31 is high. Therefore, the initial motion of the movable member 31 upon the main heating pulse being applied, is assuredly and efficiently carried out, so that reliability of the movable member 31 is improved with the result of improvement of the ejection condition of the liquid. Since the improvement of the ejection state for the liquid is effected only upon the ejection of the liquid, the desired ejection state (when images are printed by ejection of the ink, the ejection state for assuring the tone gradation of the images) can be provided assuredly even when the liquid is continuously ejected.

The pulse width of the pre-heating pulse, can be PWM-controlled on the basis of a detected temperature provided by a temperature sensor such as a diode mounted on a head. In such a case, it is preferable that detected temperatures are weighed in accordance with the temperature difference resulting from the positional relation between the temperature sensor and the heat generating element 2 and in accordance with the ejection outlet 18 being actuated. By using metal and high thermal conductivity material for the material of the movable member 31, the pre-heating of the ejection liquid is efficiently effected. Additionally, the movable member 31 can absorb the heat from the liquid adjacent to the heat generating element 2, which liquid has been heated by the pre-heating pulse or due to the continuous ejection or the like of the liquid. As a result, the heat of the liquid adjacent the heat generating element 2, can be made uniform, so that difference between the temperature of the heat generating element 2 and the detected temperature by the temperature sensor provided on the head, can be minimized, thus increasing the accuracy of the PWM control for the pre-heating pulse.

Specific examples of the driving pulses to be applied to the heat generating element 2, will be described.

Figure 36A:
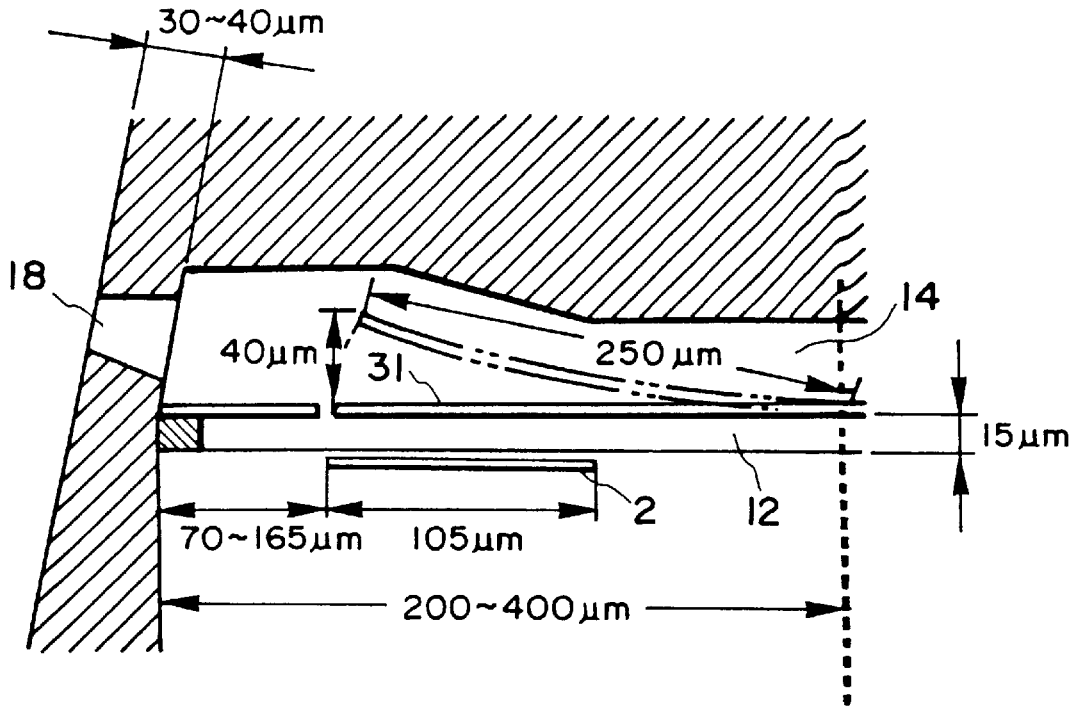
FIGS. 36(*a*) and 36(*b*) show a specific example of a driving pulse for a liquid ejecting head usable with the present invention.
Figure 36B:
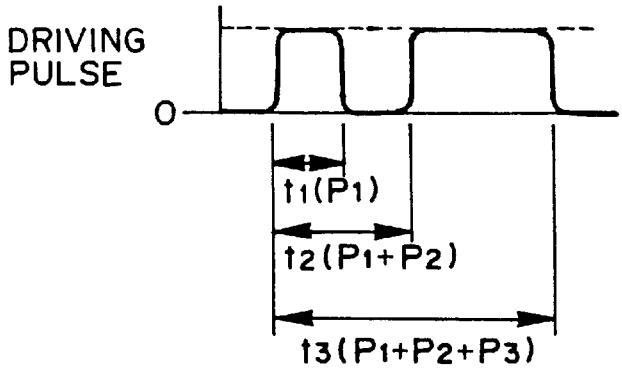

Using the nozzle structure shown in FIG. 36(*a*), the pulse widths t1, t2, t3 are selected as follows, as shown in FIGS. 36(*a*) and (*b*):

$1\ \mu sec \leqq t1 \leqq 1.4\ \mu sec$ $1.5\ \mu sec \leqq t2 \leqq 3\ \mu sec$ $3\ \mu sec < t3 < 8\ \mu sec$ (preferably, $5\ \mu sec \leqq t3 \leqq 8\ \mu sec$)

With these conditions, the ejection amount was properly controlled in accordance with the configurations of the driving pulse, and the multi-level tone gradation control was accomplished in the print image using ink.

When the pre-heating pulse is made slightly longer to $1.5\ \mu sec \leqq t1 \leqq 1.8\ \mu sec$, by which the temperature of the liquid adjacent to the heat generating element 2 is raised to a certain extent, the control of the ejection amount in the range lower than approx. 10 ng of the liquid has been accomplished. When the ink as the liquid is ejected onto a transparent or semi-transparent OHP sheet to effect printing thereon, high density print is desirable in many cases, although the correction of the variation of the ejection amount is also important. Therefore, when the printing is effected on the OHP sheet, the PWM control in accordance with the recording head temperature is not effected, and the pulse width $P_3$ is fixed. In this case, the pulse width $P_1$ is made longer as much as possible so as to increase the ejection amount, thus increasing the density.

Figure 37:
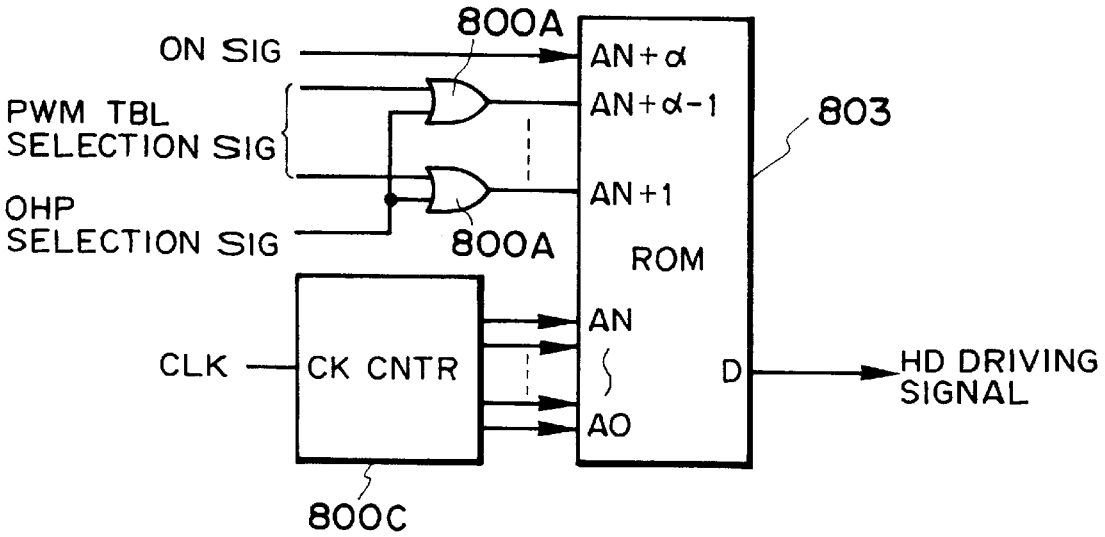
FIG. 37 is a block diagram showing an example of a major part of a liquid ejecting apparatus according to the present invention.
Figure 38:
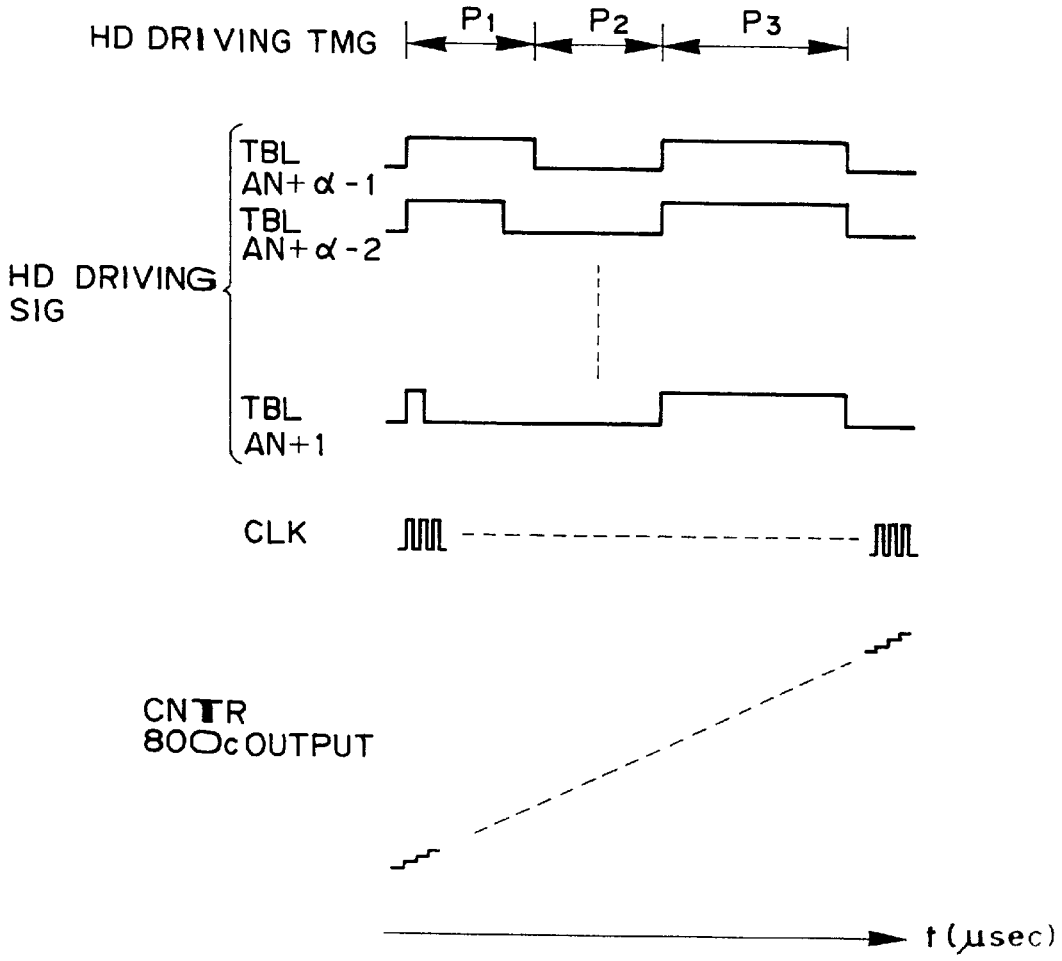
FIG. 38 is a timing chart of each signal in the structure of FIG. 37.

FIG. 37 is a block diagram illustrating the drive control for the head for the OHP sheet, and FIG. 38 is a timing chart for each signal therefor. The pattern of the driving signal waveform for the head is stored in a ROM803 beforehand. First, a clock signal is supplied to the counter 800C in the controller of the recording device at output timing of the driving signal for the head. At each input of the clock signal, the output of the counter is incremented by 1. By this, the content of the ROM803 is outputted with the address of the output of the counter, and is used as head driving signal.

The head driving signal is outputted depending on the selection of the PWM control table storing the pulse width $P_1$ for the pre-heating pulse for each temperature. As shown in FIG. 38, the head driving signal having the head in accordance with the selected table, is outputted. Which head driving signal table is selected, is determined by the PWM control table selection signal supplied to the ROM803. When the OHP sheet selection signal takes the H level, all the input signals for the PWM table selection signal to the ROM803 take H level by the function of an OR-gate 800A, and therefore, the table AN+α−1 is selected irrespective of the PWM table selection signal, so that pulse width $P_1$ of pre-heating pulse shown at the top in FIG. 38 is fixed at the maximum. More particularly, $P_3$=4.114 μsec, when $P_1$=2.618 μsec.

FIG. 38 shows the head driving signal when the printing ON signal is H when the printing is effected. When the printing ON signal is L (not printing), the pulse $P_3$ of the head driving signal shown in FIG. 38 takes the L level.

In this embodiment, the ejection amount increase is realized only in the state of the fixed pulse width $P_1$ of the pre-heating pulse at the maximum. The ejection amount may be further increased by raising the target temperature for the head then normal temperature. More particularly, the target temperature is raised up to 40° C. from the normal 25° C. If the temperature is made higher than this, the temperature of the recording head approaches to the head limit temperature $T_{LIMIT}$=60° C. since the temperature rise may be approx. 15° C., and therefore, such raising is not preferable.

The drive control is enabled when the OHP mode is detected by detection of what kind of sheet is used.

Figure 39:
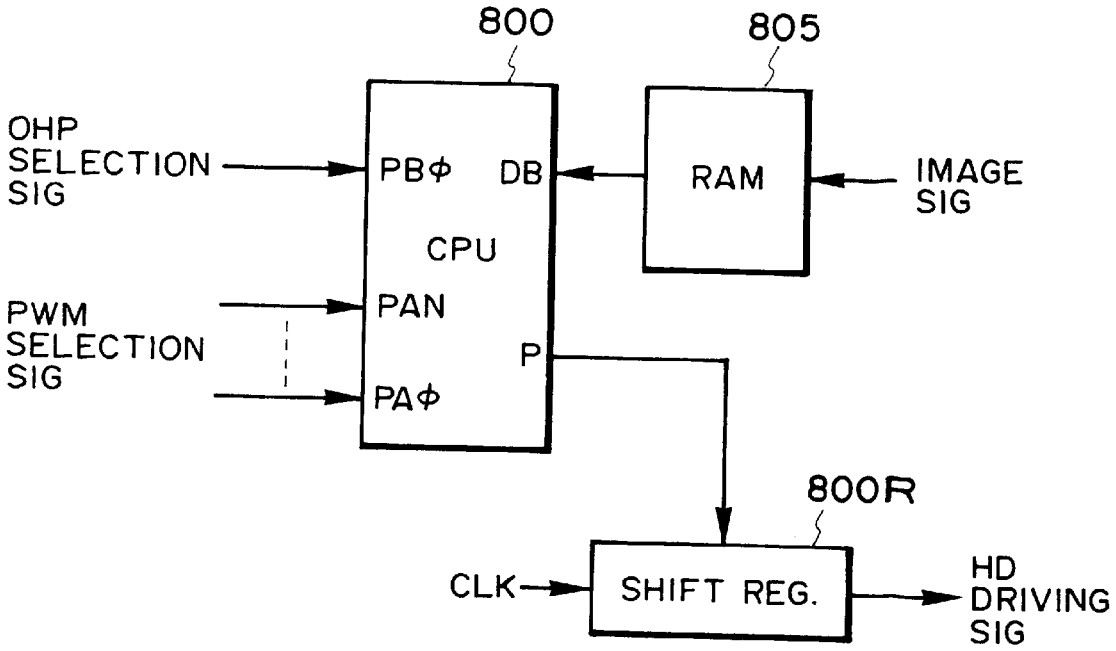
FIG. 39 is a block diagram showing another example of a major part of a liquid ejecting apparatus according to an embodiment of the present invention.
Figure 40:
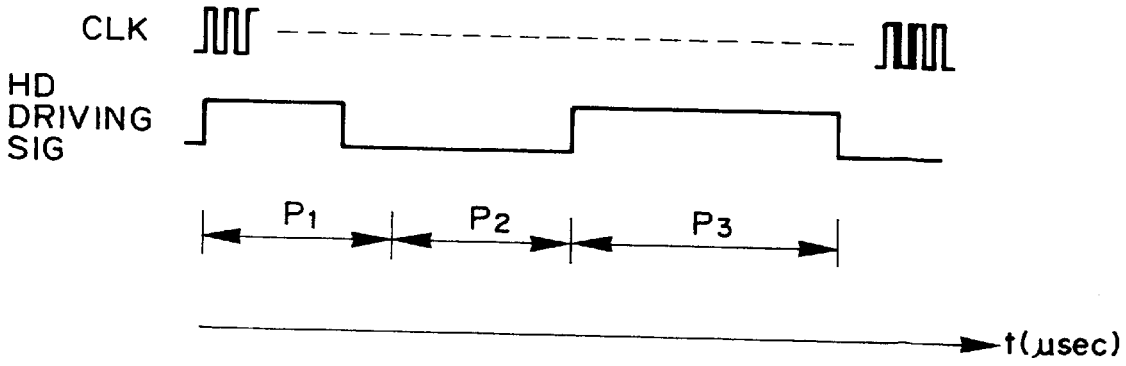
FIG. 40 is a timing chart of each signal in the structure shown in FIG. 39.
Figure 41:
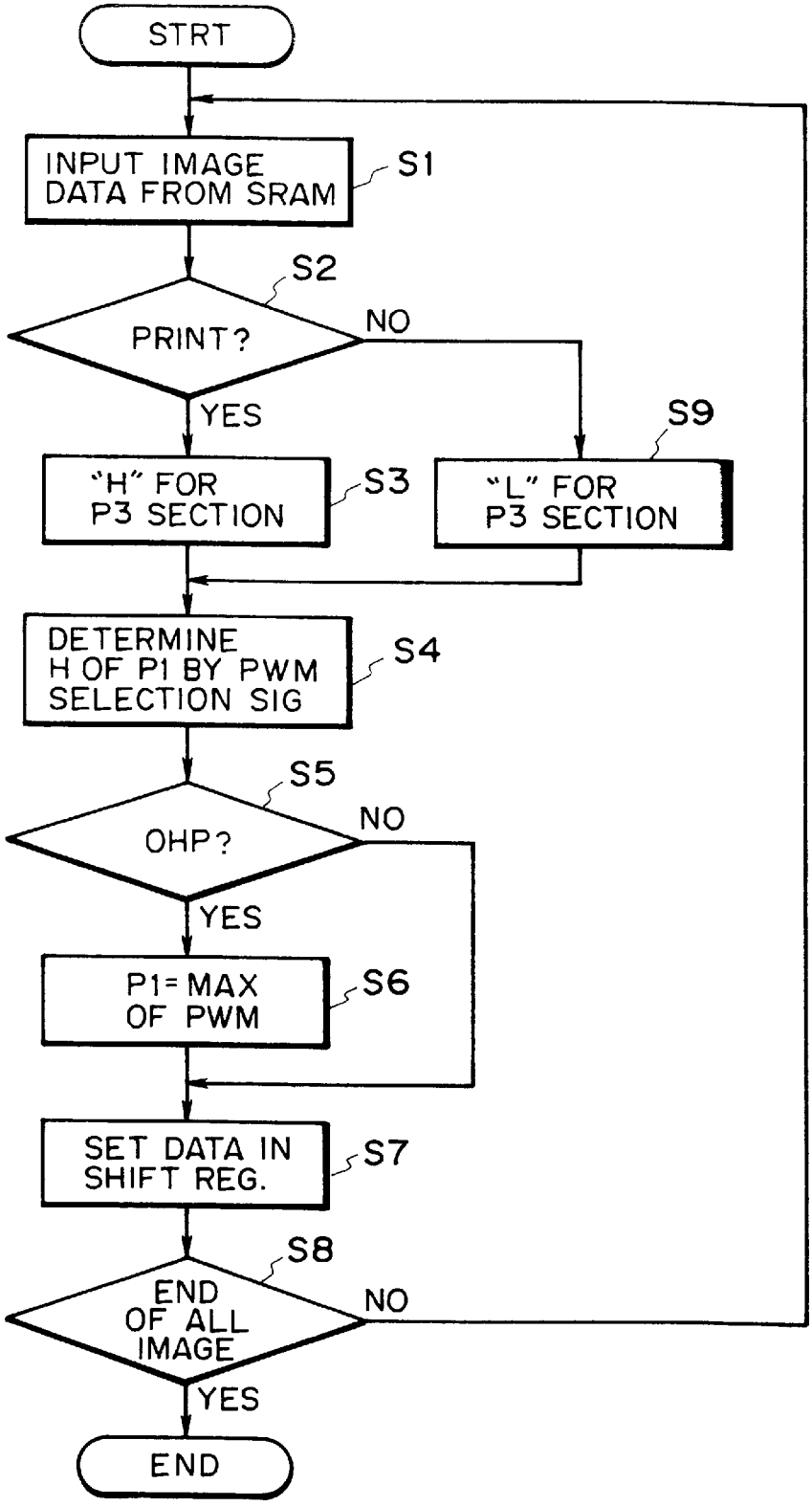
FIG. 41 is a flow chart of process steps for the structure shown in FIG. 39.

Referring to FIG. 39 to FIG. 41, the description will be made as to another embodiment of the head drive control. FIG. 40 is a timing chart for each signal in the structure shown in FIG. 39.

In FIG. 39, the image signal as the print data is stored in RAM805. When the image signal is stored in RAM805, the CPU800 sets the image data in the shift register 800R to permit production of the head driving signal. The detail will be described in conjunction with the flow chart of FIG. 41.

In FIG. 41, at step S1, the CPU800 reads the image data for one pixel out of the RAM805, and the operation goes to step S2. At step S2, the discrimination is made as to whether the data for the one pixel requires printing or not, that is, whether to eject the ink or not. If the result of the discrimination is affirmative, the operation proceeds to step S3, and if not, it goes to step S9.

At step S3, the register 12 of the CPU800 memorizes that level in the period of the main pulse width $P_3$ is H, and the operation proceeds to step S4. At step S4, the PWM selection signal is read in, and the width $P_1$ of the H level is stored in the register 12 of CPU800, and the operation goes to step S5. At step S5, the OHP selection signal is read in, and if the OHP mode is selected, the operation goes to step S6, and if not, it goes to step S7.

At step S6, the width $P_1$ of the H level of the pre-heating pulse determined at step S4 is set to the maximum settable width, and it is stored in the register of the CPU800, and the operation goes to step S7. At step S7, a head driving signal is produced on the basis of the pulse width $P_1$ of the pre-heating pulse shown in FIG. 40 store in the register of the CPU800 and of the information of the pulse width $P_3$ of the main pulse. Then, the operation goes to step S8. The head driving signal stored in the shift register 800R is outputted from the shift register 800R in synchronization with the clock.

At step S8, the discrimination is made as to whether all the image data stored in the RAM805 are outputted or not, and if so, the process is finished, and if not, the operation goes back to step S1.

Figure 42:
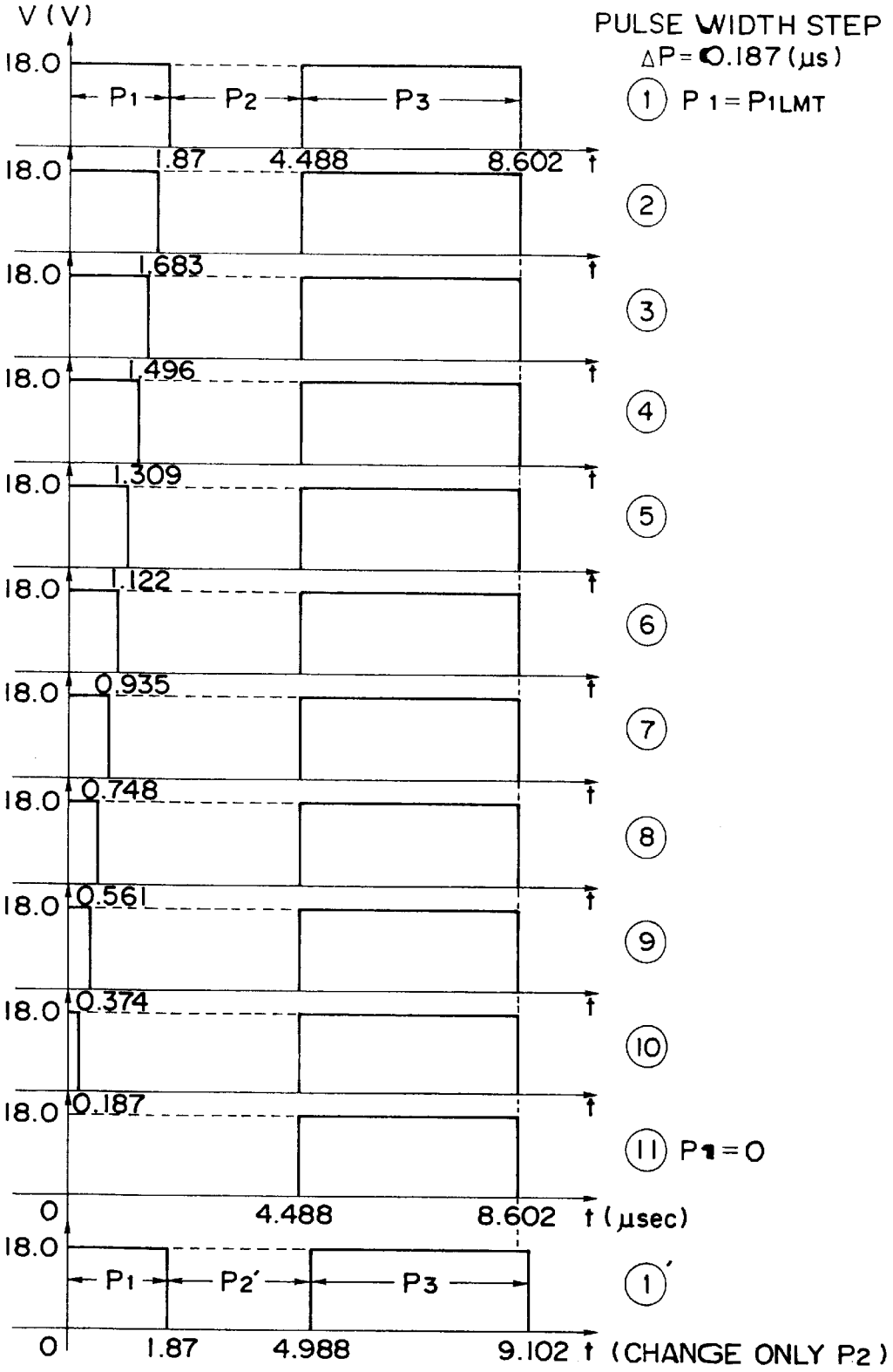
FIG. 42 shows a pulse waveform of another example of a driving pulse of a liquid ejecting head according to an embodiment of the present invention.

FIG. 42 shows a waveform graph of selectable driving pulses in the above-described PWM control.

When an usual printing sheet other than the OHP sheet having the light transmitting portion, is used, the waveforms indicated by 1 to 11 of FIG. 42 are selected for the PWM control in accordance with the detected temperature or the like.

In the foregoing embodiment, when the recording is effected on OHP sheet, only the pulse that is indicated by 1 in FIG. 42 is used in the control.

In the PWM control using 1 to 11 in FIG. 42, $P_1$ and $P_2$ are variable respectively, by which the ejection amount of the liquid is controlled. But, the ejection amount of the liquid can be controlled by changing the width of the interval $P_2$. In this case, by increasing the interval as indicated by 1' in FIG. 42, the heat due to the pre-heat is sufficiently transmitted to the bubble generating region 11 or to the movable member 31, thus increasing the bubble size to increase the ejection amount of the liquid.

Upon the PWM control indicated by 1 to 11 and 1' in FIG. 42, the expanding bubble is led toward the ejection outlet by the provision of the movable member 31, so that increase rate of the ejection amount of the liquid by the PWM control is increased than in the conventional case without the movable member.

Figure 43A:
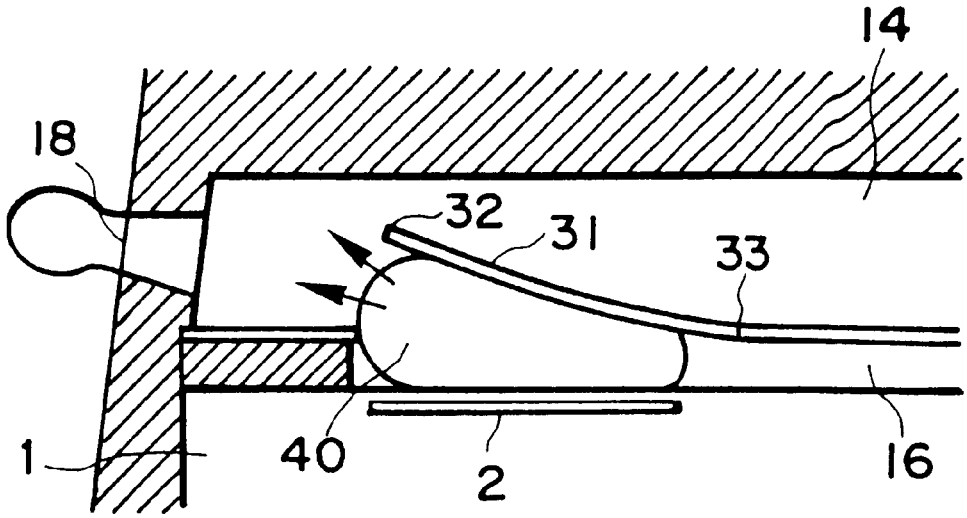
FIG. 43, (a) is an illustration of a liquid ejection state when a pulse waveform 1 in FIG. 42 is applied to the heat generating element, and (b) is an illustration of a liquid ejection state when a pulse waveform 1' in FIG. 42 is applied to the heat generating element.
Figure 43B:
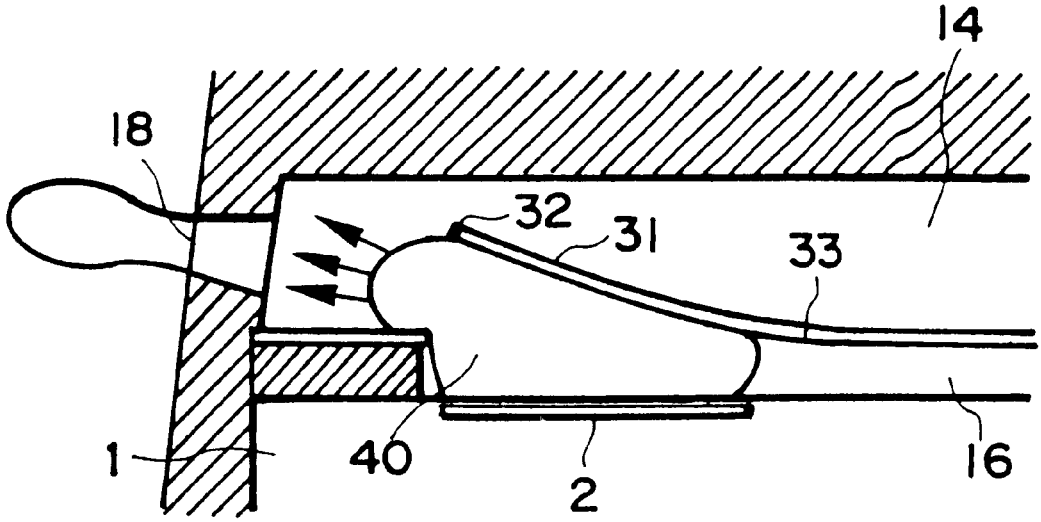
Figure 44:
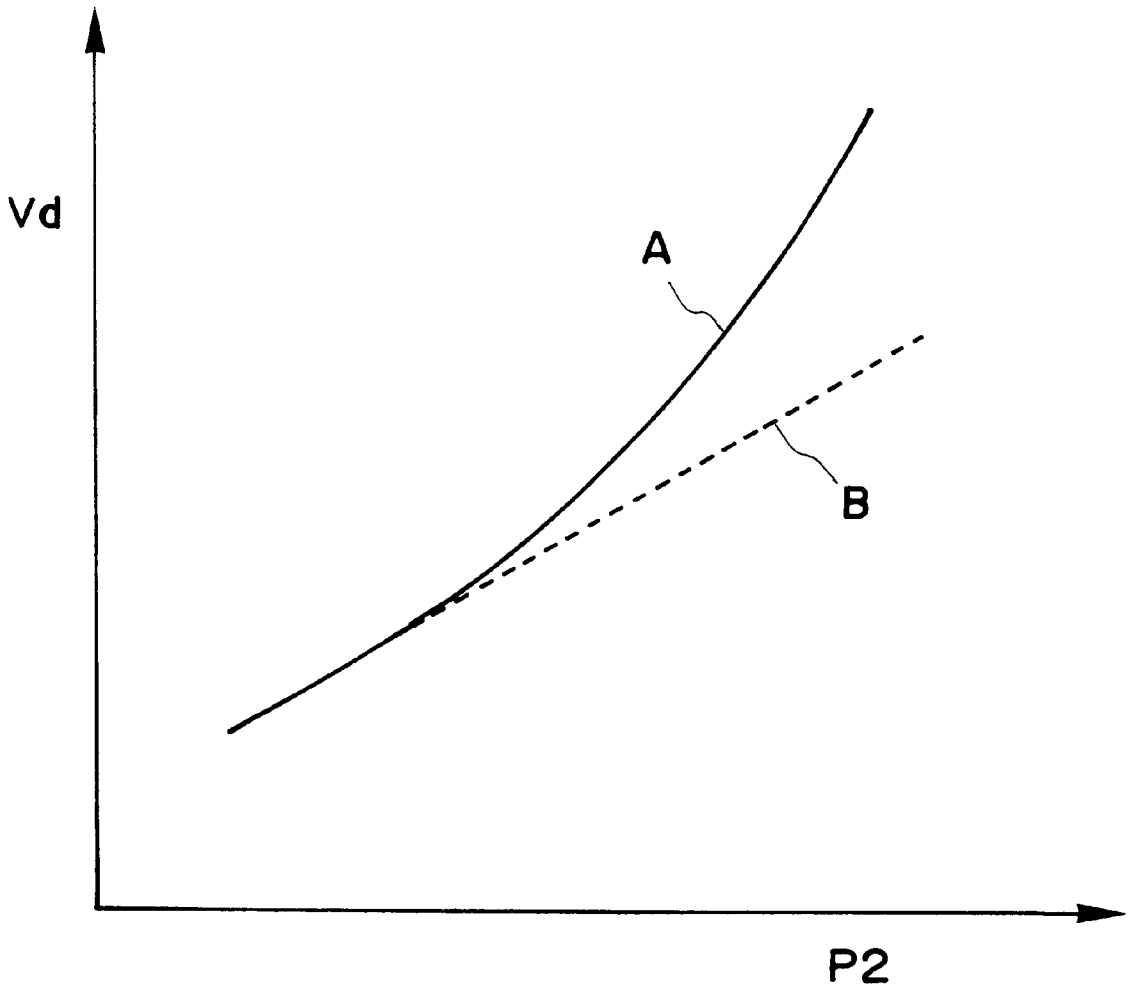
FIG. 44 is an illustration of a relation between an interval time of a driving pulse and an ejection amount in a liquid ejecting head in an embodiment of the present invention.

FIG. 43 is an illustration of a relation between the pulse waveform applied to the heat generating element 2 and the liquid ejection state, in each of the embodiment of the present invention. This Figure corresponds to FIG. 1(*c*), and the like reference numerals are assigned. FIG. 43(*a*) shows a liquid ejection state when the pulse waveform 1 in FIG. 42 is applied to the heat generating element 2, and FIG. 43(*b*) shows it when the pulse waveform 1' in FIG. 42 is applied to the heat generating element 2. In FIG. 43(*a*), too, the bubble 40 generation is efficiently directed toward the ejection outlet. When the size of the bubble 40 is large due to the sufficient transmission of the heat as described with FIG. 43(*b*), the displacement of the movable member 31 increases, and therefore, the growth of the bubble 40 is enhanced toward the ejection outlet, so that ejection amount is increased. This is because the movable member is deflected to direct the bubble toward the ejection outlet, so that movement and growth of the bubble 40 is directed toward the ejection outlet in which direction the resistance is smaller than in the direction against the spring stress of the movable member 31. Therefore, as compared with a conventional liquid ejection head not having the movable member 31, the use of the movable member 31 and the control of the width of the interval $P_2$ between the pre-heating pulse and the main pulse, permits the change rate of the liquid ejection amount to increase non-linearly as shown by curve A in FIG. 44 unlike the conventional linear increase as shown by line B in FIG. 44, so that controllability of the ejection amount is improved. Also, by controlling the pre-heating pulse width $P_1$, the change rate of the ejection amount is increased, so that controllability of the ejection amount is improved.

(Type 1 of the PWM control in accordance with the state quantity of the liquid)

In this invention, the "state quantity of the liquid" includes physical quantity such as the temperature, the viscosity of the liquid, and the surface tension of the liquid influential to the ejection amount of the liquid. When the liquid is ink, it includes the property of the ink. The PWM control may be dependent on the kind of the ink, as will be described hereinafter. The tone gradation controllability is improved by the increase of the change rate of the ejection amount as a result of the control of the interval P2 and by the property having the non-linear region. In this example, the temperature T2 of the liquid (bubble generation liquid) in the second liquid flow path 16 is detected by a temperature sensor S1 on the element substrate 1, and the temperature T1 of the liquid (recording liquid) in the first liquid flow path 14 is predicted on the basis of the detected temperature T2. The A pulse width P1 of the pre-heating pulse in FIG. 33 is PWM controlled on the basis of the predicted temperature T1, the detected temperature T2, and the temperature difference therebetween. It is preferable to take into account the viscosity ρ1 of the recording liquid and the surface tension η1 of the recording liquid influenced by the temperature.

Figure 45:
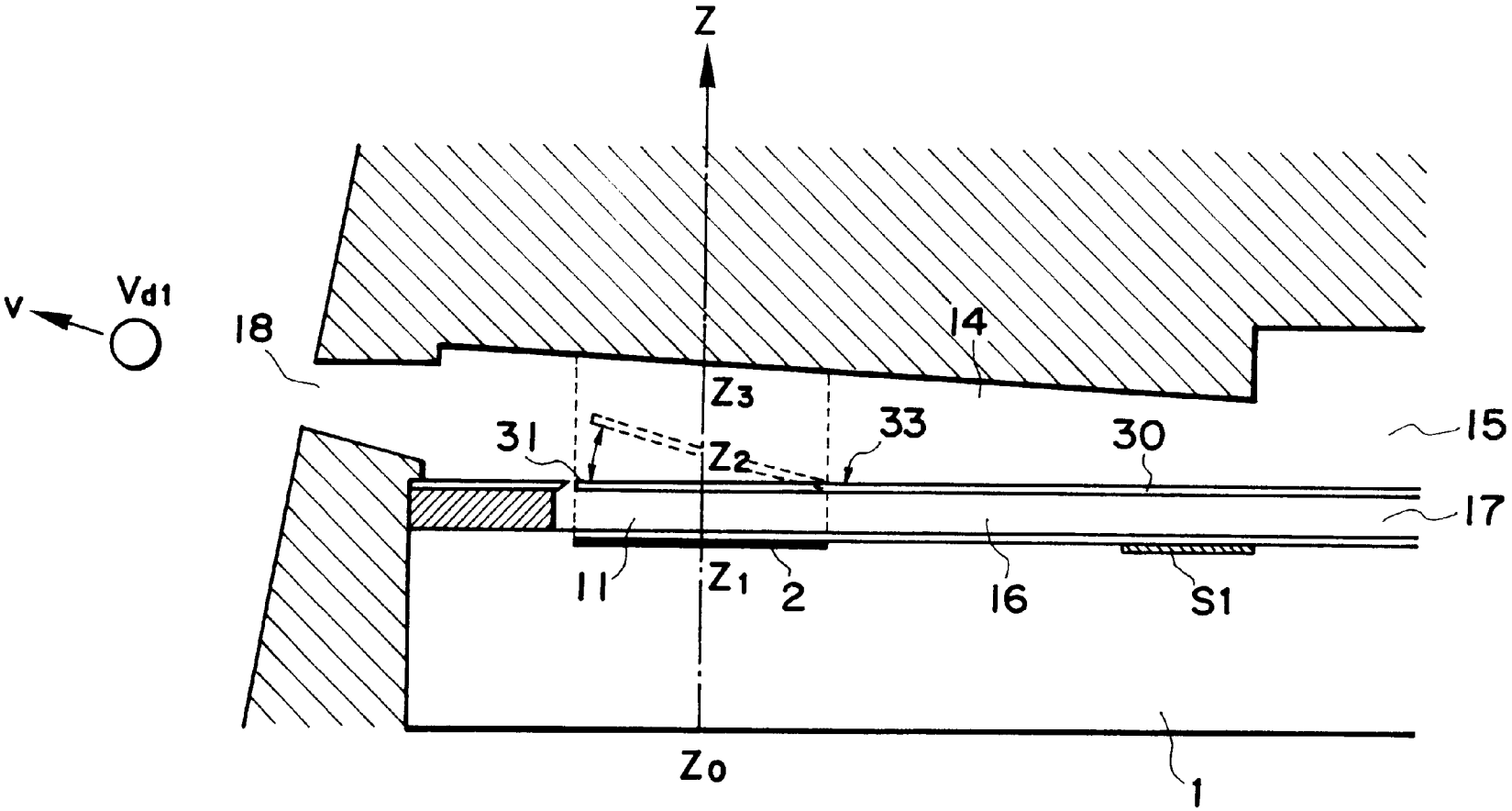
FIG. 45 is a sectional view of a major part for illustrating type 1 of a PWM control according to an embodiment of the present invention.
Figure 46:
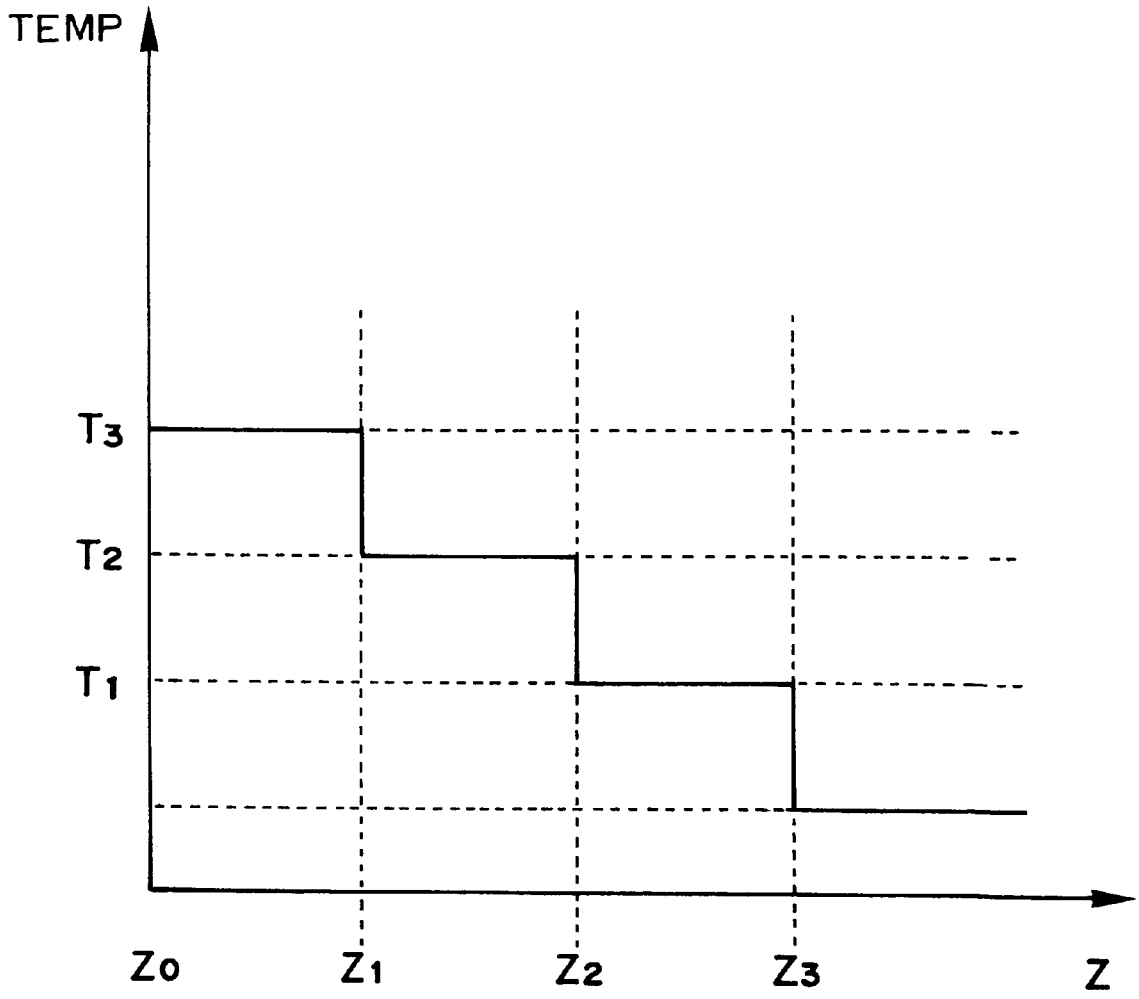
FIG. 46 is an illustration of a temperature distribution along Z-axis in FIG. 45.

FIG. 46 shows a temperature distribution along the Z-axis in FIG. 45. In FIG. 46, the temperature distribution in the element substrate 1 and the temperature distribution in the bubble generation liquid and the recording liquid are neglected. In this Figure, the detected temperature of the temperature sensor S1 is deemed as the temperature T3 of the element substrate 1, and temperature T2 of the bubble generation liquid and the recording liquid temperature T1 are predicted from the detected temperature T3 (T3≧T2≧T1).

Figure 47:
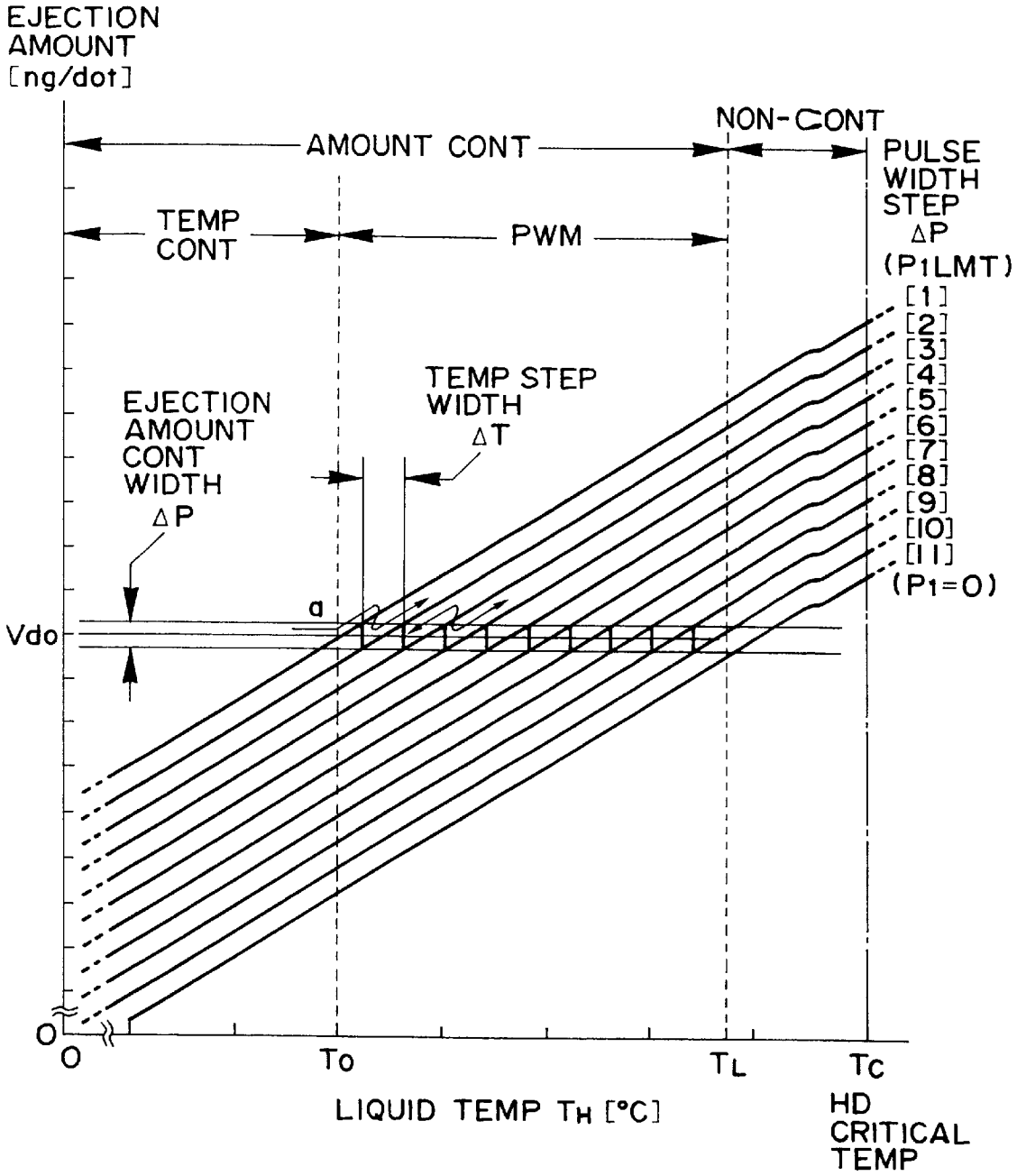
FIG. 47 is an illustration of a type 1 of a PWM control according to an embodiment of the present invention.

FIG. 47 shows an example wherein the pulse width P1 of the pre-heating pulse is stepwisely controlled so as to maintain a constant control width ±ΔV of the ejection amount Vd. In this example, the recording liquid temperature T1, bubble generation liquid temperature T2 or the temperature difference therebetween is taken as a liquid temperature TH, and when the liquid temperature TH is in the range between T0 and TL, one of tables 1–11 is selected in accordance with the liquid temperature TH, by which the pulse width P1 of the pre-heating pulse is stepwisely changed. In the tables 1–11, the pulse widths P1 for the pre-heating pulse are set with fine gradation as in 1 to 10 in FIG. 42. Temperature T0 is set at 25° C. for example, and when the temperature is lower than this temperature, the temperature adjustment is effected for the head with the target temperature of 25° C. The range of the liquid temperature TH which is TL or higher, is outside a normal printing range, and therefore, such a range is not frequently used. However, when the head is actuated at mm 100% duty, the temperature may go into this range. In this region, use is made with P1=0 (micro sec) to effect the printing with the single pulse of the main heating pulse alone so as to minimize the self-temperature-rise. If necessary, a PWM control of a single pulse may be used to suppress the temperature rise. Designated by TC is an usable limit temperature of the head.

Figure 48:
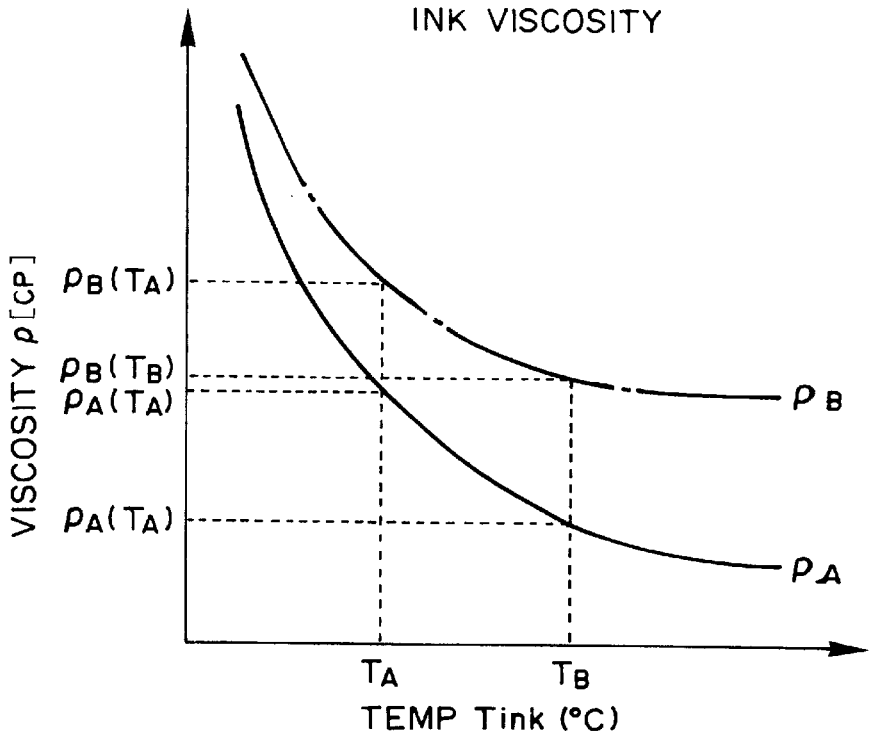
FIG. 48 is an illustration of a relation between a temperature and a viscosity of liquid.

FIG. 48 shows a relation between the liquid temperature and the liquid viscosity, wherein ρA (TA) and ρB (TA) are viscosities of relatively low viscosity ρA liquid and relatively high viscosity liquid ρA, respectively, at temperature TA, and the viscosities at temperature TB (>TA) are ρA (TB) and ρB (TB), respectively.

Figure 49:
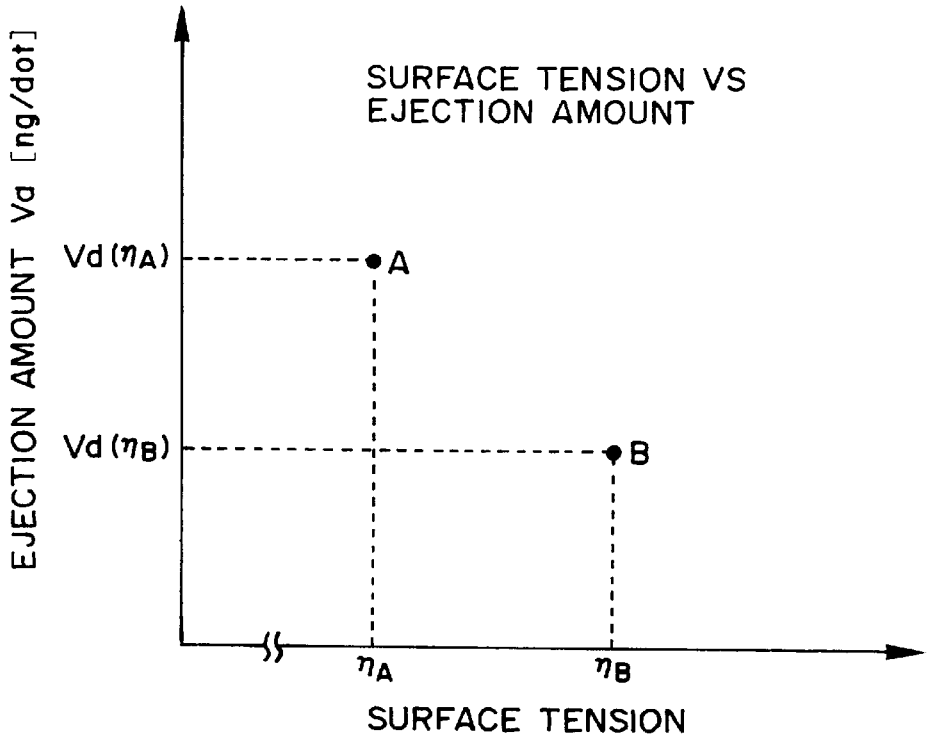
FIG. 49 is an illustration of a relation between an ejection amount and a surface tension of liquid.

The surface tension of the liquid is influential to the ejection amount of the liquid, and for example, the surface tension and the ejection amount have the relation as shown in FIG. 49. FIG. 49 deals with the case wherein ejection amount of the liquid A having a small surface tension such as ultra-high permeability ink under the same condition is increased, and wherein the ejection amount of the liquid B having a large surface tension such as processing liquid ejected for improvement of the image quality before, after or before and after the ink ejection, is decreased.

Specific example of the PWM control using the temperatures T1, T2, will be described. In the PWM control, one of the pulse width P1 of the pre-heating pulse, interval time P2 or the pulse width P3 of the main heating pulse, is controlled, or they are controlled in combination. In the following description, the pulse width P1 of the pre-heating pulse is controlled.

1) In the case of T1=T2 a) When the recording liquid A and the bubble generation liquid B are the same ink:

The quantities of states of liquids A and B are the same, that is, $\Phi A(\rho 1, \eta 1)=\Phi B(\rho 1, \eta 2)$, and therefore, the pulse width P1 of the pre-heating pulse is controlled on the basis of the temperature T2 (=T1) to control only the generated bubble volume of the bubble generation liquid B.

b) When the recording liquid A and bubble generation liquid B are different inks:

When, for example, the liquids A, B have a viscosities ($\rho 1<\rho 2$), the state quantities thereof are different, namely, $\Phi A(\rho 1, \rho 1)\neq\Phi B(\rho 2, \rho 2)$. Such a state occurs when the printing operation is started after long rest period or when the printing operation is started after sufficient temperature control is carried out for the head. Even if the temperatures of the liquids A, B are the same, the viscosity $\rho 1$ of the recording liquid is higher than the viscosity $\rho 2$ of the bubble generation liquid B, and therefore, if the pulse width P1 of the pre-heating pulse is controlled on the basis of the temperature T2 (=T1) so as to control only the generated bubble volume of the bubble generation liquid B as with a), the bubble generation pressure of the bubble generation liquid B is transmitted to the recording liquid A with the result of the decrease of the ejection pressure. Therefore, the intended ejection amount Vd is not provided, so that density of the print lowers. Correspondingly, therefore, the pulse width P1 of the pre-heating pulse is made longer than in the case said a) to avoid the decrease of the ejection amount.

2) In the case of T1<T2 c) When the recording liquid A and the bubble generation liquid B are the same ink:

Normally, the temperature of the bubble generation liquid B is higher than that of the recording liquid A due to the temperature rise of the head by the printing operation. The above state, therefore, occurs during the normal printing operation. The viscosities $\rho 1$, $\rho 2$ of the liquid A, B are dependent on the temperatures T1, T2, and therefore, the state quantities are different such that viscosity $\rho 1$ of the recording liquid A is higher than the viscosity $\rho 2$ of the bubble generation liquid B. Similarly to the case of b), the ejection pressure decreases due to the transmission of the bubble generation pressure of the bubble generation liquid B to the recording liquid A, so that intended ejection amount Vd cannot be assured with the result of decrease of the print density. Correspondingly, therefore, the pulse width P1 of the pre-heating pulse is made longer than that in the case of a) to avoid the decrease of the ejection amount.

It is desirable that difference $\Delta T$ between the temperatures T1 and T2 is determined, and the ejection amount difference corresponding to $\Delta T$ is measured through experiments, and the pulse width P1 is obtained for the PWM control.

$$P1=P1(0)+\Delta P(T)+\Delta P(\Delta T)$$

where P1(0) is a reference pulse width; $\Delta P(T)$ is a temperature correction amount as a function of temperature T1 or T2; and $\Delta P(\Delta T)$ is an ejection amount difference corresponding to the temperature difference $\Delta T$. For example, P1(0)=2.0 ($\mu$sec), $\Delta P(T)$=0–2.0 ($\mu$sec), $\Delta P(\Delta T)$=0–1.0 ($\mu$sec).

d) When the recording liquid A and the bubble generation liquid B are different kind inks:

When the recording is effected on plain paper, it is possible that recording liquid A is ultra-high permeability ink having extremely low surface tension $\eta 1$, and the bubble generation liquid B has a normal surface tension $\rho 2$ ($>\rho 1$) for the purpose of stabilizing the bubble generation. In such a case, the variation of the ejection amount due to the temperature difference, temperature T1, T2, can be solved by the same method as with c), but the variation of the ejection amount due to the difference of the surface tensions $\rho 1$, $\rho 2$ of the inks, are cannot be solved. Since the surface tensions $\rho 1$, $\rho 2$ are not dependent on the temperature, the property of the ink may be recognized depending on the ID of the head, and the reference pulse P1(0) may be corrected in accordance with the surface tensions $\rho 1$, $\rho 2$. If the pulse width P1 of the pre-heating pulse is controlled only on the basis of the temperature increase. to control only the generated bubble volume of the bubble generation liquid B as with the foregoing case a), the ejection amount Vd of the ink varies as a result of difference in the manner of tearing of the ink depending on the surface tension. Generally, the ejection amount Vd tends to increase with decrease of the surface tension.

The ejection amount Vd varies with the temperature, viscosity and another state (property) of the ink as well as the surface tension, and therefore, the factors influential to the change of the ejection amount Vd are analyzed through experiments, and the results are used for the PWM control.

Figure 50:
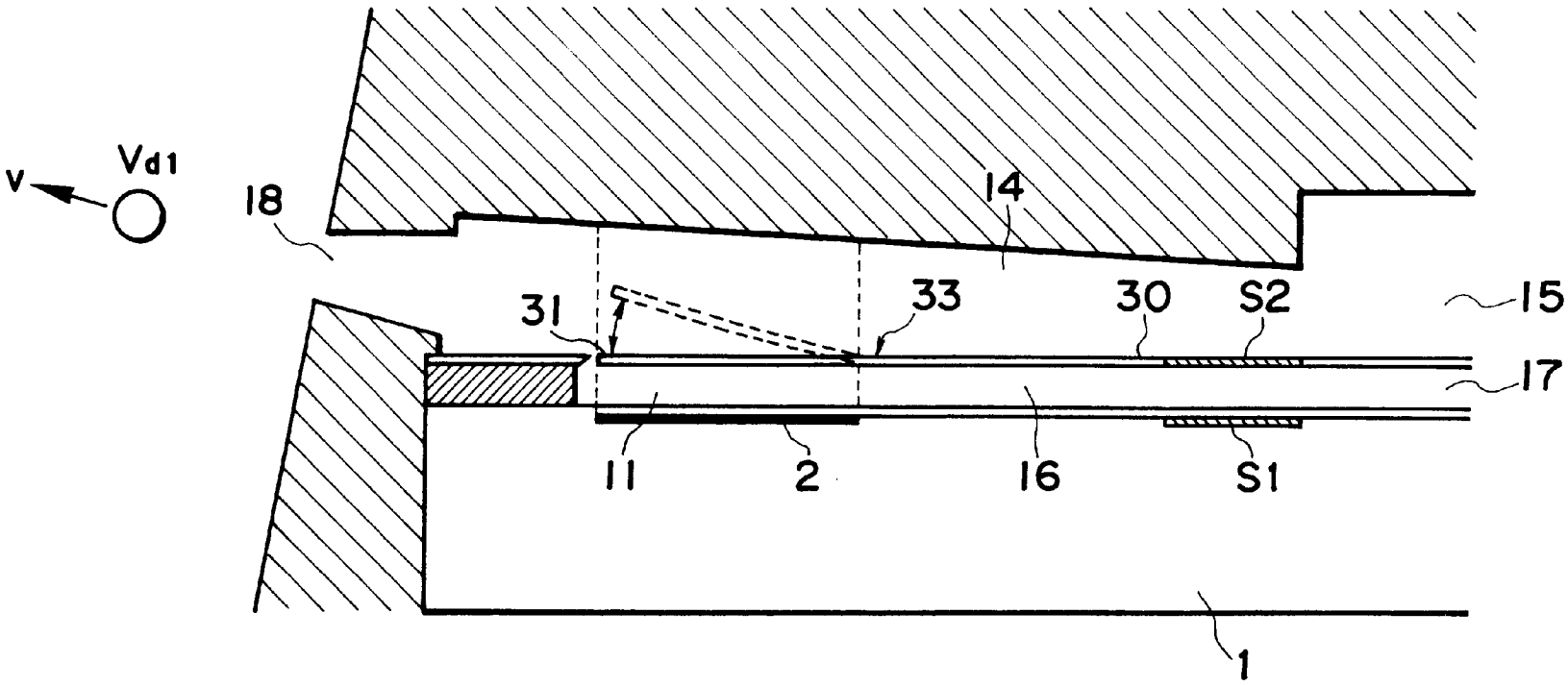
FIG. 50 is a sectional view of a major part for illustrating type 2 of a PWM control of an embodiment of the present invention.

(Type 2 of the PWM control in accordance with the state quantity of the liquid) In this example, as shown in FIG. 50, the temperature T2 of the liquid (bubble generation liquid) in the second liquid flow path 16 is detected by a temperature sensor S1 on the element substrate 1, and the temperature T1 of the liquid (recording liquid) in the first liquid flow path 14 is detected by a temperature sensor S2 provided on the separation wall 30. On the basis of the detected temperature T1, the detected temperature T2 or the temperature difference therebetween, the pulse width P1 of the pre-heating pulse is PWM controlled. It is preferable that viscosity $\rho 1$ of the recording liquid and the surface tension $\eta 1$ of the recording liquid influenced by the temperature, are taken into account.

(Type 3 of the PWM control in accordance with the state quantity of the liquid)

In this example, the temperature T2 of the liquid in the second liquid flow path 16 and the temperature T1 of the liquid in the first liquid flow path 14, are predicted on the basis of the image data corresponding to the image to be formed on the print medium by the ejection of the ink as the liquid. More particularly, the temperatures T1, T2 of the liquid are predicted from the temperature change of the head influential to the frequency of the operation of the head. The pulse width P1 of the pre-heating pulse in FIG. 33 is PWM controlled on the basis of the predicted temperatures T1, T2 or the temperature difference therebetween. In this case, it is preferable that viscosity $\rho 1$ of the recording liquid and the surface tension η1 of the recording liquid influenced by the is taken into account.

Figure 51:
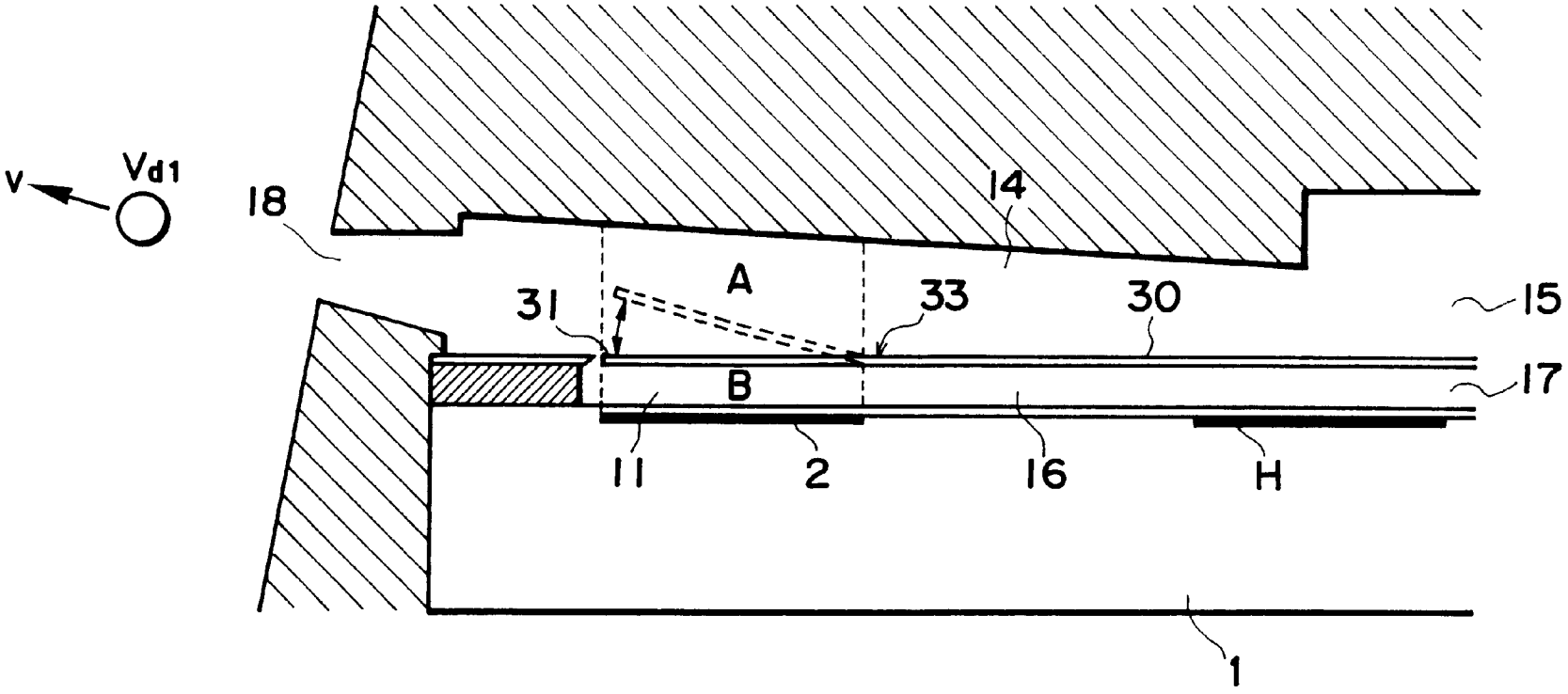
FIG. 51 is a sectional view of a major part for illustrating type 3 of a PWM control in an embodiment of the present invention.
Figure 52A:
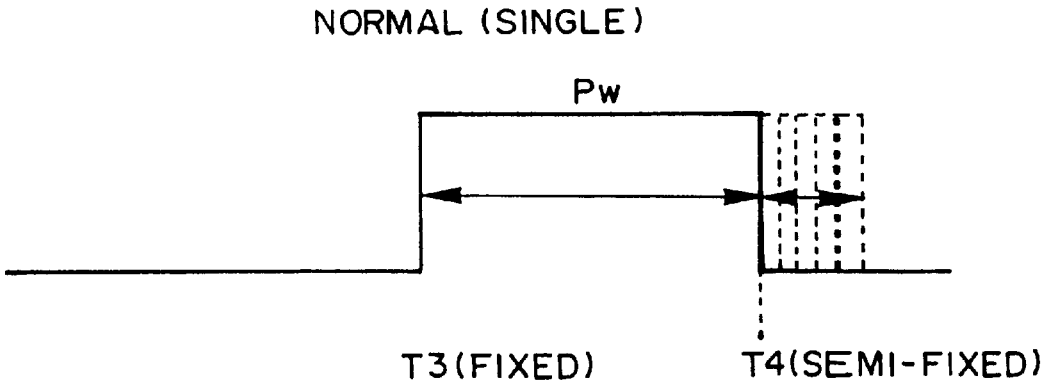
FIGS. 52(*a*) and 52(*b*) are illustrations of type 3 of PWM control according to an embodiment of the present invention.
Figure 52B:
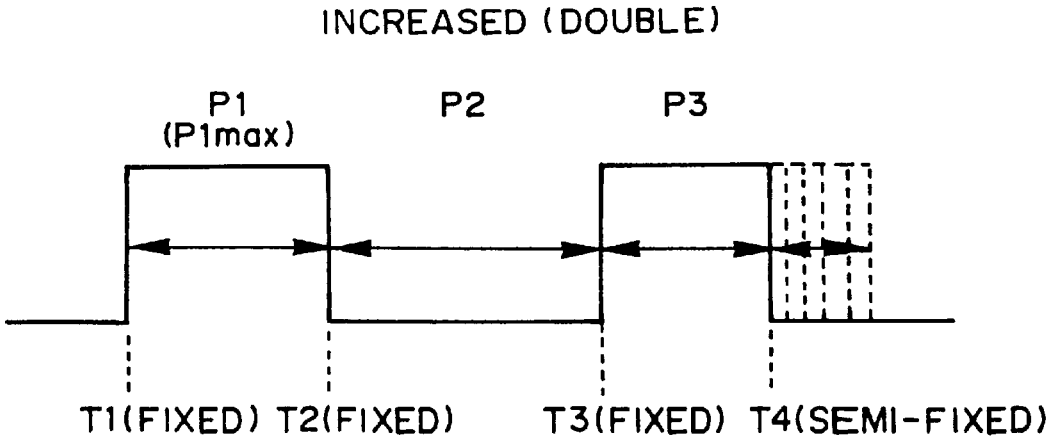
Figure 53:
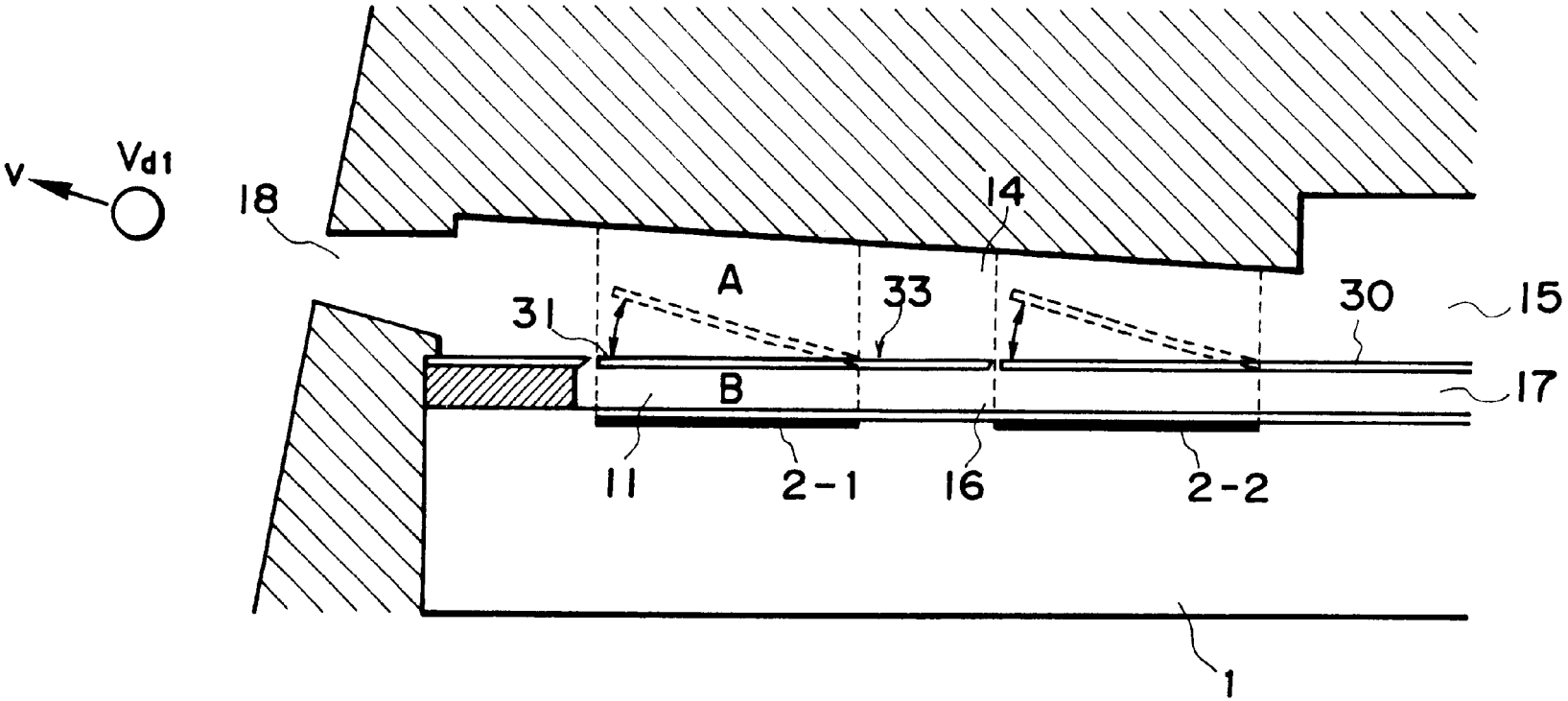
FIG. 53 is a sectional view of a major part of a head for illustrating type 4 of PWM control according to an embodiment of the present invention.
Figure 54:
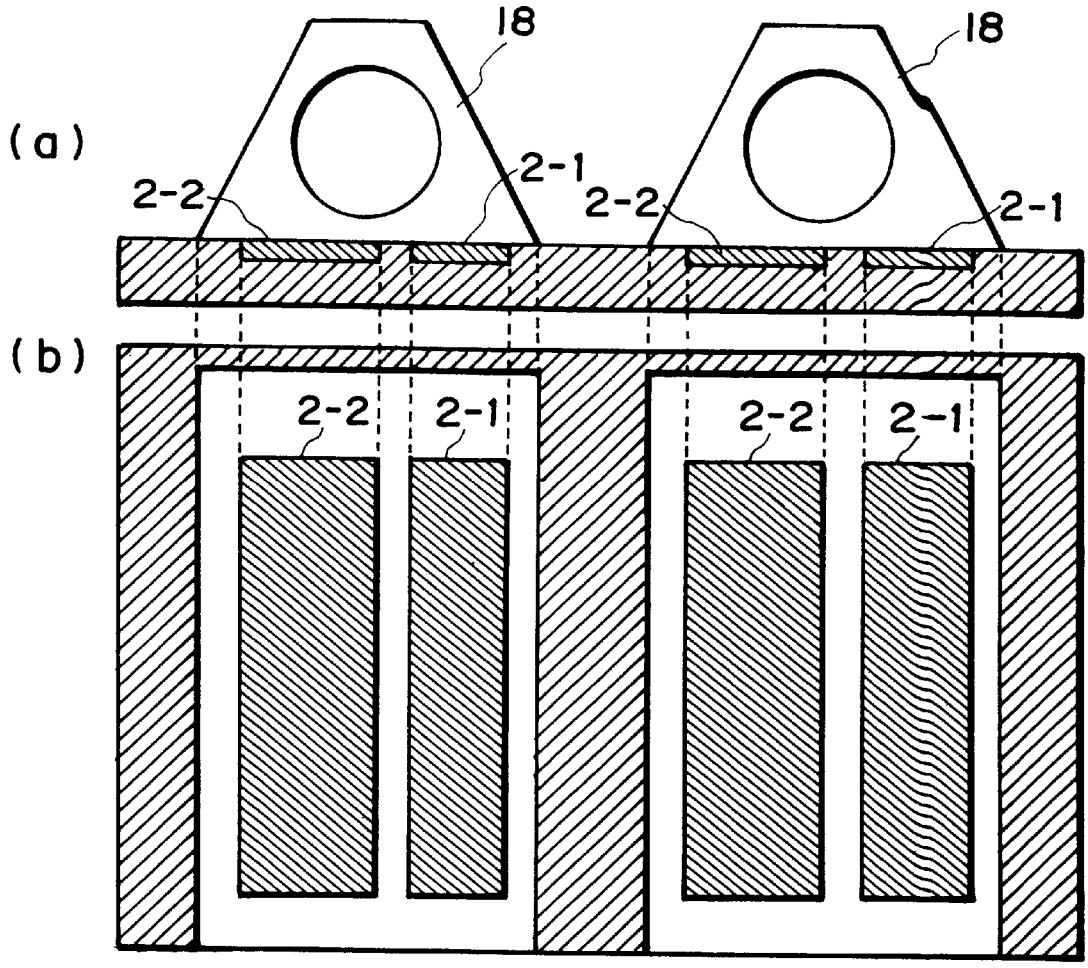
FIG. 54 is a sectional view of a major part of another head for illustrating type 4 of PWM control according to an embodiment of the present invention.

The driving pulse for the heat generating element 2 may be selectively changed in accordance with the predicted temperature T1, T2 or the temperature difference therebetween. In such a case, the single pulse shown in FIG. 52(A) or the double pulse shown in FIG. 52(B) may be selectively used. With the single pulse, the pulse rising timing T3 is fixed, and falling timing T4 thereof is semi-fixed so that it can be set in accordance with the property peculiar to the head. By application of such pulses, a relatively small amount of the ink (20p1) is ejected, which is suitable for the color mode. With the double pulse, the interval time P2 of the pre-heating pulse P1 is fixed, and the falling timing T4 of the main heating pulse P3 is semi-fixed so that it can be set in accordance with the property peculiar to the head. By application of the pulse, a relatively large amount of the ink (30p1) is ejected, which is suitable for a letter printing mode or the like. By provision of a sub-heater as shown in FIG. 51 and combining the temperature control using the same, the tone gradation recording of the image is accomplished. (Type 4 of the PWM control in accordance with the state quantity of the liquid):

In this example, use is made with the heat generating elements 2-1, 2-2 providing different heating values. These heat generating elements 2-1, 2-2 are arranged longitudinally as shown in FIG. 53 or laterally as shown in FIG. 54, and the heat generating elements 2-1, 2-2 are selectively driven, or are simultaneously driven, so that ejection amount can be changed stepwisely (10p1, 20p1, 30p1) with large gradation. Similarly to the foregoing type 3, the temperature T2 of the liquid in the second liquid flow path 16 and the temperature T1 of the liquid in the first liquid flow path 14, are predicted on the basis of the image data corresponding to the image to be printed on the print medium by the ejection of the ink as the liquid. That is, the temperatures T1, T2 of the liquid are predicted from the temperature change of the head influenced by the frequency of the operation of the head. On the basis of the predicted temperatures T1, T2 or the temperature difference therebetween, the driving pulse for the heat generating elements 2-1, 2-2 are PWM-controlled.

Figure 55:
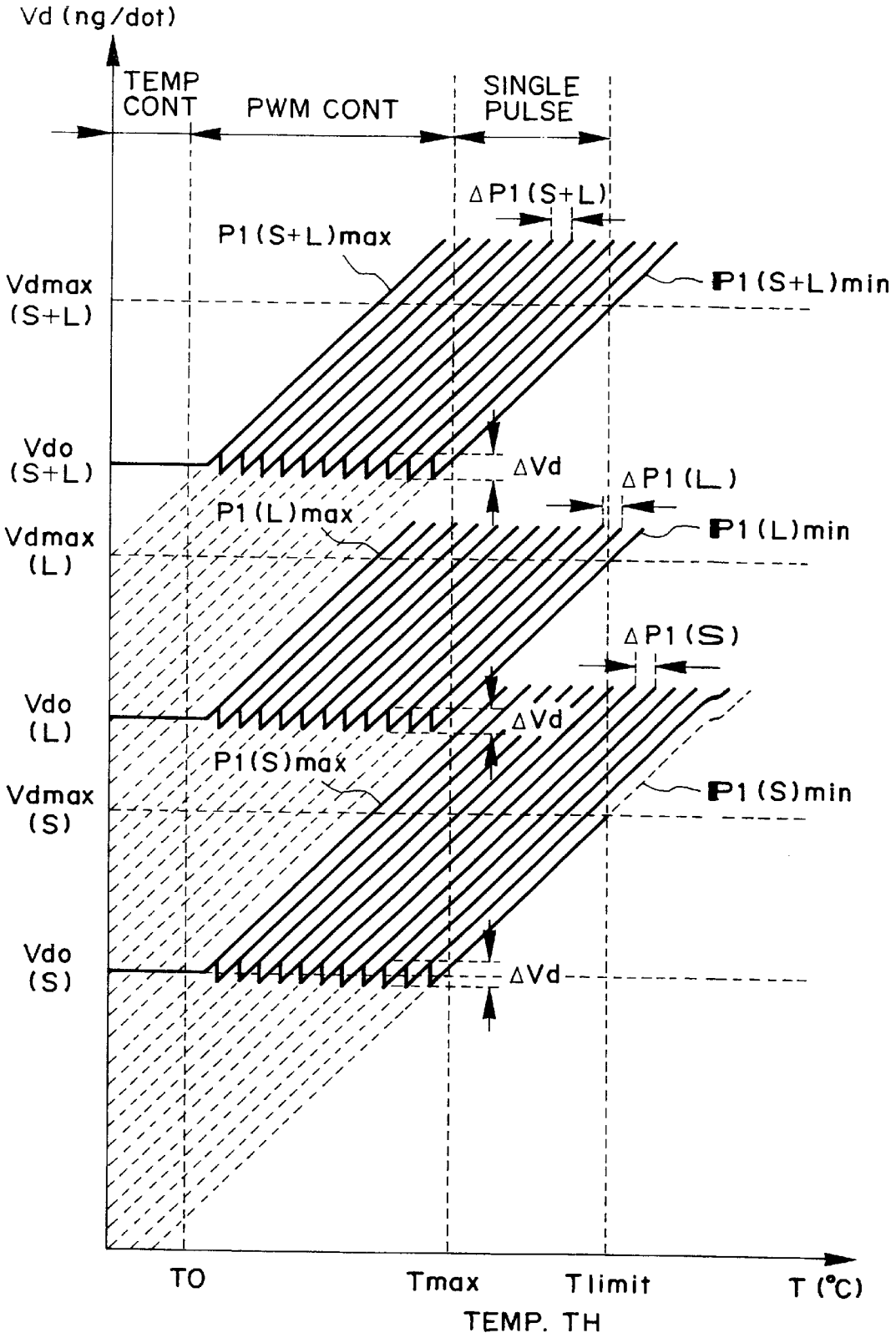
FIG. 55 is an illustration of type 4 of PWM control.

When the temperatures T1, T2 are predicted, the heating value of the heat generating elements 2-1, 2-2 up to now is taken into account. The heating value may be obtained from the history of the ejection amounts of the liquid. More particularly, from the frequency of the driving of the heat generating element 2-1, 2-2, the influence of the heat to the liquid is recognized, and by taking it into account, the temperatures T1, T2 can be properly predicted. FIG. 55 shows an example of control wherein a pulse width P1(S) or P1(L) of the driving pulse for one or each of a heat generating element 2-1 S producing a relatively smaller heating value and a heat generating element 2-2 L producing a relatively larger heating value.

When only P1(S) is controlled, the ejection amount Vd0 (S) of the liquid is maintained substantially constant, namely within a control width ±ΔV. More particularly, the temperature T1, T2 or the temperature difference therebetween, is taken as a liquid temperature TH, and the pulse width P1(S) is changed stepwisely by selecting from the range between P1(S)max and P1(S)min in accordance with the liquid temperature TH within the range of the liquid temperature TH from T0 to Tmax. When the liquid temperature TH is temperature T0 or lower, the temperature of the head is controlled with the target temperature of T0. When the liquid temperature TH is higher than Tmax, the main pulse only is used as the driving pulse. The main pulse may be PWM controlled in accordance with the liquid temperature TH.

When only the P1(L) is controlled, the ejection amount Vd0(L) of the liquid is maintained substantially at a constant namely within a control width ±ΔV. More particularly, the temperature T1, T2 or the temperature difference therebetween, is taken as a liquid temperature TH, and the pulse width P1(S) is changed stepwisely by selecting from the range between P1(S)max and P1(S)min in accordance with the liquid temperature TH within the range of the liquid temperature TH from T0 to Tmax. When the liquid temperature TH is temperature T0 or lower, the temperature of the head is controlled with the target temperature of T0. When the liquid temperature TH is higher than Tmax, the main pulse only is used as the driving pulse. The main pulse may be PWM controlled in accordance with the liquid temperature TH.

When both of the P1(S) and P1(L) are controlled, the ejection amount Vd0 (S+L) of the liquid is maintained constant in the control width ±ΔV. More particularly, the temperature T1, T2 or the temperature difference therebetween, is taken as a liquid temperature TH, and the pulse width P1(S+L) is changed stepwisely by selecting from the range between P1(S+L)max and P1(S+L)min in accordance with the liquid temperature TH within the range of the liquid temperature TH from T0 to Tmax. When the liquid temperature TH is temperature T0 or lower, the temperature of the head is controlled with the target temperature of T0. When the liquid temperature TH is higher than Tmax, the main pulse only is used as the driving pulse. The main pulse may be PWM-controlled in accordance with the liquid temperature TH.

Figure 57:
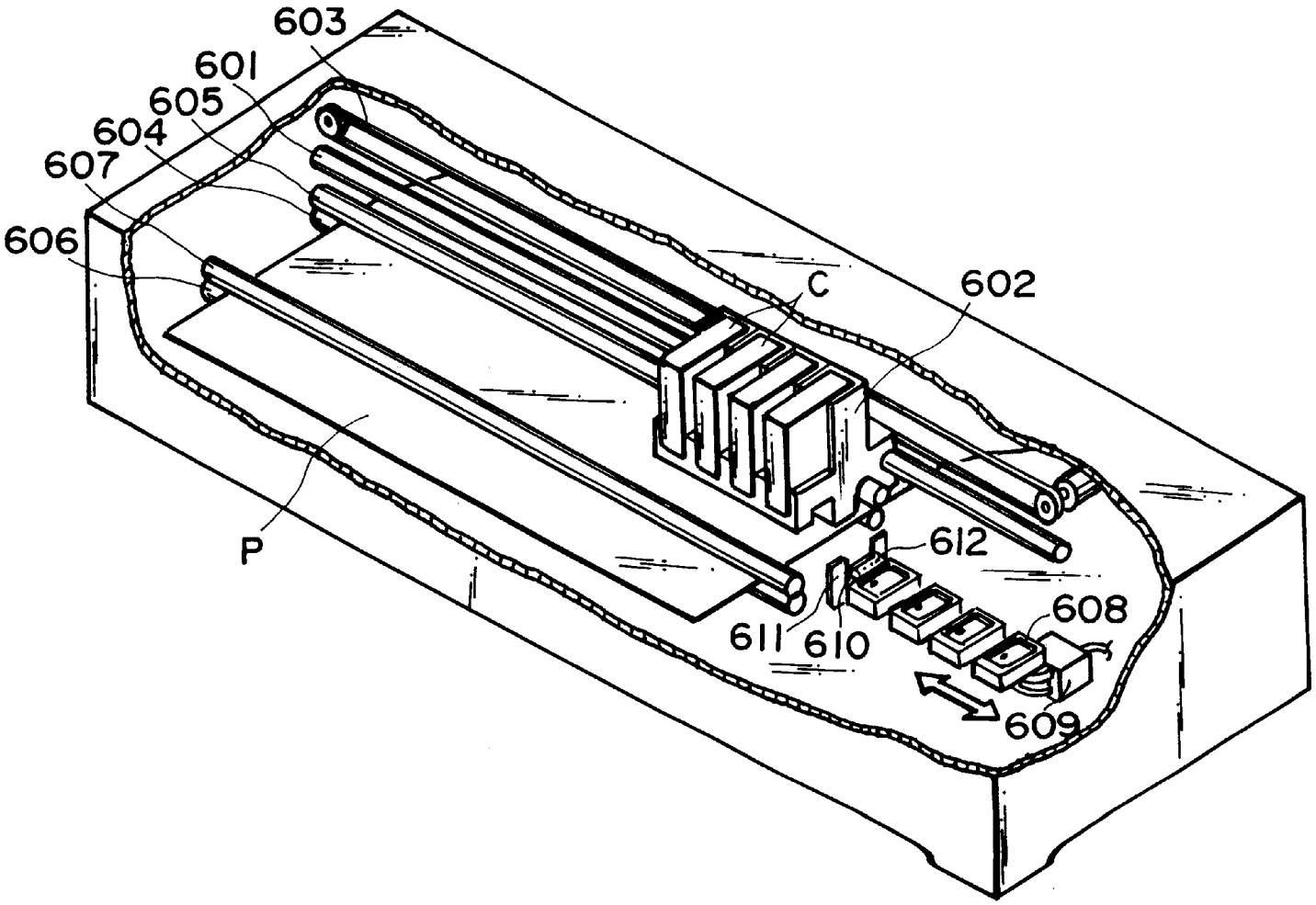
FIG. 57 is a perspective view of an implemented device for type 4 of PWM control.

FIG. 56 shows an example wherein such a three step stabilization control (ejection amount Vd0(S), Vd0(L), Vd0 (S+L)) is used to effect black printing (Bk) and color printing (Col). In this example, the recording device is a serial scanning type machine as shown in FIG. 57. The recording device has a carriage 601 reciprocable along a guide 601, on which a cartridge C is mounted. The carriage 601 is scanningly reciprocated by a belt 603 moved by an unshown motor. The cartridge C has a head cartridge integrally including a black ink ejecting head and a black ink container, and has a head cartridge integrally having color ink ejecting heads and color ink containers. Designated by 604 to 607 are rollers for feeding a sheet P as a recording material; 608 is a cap corresponding to each of the heads in the cartridge C. By suction of the inside of the cap using a pump unit 609, the clogging of each head is prevented. Designated by 610, 611 are first and second blades functioning as wipers; 612 is a blade cleaner of absorbing material for cleaning the first blade 610.

In this example, the black ink head is controlled stepwisely by the heat generating element S having a small heating value and a heat generating element L having a large heating value, more particularly, with 3 steps (ejection amounts Vd0(S), Vd0(L) and Vd0(S+L) (25:45:70)). One, the color ink head is controlled stepwisely by the heat generating element S having a small heating value and a heat generating element L having a large heating value, more particularly, with 3 steps (ejection amounts Vd0(S), Vd0(L) and Vd0(S+L) (15:25:40)).

The printing mode "Fast" in FIG. 56 is a high speed recording mode at the recording density 360 dpi, wherein in both of the black printing (Bk) and the color printing (Col), one dot is printed for one pixel through one unidirectional scanning of the carriage 602. For the black printing, the ink ejection amount is Vd0 (S+L), and the ejection amount ratio is 70. For the color printing, the ink ejection amount is Vd0 (S+L), and the ejection amount ratio is 40.

The printing mode "Norm" in FIG. 56, is a normal recording mode at a recording density-of-360 dpi, wherein in both of the black printing (Bk) and the color printing (Col), binary recording and ternary recording are selectively usable. In the black printing with the binary recording, a dot is printed for one pixel with the ejection amount ratio 70, that is, Vd0(S+L) through unidirectional two scans of the carriage 602. In the ternary recording, the ink of the ejection amount Vd0(L), ejection amount ratio 45, is ejected with two unidirectional scans with deviation of a half pixel. On the other hand, in the binary recording for color printing, a dot is printed for one pixel with the ejection amount ratio 40, that is, Vd0(S+L) by two bidirectional scans of the carriage 602. In the ternary recording, the ejection amount of the ink is Vd0(L) (the ejection amount ration of 25), and two bidirectional scans are used with deviation of a half of the pixel.

The printing mode "HQ" in FIG. 56 is a high resolution recording mode at the recording density-of-360 dpi, and quinary recording is effected for both of the black printing (Bk) and the color printing (Col). In the black printing, four unidirectional scans of the carriage 602 with the deviation of a half of one pixel are used, and the ink ejection amount is Vd0(S) (ejection amount ratio is 25). On the other hand, in the color printing, four unidirectional scans of the carriage 602 are used with deviation of a half pixel, and the ink ejection amount is Vd0(S) (ejection amount ratio of 15).

(Other Embodiments)

Other embodiments will be described. In the following, either a single-flow-path type or two-flow-path type will be taken, but any example is usable for both unless otherwise stated.

<Liquid flow path ceiling configuration>

Figure 13:
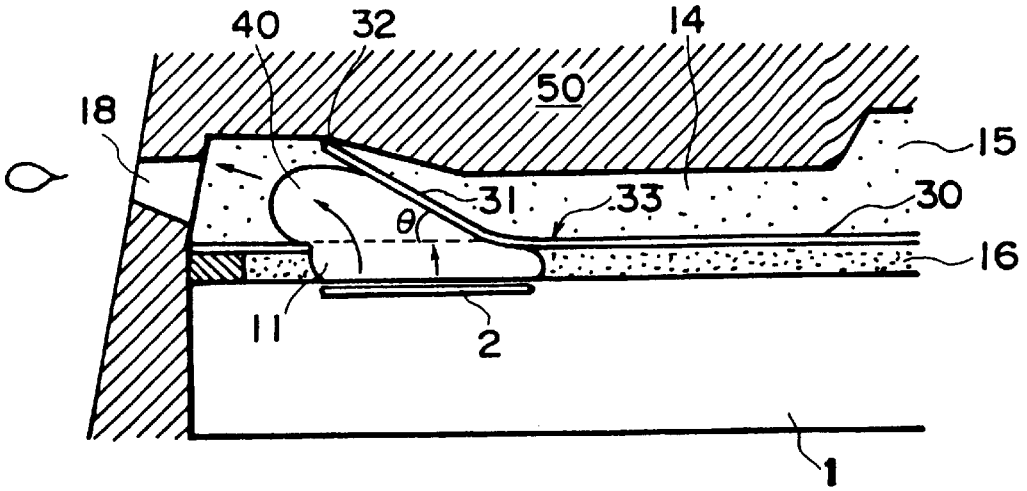
FIG. 13 illustrates structures of a movable member and a first liquid flow path of a liquid ejecting head according to an embodiment of the present invention.

FIG. 13 is a sectional view taken along the length of the flow path of the liquid ejecting head according to the embodiment. Grooves for constituting the first liquid flow paths 14 (or liquid flow paths 10 in FIG. 1) are formed in grooved member 50 on a partition wall 30. In this embodiment, the height of the flow path ceiling adjacent the free end 32 position of the movable member is greater to permit larger operation angle 6 of the movable member. The operation range of the movable member is determined in consideration of the structure of the liquid flow path, the durability of the movable member and the bubble generation power or the like. It is desirable that it moves in the angle range wide enough to include the angle of the position of the ejection outlet.

As shown in this Figure, the displaced level of the free end of the movable member is made higher than the diameter of the ejection outlet, by which sufficient ejection pressure is transmitted. As shown in this Figure, a height of the liquid flow path ceiling at the fulcrum 33 position of the movable member is lower than that of the liquid flow path ceiling at the free end 32 position of the movable member, so that the release of the pressure wave to the upstream side due to the displacement of the movable member can-be further effectively prevented.

<Positional relation between second liquid flow path and movable member>

Figure 14A:
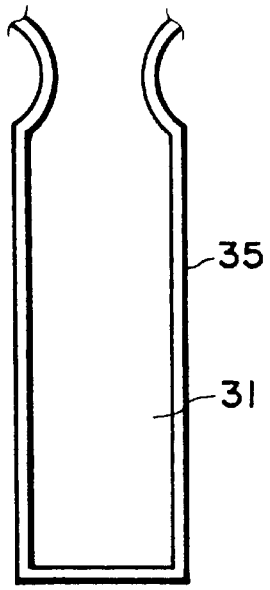
FIGS. 14(*a*)–14(*c*) illustrate a structure of a movable member and a liquid flow path of a liquid ejecting head according to an embodiment of the present invention.
Figure 14B:
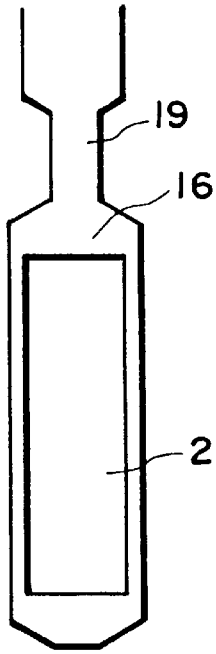
Figure 14C:
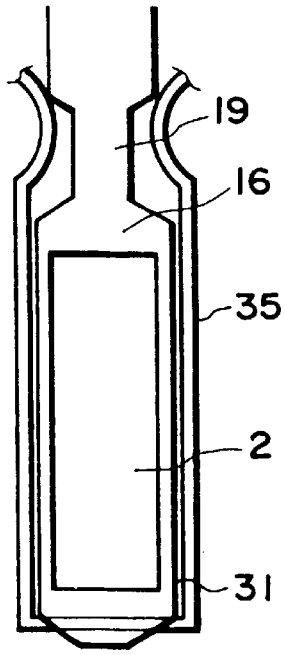

FIG. 14 is an illustration of a positional relation between the above-described movable member 31 and second liquid flow path 16, and (a) is a view of the movable member 31 position of the partition wall 30 as seen from the above, and (b) is a view of the second liquid flow path 16 seen from the above without partition wall 30. FIG. 14, (*c*) is a schematic view of the positional relation between the movable member 6 and the second liquid flow path 16 wherein the elements are overlaid. In these Figures, the bottom is a front side having the ejection outlets.

The second liquid flow path 16 of this embodiment has a throat portion 19 upstream of the heat generating element 2 with respect to a general flow of the liquid from the second common liquid chamber side to the ejection outlet through the heat generating element position, the movable member position along the first flow path, so as to provide a chamber (bubble generation chamber) effective to suppress easy release, toward the upstream side, of the pressure produced upon the bubble generation in the second liquid flow path 16.

In the case of the conventional head wherein the flow path where the bubble generation occurs and the flow path from which the liquid is ejected, are the same, a throat portion may be provided to prevent the release of the pressure generated by the heat generating element toward the liquid chamber. In such a case, the cross-sectional area of the throat portion should not be too small in consideration of the sufficient refilling of the liquid.

However, in the case of this embodiment, much or most of the ejected liquid is from the first liquid flow path, and the bubble generation liquid in the second liquid flow path having the heat generating element is not consumed much, so that the filling amount of the bubble generation liquid to the bubble generation region 11 may be small. Therefore, the clearance at the throat portion 19 can be made very small, for example, as small as several $\mu$m—ten and several $\mu$m, so that the release of the pressure produced in the second liquid flow path can be further suppressed and to further concentrate it to the movable member side. The pressure can be used as the ejection pressure through the movable member 31, and therefore, the high ejection energy use efficiency and ejection pressure can be accomplished. The configuration of the second liquid flow path 16 is not limited to the one described above, but may be any if the pressure produced by the bubble generation is effectively transmitted to the movable member side.

As shown in FIG. 14, (*c*), the lateral sides of the movable member 31 cover respective parts of the walls constituting the second liquid flow path so that the falling of the movable member 31 into the second liquid flow path is prevented. By doing so, the above-described separation between the ejection liquid and the bubble generation liquid is further enhanced. Furthermore, the release of the bubble through the slit can be suppressed so that ejection pressure and ejection efficiency are further increased. Moreover, the above-described effect of the refilling from the upstream side by the pressure upon the collapse of bubble, can be further enhanced.

In FIG. 12, (*b*) and FIG. 13, a part of the bubble generated in the bubble generation region of the second liquid flow path 4 with the displacement of the movable member 6 to the first liquid flow path 14 side, extends into the first liquid flow path 14 side. by selecting the height of the second flow path to permit such extension of the bubble, the ejection force is further improved as compared with the case without such extension of the bubble. To provide such extending of the bubble into the first liquid flow path 14, the height of the second liquid flow path 16 is preferably lower than the height of the maximum bubble, more particularly, the height is preferably several $\mu$m—30 $\mu$m, for example. In this example, the height is 15 $\mu$m.

<Movable member and partition wall>

Figure 15A:
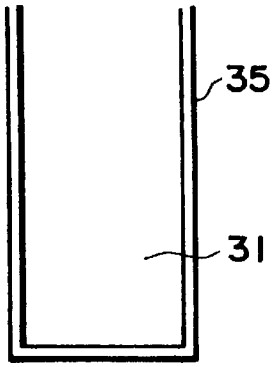
FIGS. 15(*a*)–15(*c*) illustrate another configuration of a movable member of the liquid ejecting head according to the present invention.
Figure 15B:
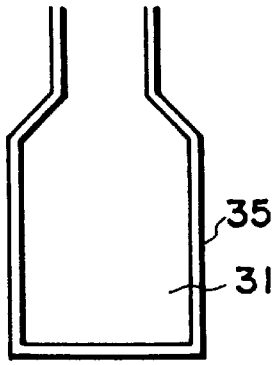
Figure 15C:
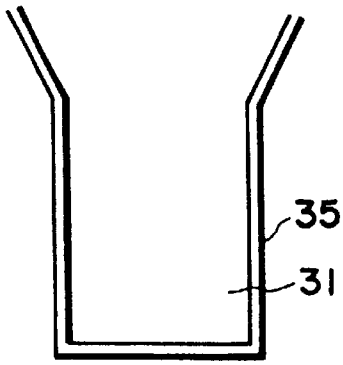
Figure 16:
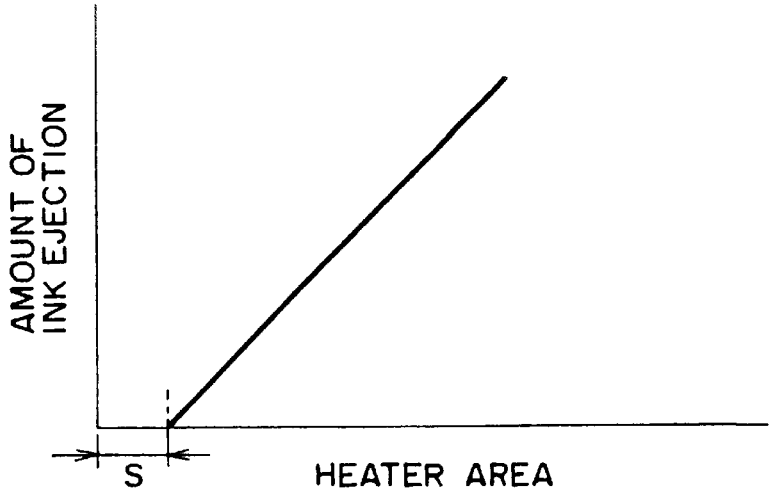
FIG. 16 shows a relation between a heat generating element area and ink ejection amount of a liquid ejecting head.

FIG. 15 shows another example of the movable member 31, wherein reference numeral 35 designates a slit formed in the partition wall, and the slit is effective to provide the movable member 31. In FIG. 15, (*a*), the moveable member has a rectangular configuration, and in (*b*), it is narrower in the fulcrum side to permit increased mobility of the movable member, and in (*c*), it has a wider-fulcrum side to enhance the durability of the movable member. The configuration narrowed and arcuated at the fulcrum side is desirable as shown in FIG. 14, (*a*), since both of easiness of motion and durability are satisfied. However, the configuration of the movable member is not limited to the one described above, but it may be any if it does not enter the second liquid flow path side, and motion is easy with high durability.

In the foregoing embodiments, the plate or film movable member 31 and the separation wall 5 having this movable member was made of a nickel having a thickness of 5 μm, but this is not limited to this example, but it may be any if it has anti-solvent property against the bubble generation liquid and the ejection liquid, and if the elasticity is enough to permit the operation of the movable member, and if the required fine slit-can be formed.

Preferable examples of the materials for the movable member include durable materials such as metal such as silver, nickel, gold, iron, titanium, aluminum, platinum, tantalum, stainless steel, phosphor bronze or the like, alloy thereof, or resin material having nytril group such as acrylonitrile, butadiene, stylene or the like, resin material having amide group such as polyamide or the like, resin material having carboxyl such as polycarbonate or the like, resin material having aldehyde group such as polyacetal or the like, resin material having sulfon group such as polysulfone, resin material such as liquid crystal polymer or the like, or chemical compound thereof; or materials having durability against the ink, such as metal such as gold, tungsten, tantalum, nickel, stainless steel, titanium, alloy thereof, materials coated with such metal, resin material having amide group such as polyamide, resin material having aldehyde group such as polyacetal, resin material having ketone group such as polyetheretherketone, resin material having imide group such as polyimide, resin material having hydroxyl group such as phenolic resin, resin material having ethyl group such as polyethylene, resin material having alkyl group such as polypropylene, resin material having epoxy group such as epoxy resin material, resin material having amino group such as melamine resin material, resin material having methylol group such as xylene resin material, chemical compound thereof, ceramic material such as silicon dioxide or chemical compound thereof.

Preferable examples of partition or division wall include resin material having high heat-resistive, high anti-solvent property and high molding property, more particularly recent engineering plastic resin materials such as polyethylene, polypropylene, polyamide, polyethylene terephthalate, melamine resin -material, phenolic resin, epoxy resin material, polybutadiene, polyurethane, polyetheretherketone, polyether sulfone, polyallylate, polyimide, polysulfone, liquid crystal polymer (LCP), or chemical compound thereof, or metal such as silicon dioxide, silicon nitride, nickel, gold, stainless steel, alloy thereof, chemical compound thereof, or materials coated with titanium or gold.

The thickness of the separation wall is determined depending on the used material and configuration from the standpoint of sufficient strength as the wall and sufficient operativity as the movable member, and generally, 0.5 μm–10 μm approx. is desirable.

The width of the slit 35 for providing the movable member 31 is 2 μm in the embodiments. When the bubble generation liquid and ejection liquid are different materials, and mixture of the liquids is to be avoided, the gap is determined so as to form a meniscus between the liquids, thus avoiding mixture therebetween. For example, when the bubble generation liquid has a viscosity about 2 cP, and the ejection liquid has a viscosity not less than 100 cP, 5 μm approx. slit is enough to avoid the liquid mixture, but not more than 3 μm is desirable.

When the ejection liquid and the bubble generation liquid are separated, the movable member functions as a partition therebetween. However, a small amount of the bubble generation liquid is mixed into the ejection liquid. In the case of liquid ejection for printing, the percentage of the mixing is practically of no problem, if the percentage is less than 20%. The percentage of the mixing can be controlled in the present invention by properly selecting the viscosities of the ejection liquid and the bubble generation liquid.

When the percentage is desired to be small, it can be reduced to 5%, for example, by using 5 CPS or lower fro the bubble generation liquid and 20 CPS or lower for the ejection liquid.

In this invention, the movable member has a thickness of μm order as preferable thickness, and a movable member having a thickness of cm order is not used in usual cases. When a slit is formed in the movable member having a thickness of μm order, and the slit has the width (W μm) of the order of the thickness of the movable member, it is desirable to consider the variations in the manufacturing.

When the thickness of the member opposed to the free end and/or lateral edge of the movable member formed by a slit, is equivalent to the thickness of the movable member (FIGS. 12, 13 or the like), the relation between the slit width and the thickness is preferably as follows in consideration of the variation in the manufacturing to stably suppress the liquid mixture between the bubble generation liquid and the ejection liquid. When the bubble generation liquid has a viscosity not more than 3 cp, and a high viscous ink (5 cp, 10 cp or the like) is used as the ejection liquid, the mixture of the 2 liquids can be suppressed for a long term if $W/t \leqq 1$ is satisfied.

The slit providing the "substantial sealing", preferably has several microns width, since the liquid mixture prevention is assured.

In the case that the bubble generation liquid and the ejection liquid are used as different function liquids, the movable member functions substantially as a partition or separation member between the liquids. When the movable member moves with the generation of the bubble, a small quantity of the bubble generation liquid may be introduced into the ejection liquid (mixture). Generally, in the ink jet recording, the coloring material content of the ejection liquid is 3% to 5% approx., and therefore, no significant density change results if the percentage of the bubble generation liquid mixed into the ejected droplet is not more than 20%. Therefore, the present invention covers the case where the mixture ratio of the bubble generation liquid of not more than 20%.

In the above-described structure, the mixing ratio of the bubble generation liquid was at most 15% even when the viscosity was changed. When the viscosity of the bubble generation liquid was not more than 5 cP, the mixing ratio was approx. 10% at the maximum, although it was dependent on the driving frequency.

When the viscosity of the ejection liquid is not more than 20 cP, the liquid mixing can be reduced (to not more than 5%, for example).

The description will be made as to positional relation between the heat generating element and the movable member in this head. The configuration, dimension and number of the movable member and the heat generating element are not limited to the following example. By an optimum arrangement of the heat generating element and the movable member, the pressure upon bubble generation by the heat generating element, can be effectively used as the ejection pressure.

In a conventional bubble jet recording method, energy such as heat is applied to the ink to generate instantaneous volume change (generation of bubble) in the ink, so that the ink is ejected through an ejection outlet onto a recording material to effect printing. In this case, the area of the heat generating element and the ink ejection amount are proportional to each other. However, there is a non-bubble-generation region S not contributable to the ink ejection. This fact is confirmed from observation of kogation on the heat generating element, that is, the non-bubble-generation area S extends in the marginal area of the heat generating element. It is understood that the marginal approx. 4 μm width is not contributable to the bubble generation.

In order to effectively use the bubble generation pressure, it is preferable that the movable range of the movable member covers the effective bubble generating region of the heat generating element, namely, the inside area beyond the marginal approx. 4 μm width. In this embodiment, the effective bubble generating region is approx. 4μ and inside thereof, but this is different if the heat generating element and forming method is different.

Figure 17A:
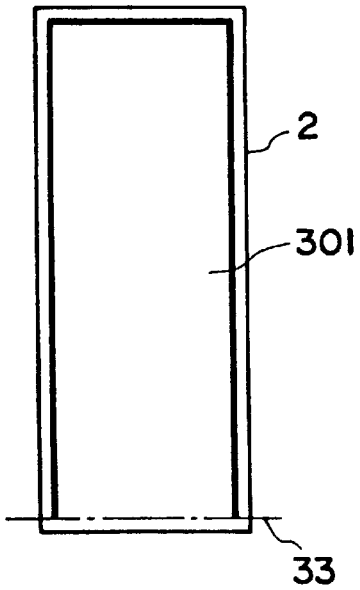
FIGS. 17(*a*) and 17(*b*) show a positional relation between a movable member and a heat generating element of a liquid ejecting head according to the present invention.
Figure 17B:
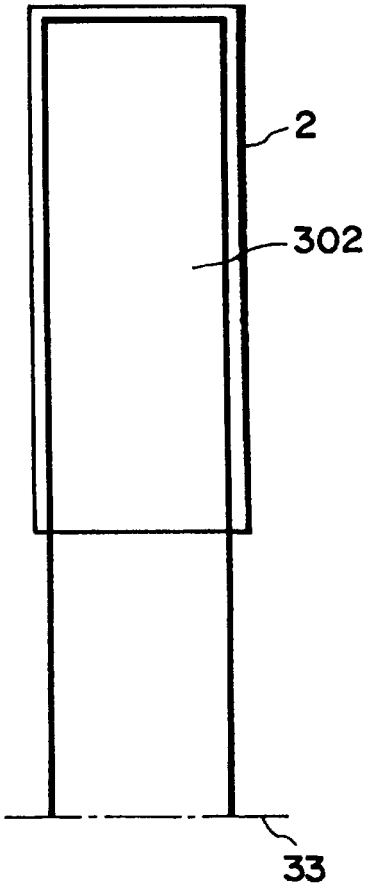
Figure 18:
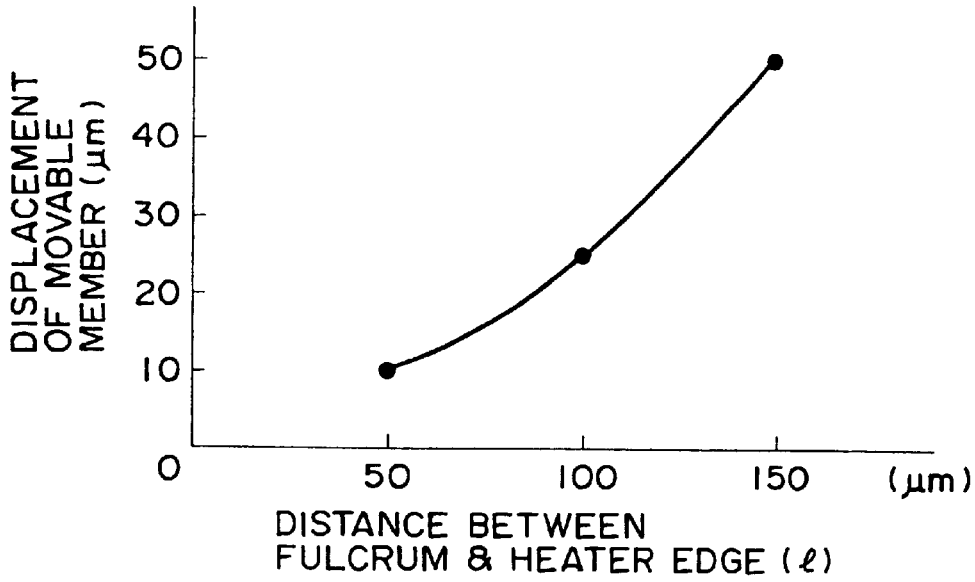
FIG. 18 shows a relation between a distance between an edge of a heat generating element and a fulcrum and a displacement of the movable member in a liquid ejecting head of the present invention.

FIG. 17 is a schematic view as seen from the top, wherein the use is made with a heat generating element 2 of 58×150 μm, and with a movable member 301, FIG. 17, (*a*) and a movable member 302, FIG. 17, (*b*) which have different total area.

The dimension of the movable member 301 is 53×145 μm, and is smaller than the area of the heat generating element 2, but it has an area equivalent to the effective bubble generating region of the heat generating element 2, and the movable member 301 is disposed to cover the effective bubble generating region. On the other hand, the dimension of the movable member 302 is 53×220 μm, and is larger than the area of the heat generating element 2 (the width dimension is the same, but the dimension between the fulcrum and movable leading edge is longer than the length of the heat generating element), similarly to the movable member 301. It is disposed to cover the effective bubble generating region. The tests have been carried out with the two movable members 301 and 302 to check the durability and the ejection efficiency. The conditions were as follows:

Bubble generation liquid: Aqueous solution of ethanol (40%)

Ejection ink: dye ink

Voltage: 20.2 V

Frequency: 3 kHz

The results of the experiments show that the movable member 301 was damaged at the fulcrum when $1\times10^7$ pulses were applied. The movable member 302 was not damaged even after $3\times10^8$ pulses were applied. Additionally, the ejection amount relative to the supplied energy and the kinetic energy determined by the ejection speed, are improved by approx. 1.5–2.5 times.

From the results, it is understood that a movable member having an area larger than that of the heat generating element and disposed to cover the portion right above the effective bubble generating region of the heat generating element, is preferable from the standpoint of durability and ejection efficiency.

Figure 19:
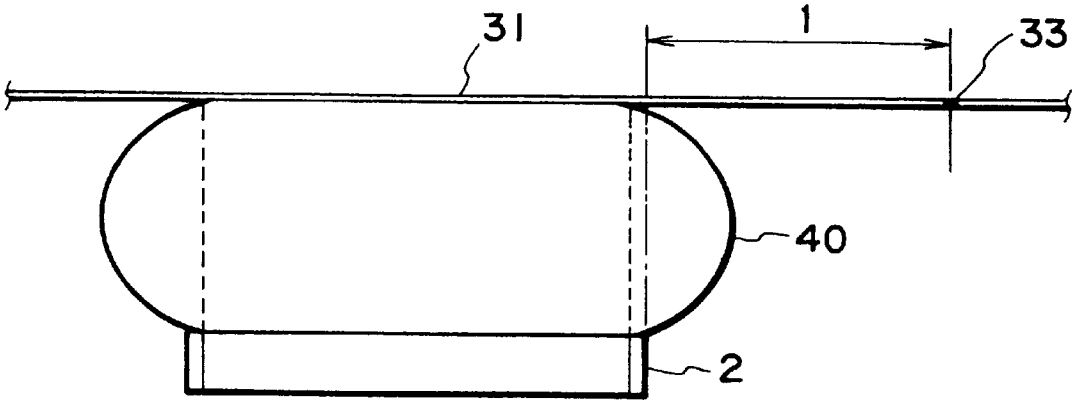
FIG. 19 illustrates a positional relation between the heat generating element and the movable member in a liquid ejecting head of the present invention.
Figure 20A:
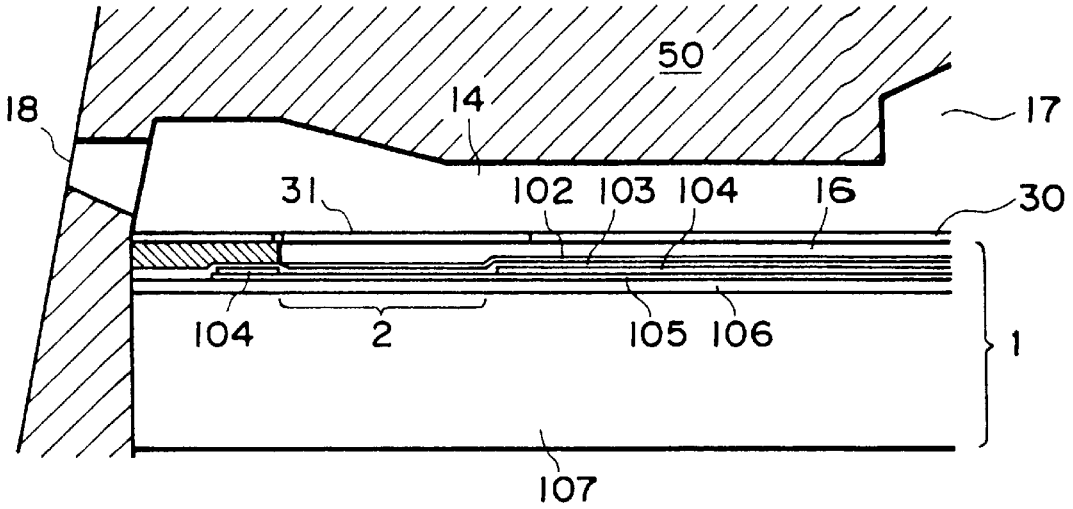
FIGS. 20(*a*) and 20(*b*) are longitudinal sectional views of a liquid ejecting head usable in the present invention.
Figure 20B:
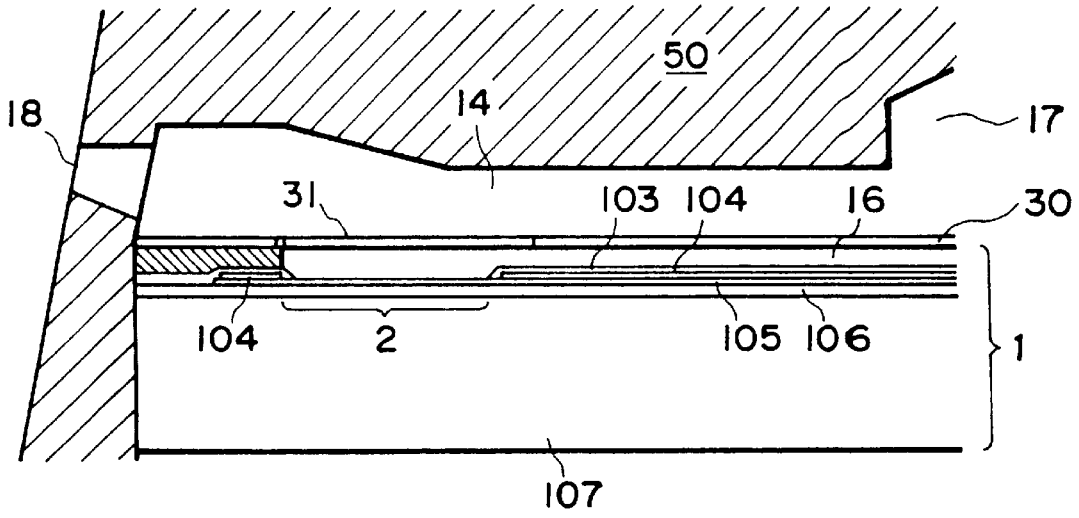

FIG. 19 shows a relation between a distance between the edge of the heat generating element and the fulcrum of the movable member and the displacement of the movable member. FIG. 20 is a section view, as seen from the side, which shows a positional relation between the heat generating element 2 and the movable member 31. The heat generating element 2 has a dimension of 40×105 μm. It will be understood that the displacement increases with increase with the distance of 1 from the edge of the heat generating element 2 and the fulcrum 33 of the movable member 31. Therefore, it is desirable to determinate the position of the fulcrum of the movable member on the basis of the optimum displacement depending on the required ejection amount of the ink, flow passage structure, heat generating element configuration and so on.

When the fulcrum of the movable member is right above the effective bubble generating region of the heat generating element, the bubble generation pressure is directly applied to the fulcrum in addition to the stress due to the displacement of the movable member, and therefore, the durability of the movable member lowers. The experiments by the inventors have revealed that when the fulcrum is provided right above the effective bubble generating region, the movable wall is damaged after application of $1\times10^6$ pulses, that is, the durability is lower. Therefore, by disposing the fulcrum of the movable member outside the right above position of the effective bubble generating region of the heat generating element, a movable member of a configuration and/or a material not providing very high durability can be practically usable. On the other hand, even if the fulcrum is right above the effective bubble generating region, it is practically usable if the configuration and/or the material is properly selected. By doing so, a liquid ejecting head with the high ejection energy use efficiency and the high durability can be provided.

<Element substrate>

The description will be made as to a structure of the element substrate provided with the heat generating element for heating the liquid.

FIG. 20 is a longitudinal section of the liquid ejecting head according to an embodiment of the present invention.

On the element substrate 1, a grooved member 50 is mounted, the member 50 having second liquid flow paths 16, separation walls 30, first liquid flow paths 14 and grooves for constituting the first liquid flow path.

Figure 11:
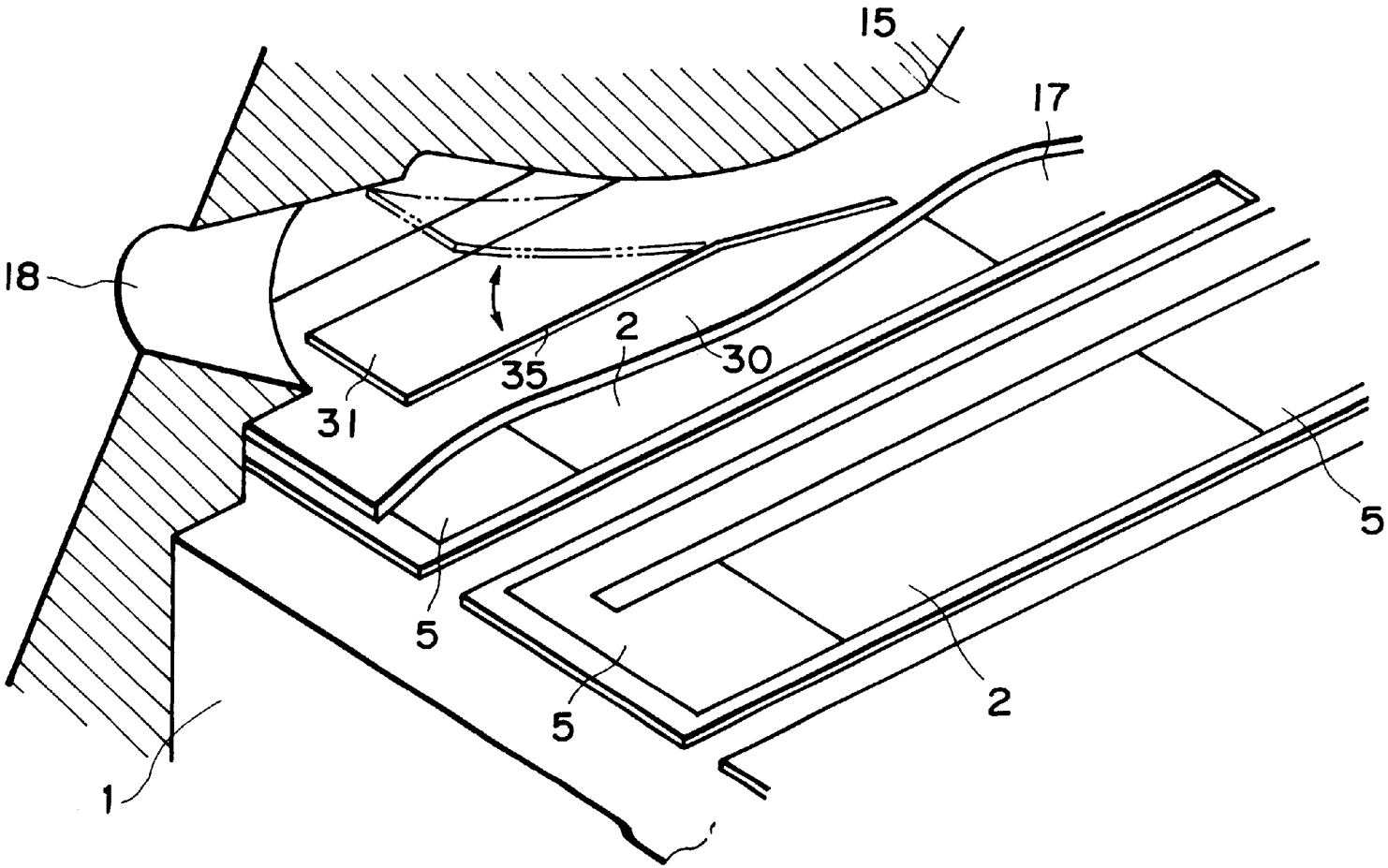
FIG. 11 is a partly broken perspective view of a liquid ejecting head of the sixth embodiment of the present invention.

The element substrate 1 has, as shown in FIG. 11, patterned wiring electrode (0.2–1.0 μm thick) of aluminum or the like and patterned electric resistance layer 105 (0.01–0.2 μm thick) of hafnium boride ($HfB_2$), tantalum nitride (TaN), tantalum aluminum (TaAl) or the like constituting the heat generating element on a silicon oxide film or silicon nitride film 106 for insulation and heat accumulation, which in turn is on the substrate 107 of silicon or the like. A voltage is applied to the resistance layer 105 through the two wiring electrodes 104 to flow a current through the resistance layer to effect heat generation. Between the wiring electrode, a protection layer of silicon oxide, silicon nitride or the like of 0.1–2.0 μm thick is provided on the resistance layer, and in addition, an anti-cavitation layer of tantalum or the like (0.1–0.6 μm thick) is formed thereon to protect the resistance layer 105 from various liquid such as ink.

The pressure and shock wave generated upon the bubble generation and collapse is so strong that the durability of the oxide film which is relatively fragile is deteriorated. Therefore, metal material such as tantalum (Ta) or the like is used as the anticavitation layer.

The protection layer may be omitted depending on the combination of liquid, liquid flow path structure and resistance material. One of such examples is shown in FIG. 4, (b). The material of the resistance layer not requiring the protection layer, includes, for example, iridium-tantalum-aluminum alloy or the like. Thus, the structure of the heat generating element in the foregoing embodiments may include only the resistance layer (heat generation portion) or may include a protection layer for protecting the resistance layer.

In the embodiment, the heat generating element has a heat generation portion having the resistance layer which generates heat in response to the electric signal. This is not limiting, and it will suffice if a bubble enough to eject the ejection liquid is created in the bubble generation liquid. For example, heat generation portion may be in the form of a photothermal transducer which generates heat upon receiving light such as laser, or the one which generates heat upon receiving high frequency wave.

On the element substrate 1, function elements such as a transistor, a diode, a latch, a shift register and so on for selective driving the electrothermal transducer element may also be integrally built in, in addition to the resistance layer 105 constituting the heat generation portion and the electrothermal transducer constituted by the wiring electrode 104 for supplying the electric signal to the resistance layer.

Figure 21:
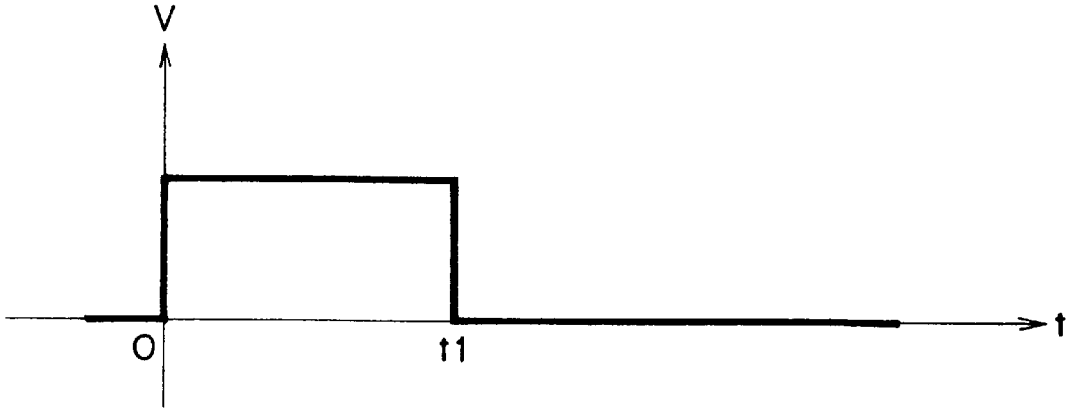
FIG. 21 is a schematic view of a configuration of a driving pulse in a liquid ejecting head of the present invention.

In order to eject the liquid by driving the heat generation portion of the electrothermal transducer on the above-described element substrate 1, the resistance layer 105 is supplied through the wiring electrode 104 with rectangular pulses as shown in FIG. 21 to cause instantaneous heat generation in the resistance layer 105 between the wiring electrode. In the case of the heads of the foregoing embodiments, the applied energy has a voltage of 24 V, a pulse width of 7 $\mu$sec, a current of 150 mA and a frequency of 6 kHz to drive the heat generating element, by which the liquid ink is ejected through the ejection outlet through the process described hereinbefore. However, the driving signal conditions are not limited to this, but may be any if the bubble generation liquid is properly capable of bubble generation.

<Head structure of 2 flow path structure>

The description will be made as to a structure of the liquid ejecting head with which different liquids are separately accommodated in first and second common liquid chamber, and the number of parts can be reduces so that the manufacturing cost can be reduced.

Figure 22:
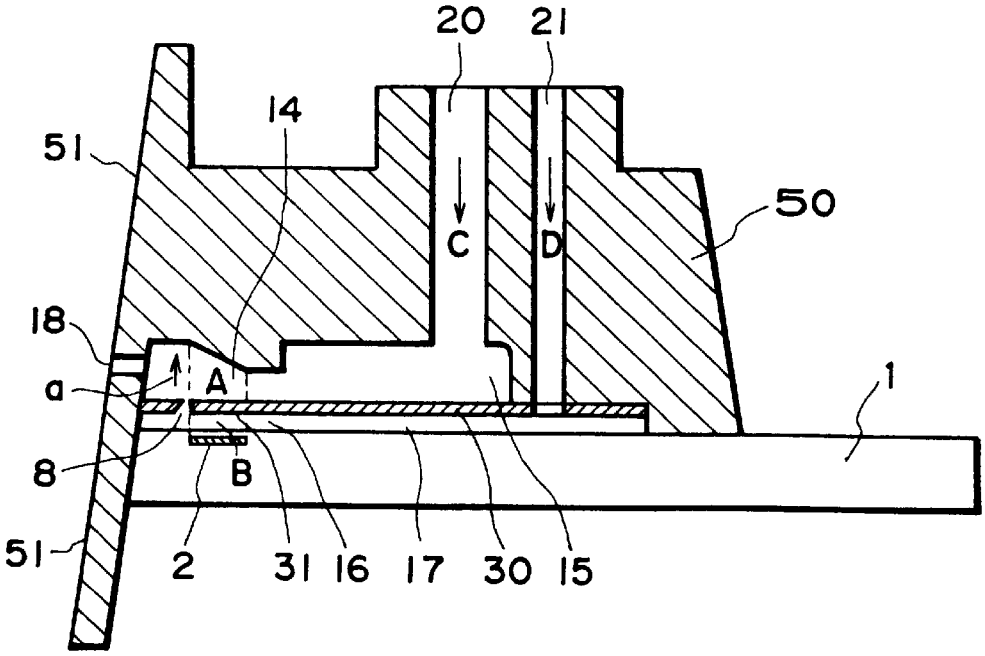
FIG. 22 is a sectional view illustrating a supply passage in a liquid ejecting head of the present invention.

FIG. 22 is a schematic view of such a liquid ejecting head. The same reference numerals as in the previous embodiment are assigned to the elements having the corresponding functions, and detailed descriptions thereof are omitted for simplicity.

In this embodiment, a grooved member 50 has an orifice plate 51 having an ejection outlet 18, a plurality of grooves for constituting a plurality of first liquid flow paths 14 and a recess for constituting the first common liquid chamber 15 for supplying the liquid (ejection liquid) to the plurality of liquid flow paths 14. A separation wall 30 is mounted to the bottom of the grooved member 50 by which plurality of first liquid flow paths 14 are formed. Such a grooved member 50 has a first liquid supply passage 20 extending from an upper position to the first common liquid chamber 15. The grooved member 50 also has a second liquid supply passage 21 extending from an upper position to the second common liquid chamber 17 through the separation wall 30.

As indicated by an arrow C in FIG. 22, the first liquid (ejection liquid) is supplied through the first liquid supply passage 20 and first common liquid chamber 15 to the first liquid flow path 14, and the second liquid (bubble generation liquid) is supplied to the second liquid flow path 16 through the second liquid supply passage 21 and the second common liquid chamber 17 as indicated by arrow D in FIG. 21.

In this example, the second liquid supply passage 21 is extended in parallel with the first liquid supply passage 20, but this is not limited to the exemplification, but it may be any if the liquid is supplied to the second common liquid chamber 17 through the separation wall 30 outside the first common liquid chamber 15.

The (diameter) of the second liquid supply passage 21 is determined in consideration of the supply amount of the second liquid. The configuration of the second liquid supply passage 21 is not limited to circular or round but may be rectangular or the like.

Figure 23:
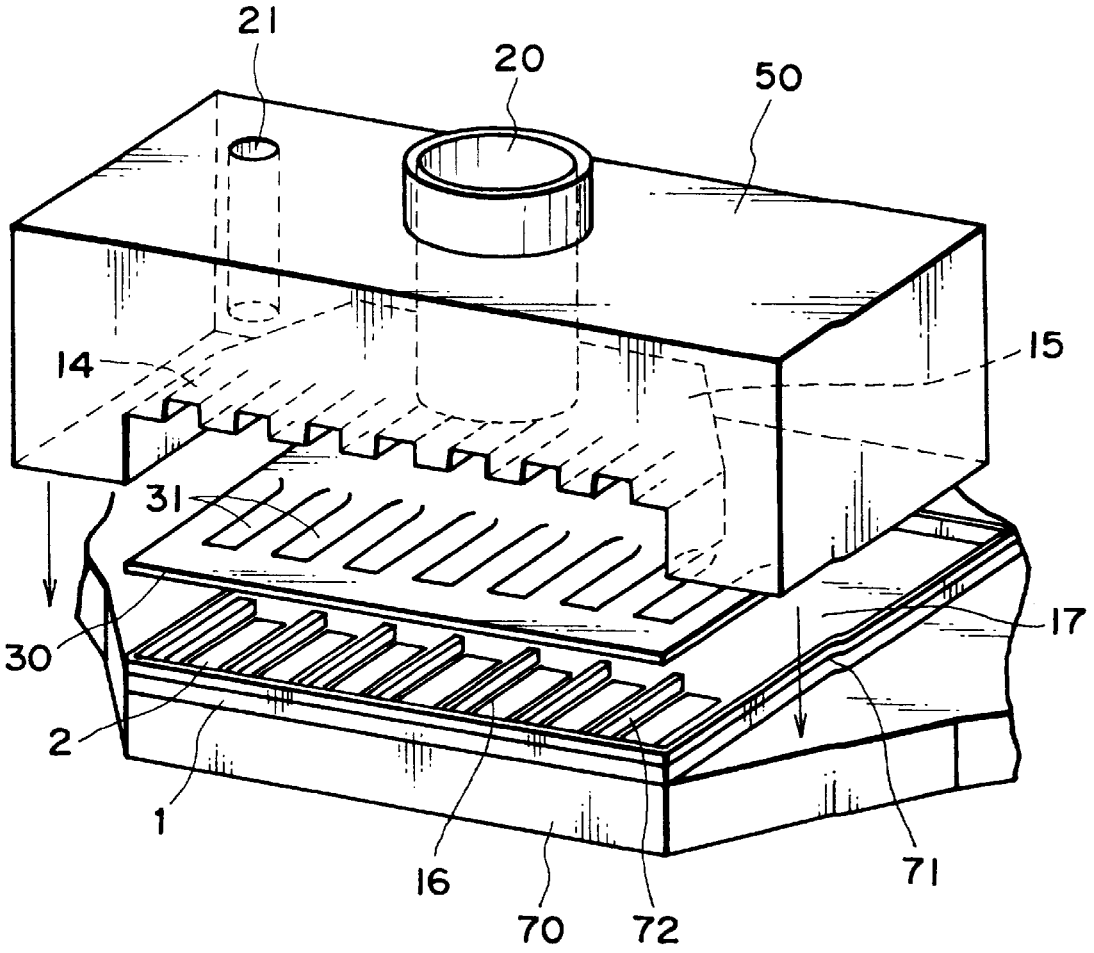
FIG. 23 is an exploded perspective view of a liquid ejecting head usable with the present invention.
Figure 24A:
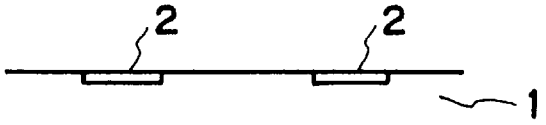
FIGS. 24(*a*)–24(*e*) are process charts illustrating a manufacturing method of the liquid ejecting head of the present invention.
Figure 24B:
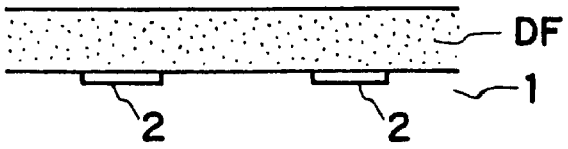
Figure 24C:
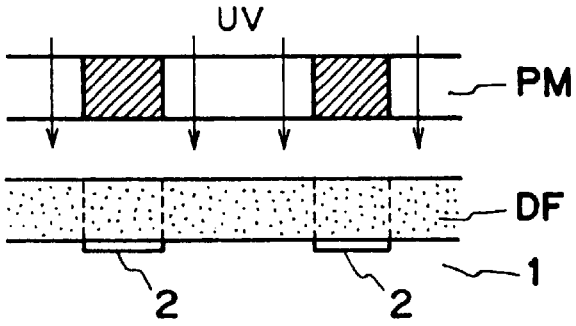
Figure 24D:
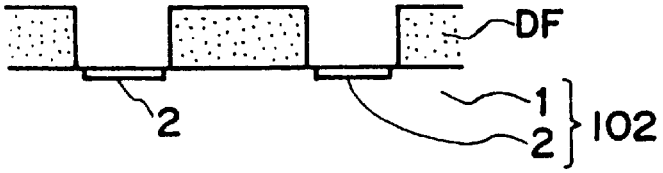
Figure 24E:
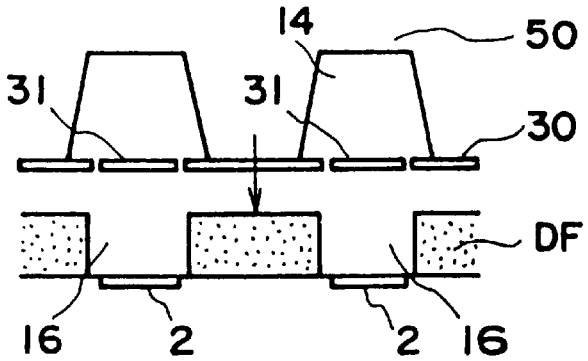
Figure 25A:
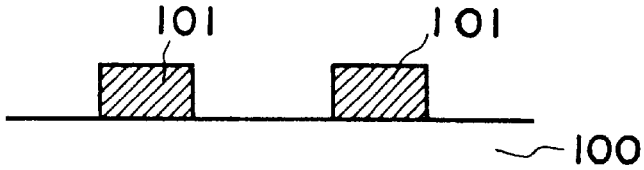
FIGS. 25(*a*)–25(*d*) are process chart illustrating a manufacturing method of the liquid ejection head of the present invention.
Figure 25B:
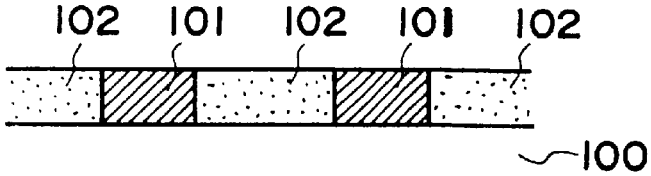
Figure 25C:
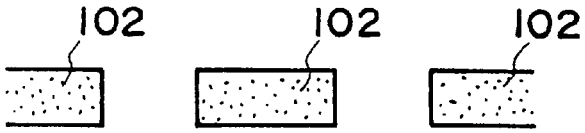
Figure 25D:
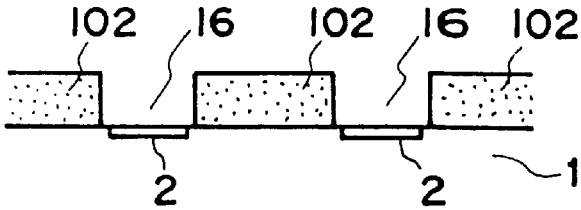
Figure 26A:
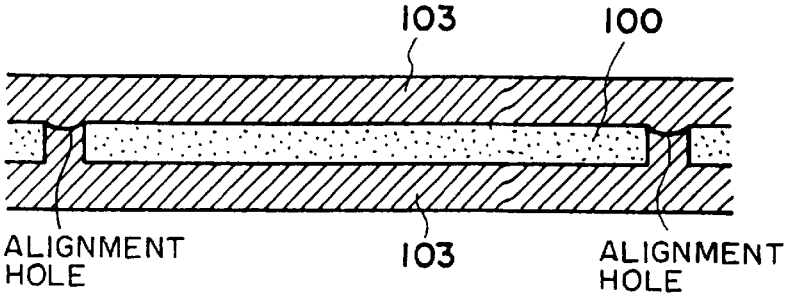
FIGS. 26(*a*)–26(*d*) are process charts illustrating a manufacturing method of the liquid ejecting head of the present invention.
Figure 26B:
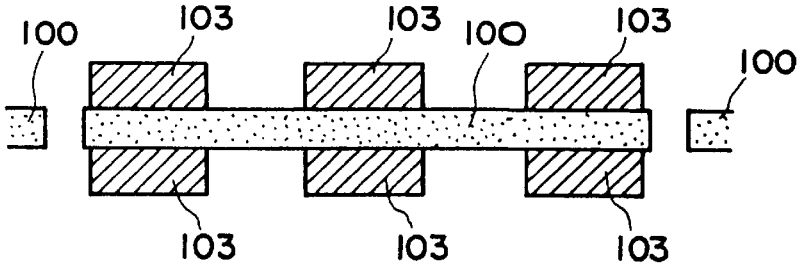
Figure 26C:
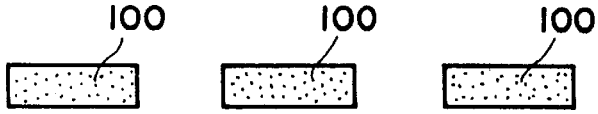
Figure 26D:
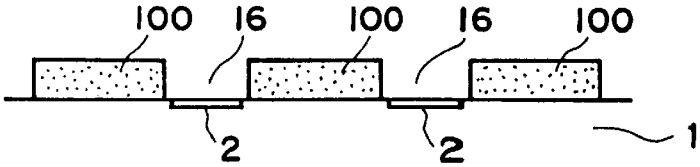

The second common liquid chamber 17 may be S formed by dividing the grooved by a separation wall 30. As for the method of forming this, as shown in FIG. 23 which is an exploded perspective view, a common liquid chamber frame and a second liquid passage wall are formed of a dry film, and a combination of a grooved member 50 having the separation wall fixed thereto and the element substrate 1 are bonded, thus forming the second common liquid chamber 17 and the second liquid flow path 16.

In this example, the element substrate 1 is constituted by providing the supporting member 70 of metal such as aluminum with a plurality of electrothermal transducer elements as heat generating elements for generating heat for bubble generation from the bubble generation liquid through film boiling.

Above the element substrate 1, there are disposed the plurality of grooves constituting the liquid flow path 16 formed by the second liquid passage walls, the recess for constituting the second common liquid chamber (common bubble generation liquid chamber) 17 which is in fluid communication with the plurality of bubble generation liquid flow paths for supplying the bubble generation liquid to the bubble generation liquid passages, and the separation or dividing walls 30 having the movable walls 31.

Designated by reference numeral 50 is a grooved member. The grooved member is provided with grooves for constituting the ejection liquid flow paths (first liquid flow paths) 14 by mounting the separation walls 30 thereto, a recess for constituting the first common liquid chamber (common ejection liquid chamber) 15 for supplying the ejection liquid to the ejection liquid flow paths, the first supply passage (ejection liquid supply passage) 20 for supplying the ejection liquid to the first common liquid chamber, and the second supply passage (bubble generation liquid supply passage) 21 for supplying the bubble generation liquid to the second supply passage (bubble generation liquid supply passage) 21. The second supply passage 21 is connected with a fluid communication path in fluid communication with the second common liquid chamber 17, penetrating through the separation wall 30 disposed outside of the first common liquid chamber 15. By the provision of the fluid communication path, the bubble generation liquid can be supplied to the second common liquid chamber 15 without mixture with the ejection liquid.

The positional relation among the element substrate 1, separation wall 30, grooved top plate 50 is such that the movable members 31 are arranged corresponding to the heat generating elements on the element substrate 1, and that the ejection liquid flow paths 14 are arranged corresponding to the movable members 31. In this example, one second supply passage is provided for the grooved member, but it may be plural in accordance with the supply amount. The cross-sectional area of the flow path of the ejection liquid supply passage 20 and the bubble generation liquid supply passage 21 may be determined in proportion to the supply amount. By the optimization of the cross-sectional area of the flow path, the parts constituting the grooved member 50 or the like can be downsized.

As described in the foregoing, according to this embodiment, the second supply passage for supplying the second liquid to the second liquid flow path and the first supply passage for supplying the first liquid to the first liquid flow path, can be provided by a single grooved top plate, so that the number of parts can be reduced, and therefore, the reduction of the manufacturing steps and therefore the reduction of the manufacturing cost, are accomplished.

Furthermore, the supply of the second liquid to the second common liquid chamber in fluid communication with the second liquid flow path, is effected through the second liquid flow path which penetrates the separation wall for separating the first liquid and the second liquid, and therefore, one bonding step is enough for the bonding of the separation wall, the grooved member and the heat generating element substrate, so that the manufacturing is easy, and the accuracy of the bonding is improved.

Since the second liquid is supplied to the second liquid common liquid chamber, penetrating the separation wall, the supply of the second liquid to the second liquid flow path is assured, and therefore, the supply amount is sufficient so that the stabilized ejection is accomplished.

<Ejection liquid and bubble generation liquid>

As described in the foregoing embodiment, according to the present invention, by the structure having the movable member described above, the liquid can be ejected at higher ejection force or ejection efficiency than the conventional liquid ejecting head. When the same liquid is used for the bubble generation liquid and the ejection liquid, it is possible that the liquid is not deteriorated, and that deposition on the heat generating element due to heating can be reduced. Therefore, a reversible state change is accomplished by repeating the gassification and condensation. So, various liquids are usable, if the liquid is the one not deteriorating the liquid flow passage, movable member or separation wall or the like.

Among such liquids, the one having the ingredient as used in conventional bubble jet device, can be used as a recording liquid.

When the two-flow-path structure of the present invention is used with different ejection liquid and bubble generation liquid, the bubble generation liquid having the above-described property is used, more particularly, the examples includes: methanol, ethanol, n-propyl alcohol, isopropyl alcohol, n- n-hexane, n-heptane, n-octane, toluene, xylene, methylene dichloride, trichloroethylene, Freon TF, Freon BF, ethyl ether, dioxane, cyclohexane, methyl acetate, ethyl acetate, acetone, methyl ethyl ketone, water, or the like, and a mixture thereof.

As for the ejection liquid, various liquids are usable without paying attention to the degree of bubble generation property or thermal property. The liquids which have not been conventionally usable, because of low bubble generation property and/or easiness of property change due to heat, are usable.

However, it is desired that the ejection liquid by itself or by reaction with the bubble generation liquid, does not impede the ejection, the bubble generation or the operation of the movable member or the like.

As for the recording ejection liquid, high viscous ink or the like is usable. As for another ejection liquid, pharmaceuticals and perfume or the like having a nature easily deteriorated by heat is usable. The ink of the following ingredient was used as the recording liquid usable for both of the ejection liquid and the bubble generation liquid, and the recording operation was carried out. Since the ejection speed of the ink is increased, the shot accuracy of the liquid droplets is improved, and therefore, highly desirable images were recorded. Dye ink viscosity of 2 cp:

| | |
|---|---|
| (C. I. food black 2) dye | 3 wt. % |
| diethylene glycol | 10 wt. % |
| Thio diglycol | 5 wt. % |
| Ethanol | 5 wt. % |
| Water | 77 wt. % |

Recording operations were also carried out using the following combination of the liquids for the bubble generation liquid and the ejection liquid. As a result, the liquid having a ten and several cps viscosity, which was unable to be ejected heretofore, was properly ejected, and even 150 cps liquid was properly ejected to provide high quality image. Bubble generation liquid 1:

| | |
|---|---|
| Ethanol | 40 wt. % |
| Water | 60 wt. % |
| Bubble generation liquid 2: | |
| Water | 100 wt. % |
| Bubble generation liquid 3: | |
| Isopropyl alcoholic | 10 wt. % |
| Water | 90 wt. % |
| Ejection liquid 1: | |
| (Pigment ink approx. 15 cp) | |
| Carbon black | 5 wt. % |
| Stylene-acrylate-acrylate ethyl copolymer resin material | 1 wt. % |
| Dispersion material (oxide 140, weight average molecular weight) | |
| Mono-ethanol amine | 0.25 wt. % |
| Glyceline | 69 wt. % |
| Thiodiglycol | 5 wt. % |
| Ethanol | 3 wt. % |
| Water | 16.75 wt. % |
| Ejection liquid 2 (55 cp): | |
| Polyethylene glycol 200 | 100 wt. % |
| Ejection liquid 3 (150 cp): | |
| Polyethylene glycol 600 | 100 wt. % |

In the case of the liquid which has not been easily ejected, the ejection speed is low, and therefore, the variation in the ejection direction is expanded on the recording paper with the result of poor shot accuracy. Additionally, variation of ejection amount occurs due to the ejection instability, thus preventing the recording of high quality image. However, according to the embodiments, the use of the bubble generation liquid permits sufficient and stabilized generation of the bubble. Thus, the improvement in the shot accuracy of the liquid droplet and the stabilization of the ink ejection amount can be accomplished, thus improving the recorded image quality remarkably.

<Manufacturing of liquid ejecting head>

The description will be made as to the manufacturing step of the liquid ejecting head according to the present invention.

In the case of the liquid ejecting head as shown in FIG. 2, a foundation 34 for mounting the movable member 31 is patterned and formed on the element substrate 1, and the movable member 31 is bonded or welded on the foundation 34. Then, a grooved member having a plurality of grooves for constituting the liquid flow paths 10, ejection outlet 18 and a recess for constituting the common liquid chamber 13, is mounted to the element substratel with the grooves and movable members aligned with each other.

The description will be made as to a manufacturing step for the liquid ejecting head having the two-flow-path structure as shown in FIG. 10 and FIG. 23.

Generally, walls for the second liquid flow paths 16 are formed on the element substratel, and separation walls 30 are mounted thereon, and then, a grooved member 50 having the grooves for constituting the first liquid flow paths 14, is mounted further thereon. Or, the walls for the second liquid flow paths 16 are formed, and a grooved member 50 having the separation walls 30 is mounted thereon.

The description will be made as to the manufacturing method for the second liquid flow path.

FIGS. 24, (*a*)–(*e*), is a schematic sectional view for illustrating a manufacturing method for the liquid ejecting head according to a first manufacturing embodiment of the present invention.

In this embodiment, as shown in FIG. 24, (*a*), elements for electrothermal conversion having heat generating elements 2 of hafnium boride, tantalum nitride or the like, are formed, using a manufacturing device as in a semiconductor manufacturing, on an element substrate (silicon wafer) 1, and thereafter, the surface of the element substrate 1 is cleaned for the purpose of improving the adhesiveness or contactness with the photosensitive resin material in the next step. In order to further improve the adhesiveness or contactness, the surface of the element substrate is treated with ultraviolet-radiation-ozone or the like. Then, liquid comprising a silane coupling agent, for example, (A189, available from NIPPON UNICA) diluted by ethyl alcoholic to 1 weight % is applied on the improved surface by spin coating.

Subsequently, the surface is cleaned, and as shown in FIG. 24, (*b*), an ultraviolet radiation photosensitive resin film (dry film Ordyl SY-318 available from Tokyo Ohka Kogyo Co., Ltd.) DF is laminated on the substratel having the thus improved surface.

Then, as shown in FIG. 24, (*c*), a photo-mask PM is placed on the dry film DF, and the portions of the dry film DF which are to remain as the second flow passage wall is illuminated with the ultraviolet radiation through the photo-mask PM. The exposure process was carried out using MPA-600, available from, CANON KABUSHIKI KAISHA), and the exposure amount was approx. 600 mJ/cm$^2$.

Then, as shown in FIG. 24, (*d*), the dry film DF was developed by developing liquid which is a mixed liquid of xylene and butyl Cellosolve acetate (BMRC-3 available from Tokyo Ohka Kogyo Co., Ltd.) to dissolve the unexposed portions, while leaving the exposed and cured portions as the walls for the second liquid flow paths 16. Furthermore, the residuals remaining on the surface of the element substrate 1 is removed by oxygen plasma ashing device (MAS-800 available from Alcan-Tech Co., Inc.) for approx. 90 sec, and it is exposed to ultraviolet radiation for 2 hours at 150° C. with the dose of 100 mJ/cm$_2$ to completely cure the exposed portions.

By this method, the second liquid flow paths can be formed with high accuracy on a plurality of heater boards (element substrates) cut out of the silicon substrate. The silicon substrate is cut into respective heater boards 1 by a dicing machine having a diamond blade of a thickness of 0.05 mm (AWD-4000 available from Tokyo Seimitsu). The separated heater boards 1 are fixed on the aluminum base plate 70 by adhesive material (SE4400 available from Toray), FIG. 19. Then, the printed board 71 connected to the aluminum base plate 70 beforehand is connected with the heater board 1 by aluminum wire (not shown) having a diameter of 0.05 mm.

As shown in FIG. 24, (*e*), a joining member of the grooved member 50 and separation wall 30 were positioned and connected to the heater board 1. More particularly, grooved member having the separation wall 30 and the heater board 1 are positioned, and are engaged and fixed by a confining spring. Thereafter, the ink and bubble generation liquid supply member 80 is fixed on the ink. Then, the gap among the aluminum wire, grooved member 50, the heater boardl and the ink and bubble generation liquid supply member 80 are sealed by a silicone sealant (TSE399, available from Toshiba silicone).

By forming the second liquid flow path through the manufacturing method, accurate flow paths without positional deviation relative to the heaters of the heater board, can be provided. By coupling the grooved member 50 and the separation wall 30 in the prior step, the positional accuracy between the first liquid flow path 14 and the movable member 31 is enhanced.

By the high accuracy manufacturing technique, the ejection stabilization is accomplished, and the printing quality is improved. Since they are formed all together on a wafer, massproduction at low cost is possible.

In this embodiment, the use is made with an ultraviolet radiation curing type dry film for the formation of the second liquid flow path. But, a resin material having an absorption band adjacent particularly 248 nm (outside the ultraviolet range) may be laminated. It is cured, and such portions going to be the second liquid flow paths are directly removed by eximer laser.

FIGS. 26, (*a*)–(*d*), is a schematic sectional view for illustration of a manufacturing method of the liquid ejecting head according to a second embodiment of the present invention.

In this embodiment, as shown in FIG. 26, (*a*), a resist 101 having a thickness of 15 $\mu$m is patterned in the shape of the second liquid flow path on the SUS substrate 100.

Then, as shown in FIG. 25, (*b*), the SUS substrate 20 is coated with 15 $\mu$m thick of nickel layer 102 on the SUS substrate 100 by electroplating. The plating solution used comprised nickel amidosulfate nickel, stress decrease material (zero ohru, available from World Metal Inc.), boric acid, pit prevention material (NP-APS, available from World Metal Inc.) and nickel chloride. As to the electric field upon electro-deposition, an electrode is connected on the anode side, and the SUS substrate 100 already patterned is connected to the cathode, and the temperature of the plating solution is 50° C., and the current temperature is 5 A/cm$^2$.

Then, as shown in FIG. 25, (*c*), the SUS substrate 100 having been subjected to the plating is subjected then to ultrasonic vibration to remove the nickel layer 102 portions from the SUS substrate 100 to provide the second liquid flow path.

On the other hand, the heater board having the elements for the electrothermal conversion, are formed on a silicon wafer by a manufacturing device as used in semiconductor manufacturing. The wafer is cut into heater boards by the dicing machine similarly to the foregoing embodiment. The heater board 1 is mounted to the aluminum base plate 70 already having a printed board 104 mounted thereto, and the printed board 7 and the aluminum wire (not shown) are connected to establish the electrical wiring. On such a heater board 1, the second liquid flow path provided through the foregoing process is fixed, as shown in FIG. 25, (*d*). For this fixing, it may not be so firm if a positional deviation does not occur upon the top plate joining, since the fixing is accomplished by a confining spring with the top plate having the separation wall fixed thereto in the later step, as in the first embodiment.

In this embodiment, for the positioning and fixing, the use was made with an ultraviolet radiation curing type adhesive material (Amicon UV-300, available from GRACE JAPAN), and with an ultraviolet radiation projecting device operated with the exposure amount of 100 mJ/cm$^2$ for approx. 3 sec to complete the fixing.

According to the manufacturing method of this embodiment, the second liquid flow paths can be provided without positional deviation relative to the heat generating elements, and since the flow passage walls are of nickel, it is durable against the alkali property liquid so that the reliability is high.

FIGS. 25, (*a*)–(*d*), is a schematic sectional view for illustrating a manufacturing method of the liquid ejecting head according to a third embodiment of the present invention.

In this embodiment, as shown in FIG. 25, (*a*), the resist 31 is applied on both of the sides of the SUS substrate 100 having a thickness of 15 $\mu$m and having an alignment hole or mark 100*a*. The resist used was PMERP-AR900 available from Tokyo Ohka Kogyo Co., Ltd.

Thereafter, as shown in (*b*), the exposure operation was carried out in alignment with the alignment hole 100*a* of the element substrate 100, using an exposure device (MPA-600 available from CANON KABUSHIKI KAISHA, JAPAN) to remove the portions of the resist 103 which are going to be the second liquid flow path. The exposure amount was 800 mJ/cm$^2$.

Subsequently, as shown in (*c*), the SUS substrate 100 having the patterned resist 103 on both sides, is dipped in etching liquid (aqueous solution of ferric chloride or cuprous chloride) to etch the portions exposed through the resist 103, and the resist is removed.

Then, as shown in (d), similarly to the foregoing embodiment of the manufacturing method, the SUS substrate 100 having been subjected to the etching is positioned and fixed on the heater board1, thus assembling the liquid ejecting head having the second liquid flow paths 4.

According to the manufacturing method of this embodiment, the second liquid flow paths 4 without the positional deviation relative to the heaters can be provided, and since the flow paths are of SUS, the durability against acid and alkali liquid is high, so that high reliability liquid ejecting head is provided.

As described in the foregoing, according to the manufacturing method of this embodiment, by mounting the walls of the second liquid flow path on the element substrate in a prior step, the electrothermal transducers and second liquid flow paths are aligned with each other with high precision. Since a number of second liquid flow paths are formed simultaneously on the substrate before the cutting, massproduction is possible at low cost.

The liquid ejecting head provided through the manufacturing method of this embodiment has the advantage that the second liquid flow paths and the heat generating elements are aligned at high precision, and therefore, the pressure of the bubble generation can be received with high efficiency so that the ejection efficiency is excellent.

<Liquid ejection head cartridge>

The description will be made as to a liquid ejection head cartridge having the liquid ejecting head of the foregoing example.

Figure 27:
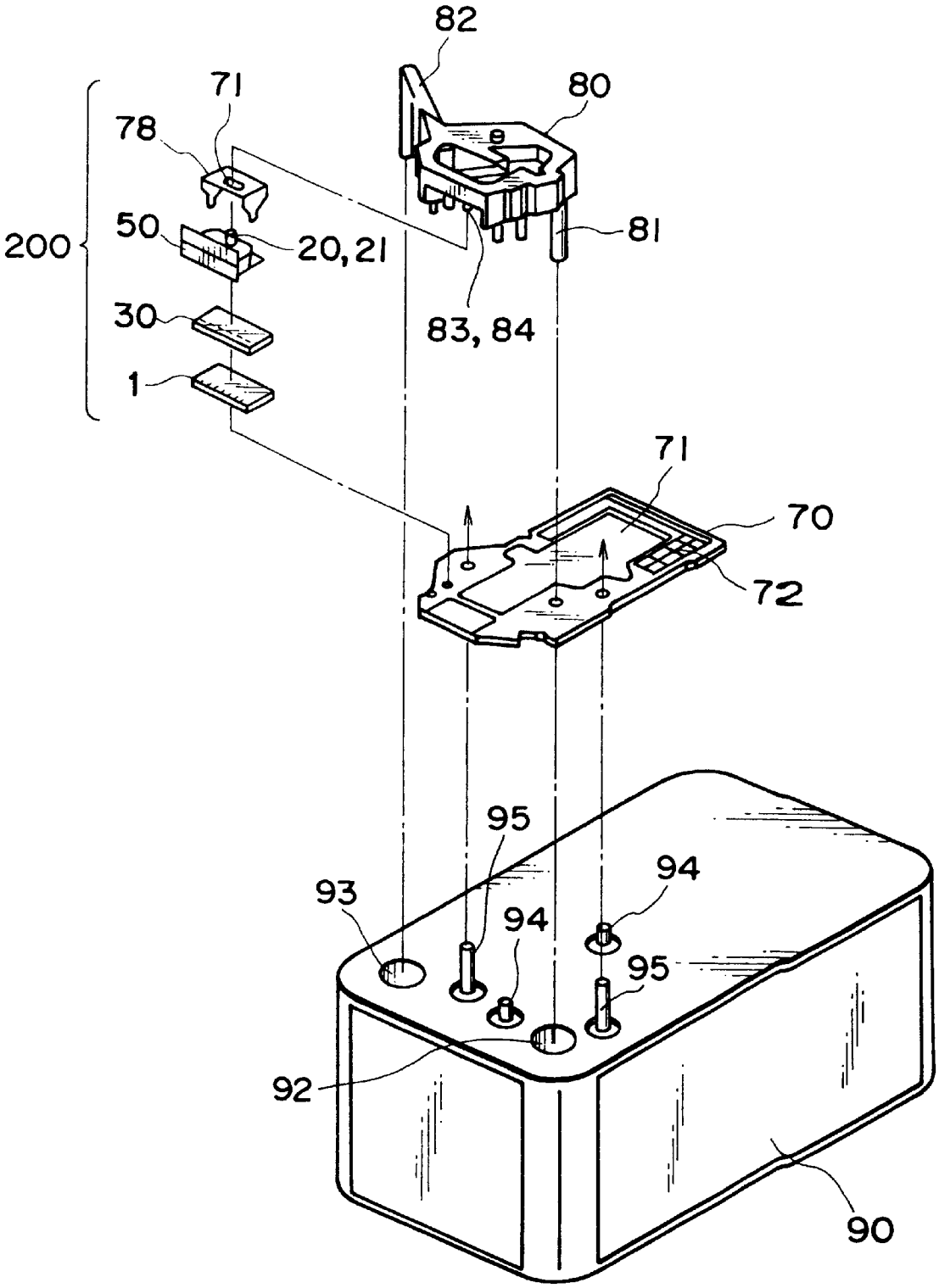
FIG. 27 is an exploded perspective view of a liquid ejection head cartridge of the present invention.

FIG. 27 is a schematic exploded perspective view of a liquid ejection head cartridge including the above-described liquid ejecting head, and the liquid ejection head cartridge comprises generally a liquid ejecting head portion 201 and a liquid container 80.

The liquid ejecting head portion 201 comprises an element substrate 1, a separation wall 30, a grooved member 50, a confining spring 78, liquid supply member 90 and a supporting member 70. The element substrate 1 is provided with a plurality of heat generating resistors for supplying heat to the bubble generation liquid, as described hereinbefore. A bubble generation liquid passage is formed between the element substrate 1 and the separation wall 30 having the movable wall. By the coupling between the separation wall 30 and the grooved top plate 50, an ejection flow path (unshown) for fluid communication with the ejection liquid is formed.

The confining spring 78 functions to urge the grooved member 50 to the element substrate 1, and is effective to properly integrate the element substrate 1, separation wall 30, grooved and the supporting member 70 which will be described hereinafter.

Supporting member 70 functions to support an element substrate 1 or the like, and the supporting member 70 has thereon a circuit board 71, connected to the element substrate 1, for supplying the electric signal thereto, and contact pads 72 for electric signal transfer between the device side when the cartridge is mounted on the apparatus.

The liquid container 90 contains the ejection liquid such as ink to be supplied to the liquid ejecting head and the bubble generation liquid for bubble generation, separately. The outside of the liquid container 90 is provided with a positioning portion 94 for mounting a connecting member for connecting the liquid ejecting head with the liquid container and a fixed shaft 95 for fixing the connection portion. The ejection liquid is supplied to the ejection liquid supply passage 81 of a liquid supply member 80 through a supply passage 84 of the connecting member from the ejection liquid supply passage 92 of the liquid container, and is supplied to a first common liquid chamber through the ejection liquid supply passages 83, 71 and 21 of the members. The bubble generation liquid is similarly supplied to the bubble generation liquid supply passage 82 of the liquid supply member 80 through the supply passage of the connecting member from the supply passage 93 of the liquid container, and is supplied to the second liquid chamber through the bubble generation liquid supply passage 84, 71, 22 of the members. In such a liquid ejection head cartridge, even if the bubble generation liquid and the ejection liquid are different liquids, the liquids are supplied in good order. in the case that the ejection liquid and the bubble generation liquid are the same, the supply path for the bubble generation liquid and the ejection liquid are not necessarily separated.

After the liquid is used up, the liquid containers may be supplied with the respective liquids. To facilitate this supply, the liquid container is desirably provided with a liquid injection port. The liquid ejecting head and the liquid container may be integral with each other or separate from each other.

(liquid ejecting apparatus)

Figure 28:
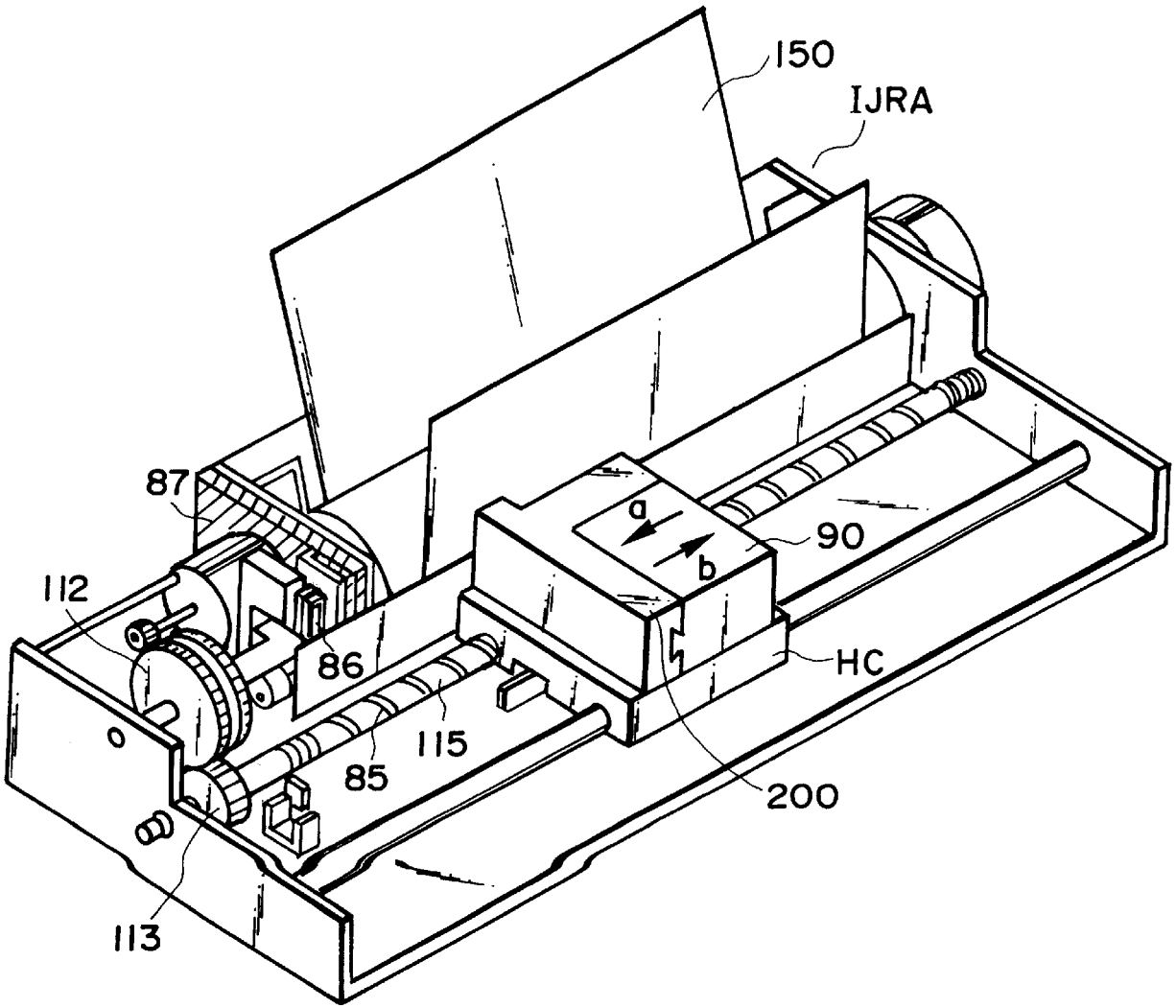
FIG. 28 is a schematic illustration of a liquid ejecting apparatus according to the present invention.

FIG. 28 schematically show a structure of a liquid ejecting apparatus having the above-described liquid ejecting head 201. In this example, the ejection liquid is ink. The apparatus is an ink ejection recording apparatus. the liquid ejecting device comprises a carriage HC to which the head cartridge comprising a liquid container portion 90 and liquid ejecting head portion 201 which are detachably connectable with each other, is mountable. the carriage HC is reciprocable In a direction of width of the recording material 150 such as a recording sheet or the like fed by a recording material transporting means.

When a driving signal is supplied to the liquid ejecting means on the carriage from unshown driving signal supply means, the recording liquid is ejected to the recording material from the liquid ejecting head 201 in response to the signal.

The liquid ejecting apparatus of this embodiment comprises a motor 181 as a driving source for driving the recording material transporting means and the carriage. gears 182, 183 for transmitting the power from the driving source to the carriage, and carriage shaft 185 and so on. By the recording device and the liquid ejecting method, satisfactory print can be provided on various recording materials.

Figure 29:
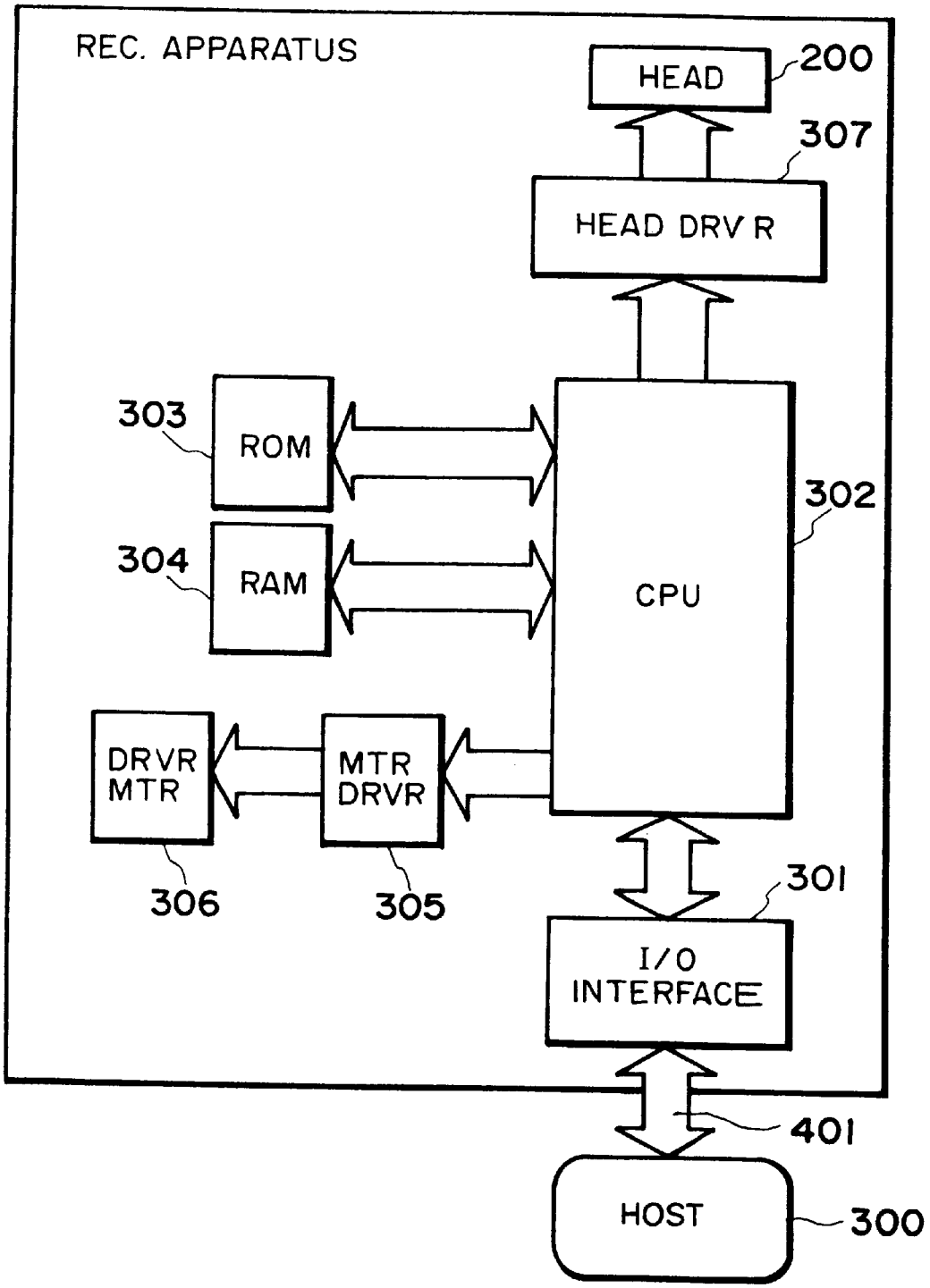
FIG. 29 is a block diagram of a liquid ejecting apparatus of the present invention.

FIG. 29 is a block diagram of the entirety of the device for carrying out ink ejection recording using the liquid ejecting head and the liquid ejecting method of the present invention.

The recording apparatus receives printing data in the form of a control signal from a host computer 300. The printing data is temporarily stored in an input interface 301 of the printing apparatus, and at the same time, is converted into processable data to be inputted to a CPU 302, which doubles as means for supplying a head driving signal. The CPU 302 processes the aforementioned data inputted to the CPU 302, into printable data (image data), by processing them with the use of peripheral units such as RAMs 304 or the like, following control programs stored in an ROM 303.

Further, in order to record the image data onto an appropriate spot on a recording sheet, the CPU 302 generates driving data for driving a driving motor which moves the recording sheet and the recording head in synchronism with the image data. The image data and the motor driving data are transmitted to a head 200 and a driving motor 306 through a head driver 307 and a motor driver 305, respectively, which are controlled with the proper timings for forming an image.

When the ejection power refreshing operation is required as after rest of the head, the CPU302 supplies refreshing operation instructions to the recovering device 310 including the suction recovery device 200. The recovering device 310 having received the ejection power recovery instructions, carries out the series of operations for the recovery of the ejection power of the head on the basis of suction or pressurizing recovery sequence.

As for recording medium, to which liquid such as ink is adhered, and which is usable with a recording apparatus such as the one described above, the following can be listed; various sheets of paper; ORP sheets; plastic material used for forming compact disks, ornamental plates, or the like; fabric; metallic material such as aluminum, copper, or the like; leather material such as cow hide, pig hide, synthetic leather, or the like; lumber material such as solid wood, plywood, and the like; bamboo material; ceramic material such as tile; and material such as sponge which has a three dimensional structure.

The aforementioned recording apparatus includes a printing apparatus for various sheets of paper or OHP sheet, a recording apparatus for plastic material such as plastic material used for forming a compact disk or the like, a recording apparatus for metallic plate or the like, a recording apparatus for leather material, a recording apparatus for lumber, a recording apparatus far ceramic material, a recording apparatus for three dimensional recording medium such as sponge or the like, a textile printing apparatus for recording images on fabric, and the like recording apparatuses.

As for the liquid to be used with these liquid ejection apparatuses, any liquid is usable as long as it is compatible with the employed recording medium, and the recording conditions.

Next, an exemplary ink jet recording system will be described, which records images on recording medium, using, as the recording head, the liquid ejection head in accordance with the present invention.

Figure 30:
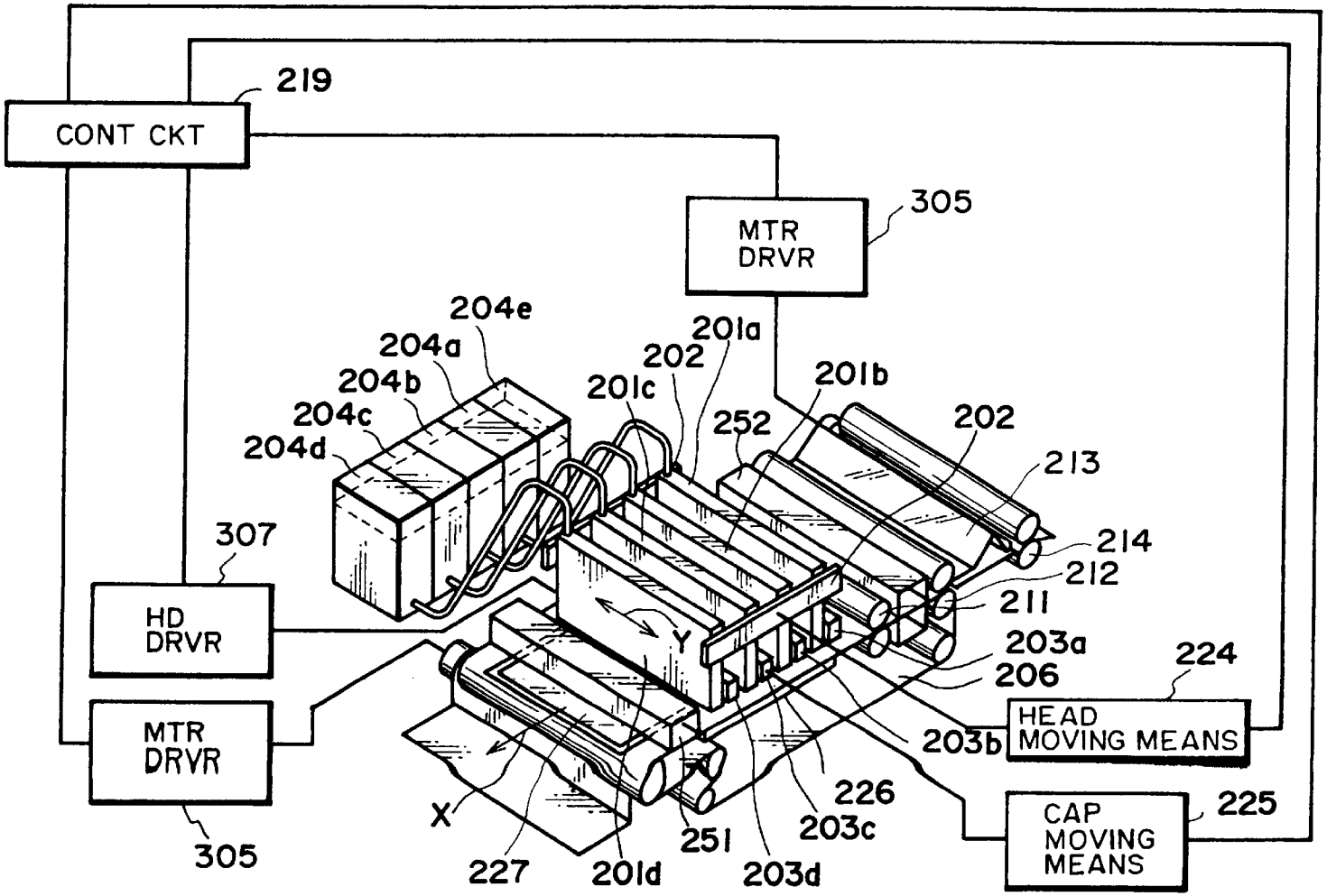
FIG. 30 illustrates a system structure of a liquid ejecting apparatus according to the present invention.

FIG. 30 is a schematic perspective view of an ink jet recording system employing the aforementioned liquid ejection head 201 in accordance with the present invention, and depicts its general structure. The liquid ejection head in this embodiment is a full-line type head, which comprises plural ejection orifices aligned with a density of 360 dpi so as to cover the entire recordable range of the recording medium 150. It comprises four heads, which are correspondent to four colors; yellow (Y), magenta (M), cyan (C) and black (Bk). These four heads are fixedly supported by a holder 1202, in parallel to each other and with predetermined intervals.

These heads are driven in response to the signals supplied from a head driver 307, which constitutes means for supplying a driving signal to each head.

Each of the four color inks (Y, M, C and Bk) is supplied to a correspondent head from an ink container 1204*a*, 1204*b*, 1205*c* or 1204*d*. A reference numeral 1204*e* designates a bubble generation liquid container from which the bubble generation liquid is delivered to each head.

Between the container and the each head, the tube is provided with pressurizing recovering device 311*e*, 311*a*, 311*b*, 311*c*, or 311*d*, as shown in the Figure. The driving means for the pressurizing recovering device is a pressurizing pump, and when the recovery for the election power of the head is necessary, the CPU302 shown in FIG. 29 produces pressurizing recovery instructions, and the series of operations for the recovery of the election power of the head is carried out on the basis of the predetermined pressurizing recovery sequence.

Below each head, there is a head cap 203*a*–203*d* having ink absorption member such as sponge, which covers the ejection outlets of each head when the recording operation is not effected to protect the head.

Designated by reference numeral 206 is a conveyer belt constituting feeding means for feeding a recording material as has been described. The conveyer belt 206 extends along a predetermined path using various rollers, and is driven by a driving roller connected with the motor driver 305.

The ink jet recording system in this embodiment comprises a pre-printing processing apparatus 1251 and a post-printing processing apparatus 1252, which are disposed on the upstream and downstream sides, respectively, of the ink jet recording apparatus, along the recording medium conveyance path. These processing apparatuses 1251 and 1252 process the recording medium in various manners before or after recording is made, respectively.

The pre-printing process and the postprinting process vary depending on the type of recording medium, or the type of ink. For example, when recording medium composed of metallic material, plastic material, ceramic material or the like is employed, the recording medium is exposed to ultra-violet rays and ozone before printing, activating its surface.

In a recording material tending to acquire electric charge, such as plastic resin material, the dust tends to deposit on the surface by static electricity. The dust may impede the desired recording. In such a case, the use is made with ionizer to remove the static charge of the recording material, thus removing the dust from the recording material. When a textile is a recording material, from the standpoint of feathering prevention and improvement of fixing or the like, a pre-processing may be effected wherein alkali property substance, water soluble property substance, composition polymeric, water soluble property metal salt, urea, or thiourea is applied to the textile. The pre-processing is not limited to this, and it may be the one to provide the recording material with the proper temperature.

On the other hand, the post-processing is a process for imparting, to the recording material having received the ink, a heat treatment, ultraviolet radiation projection to promote the fixing of the ink, or a cleaning for removing the process material used for the pre-treatment and remaining because of no reaction.

In this embodiment, the head is a full line head, but the present invention is of course applicable to a serial type wherein the head is moved along a width of the recording material.

<Head kit>

Figure 31:
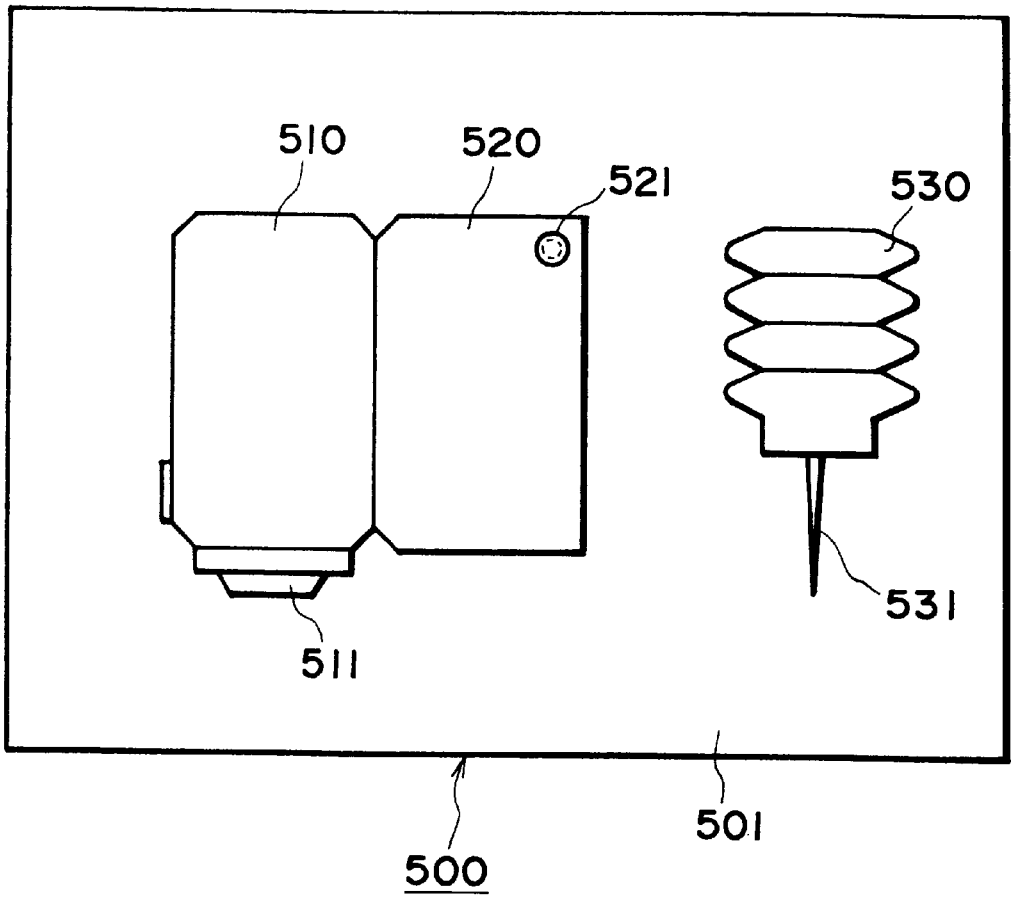
FIG. 31 is a schematic view of a head kit.
Figure 32A:
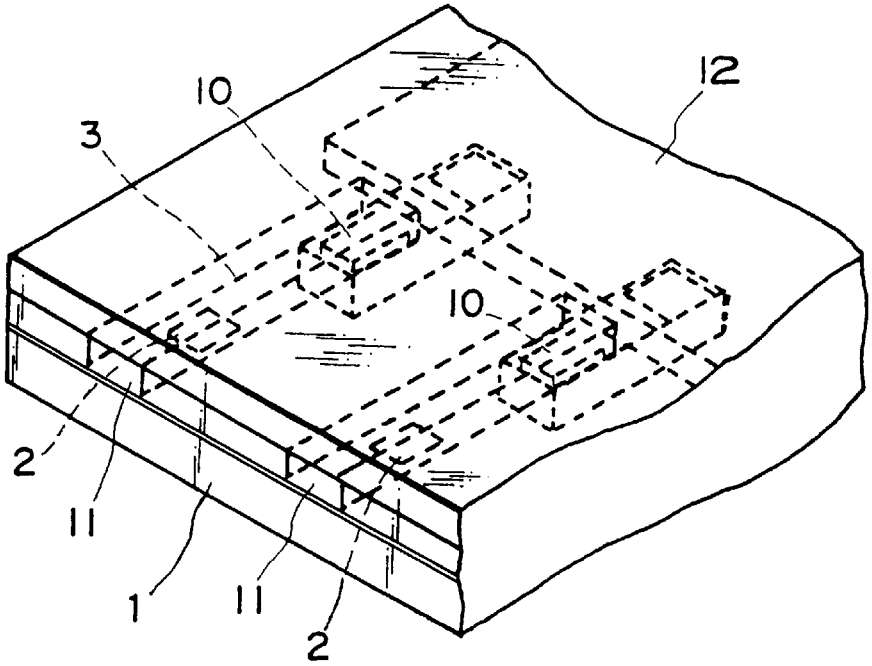
FIG. 32(a) PRIOR ART
FIGS. 32(*a*) and 32(*b*) are illustrations of a liquid flow passage structure of a conventional liquid ejecting head.
Figure 32B:
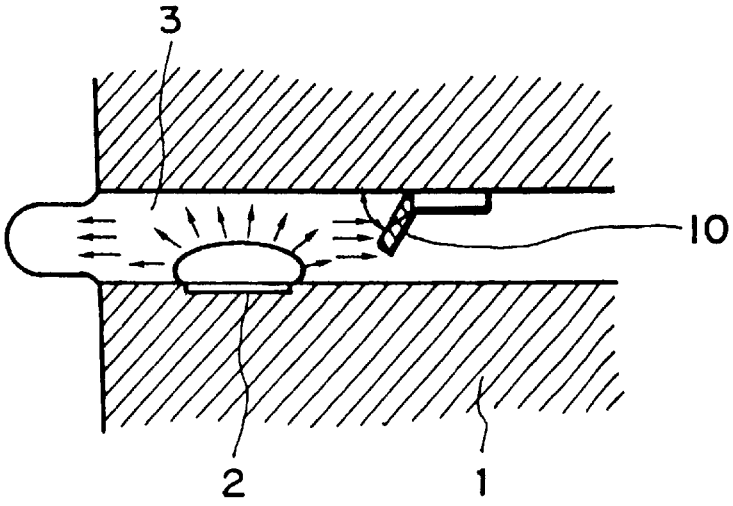
FIG. 32(b) PRIOR ART

A head kit usable for the liquid ejecting head of the present invention will be described. FIG. 31 is a schematic view of a head kit according to an embodiment of the present invention. It A comprises a head 510 according to the present invention having an ink ejection portion 511 for ejecting the ink, an ink container 520 (liquid container) separable or non-separable relative to the head, ink filling means for containing the ink for filling into the ink container, and a kit container 501 containing all of them.

When the ink is used up, a part of an inserting portion (injection needle or the like) 531 of the ink filling means is inserted into an air vent 521 of the ink container or into a hole or the like formed in a wall of the ink container or in a connecting portion relative to the head, and the ink in the ink filling means is filled into the ink container.

Thus, the liquid ejecting head of the present invention, ink container, ink filling means or the like, are accommodated in the kit container, So that when the ink is used up, the ink can be filled into the ink container without difficulty.

In the head kit of this embodiment, the ink filling means is contained, but the head kit may not have the ink filling means, and instead, the kit container 510 may contain a full ink container detachably mountable to the head as well as the head.

In FIG. 31, there is shown only ink filling means for filling the ink to the ink container, but the kit container may also contain bubble generation liquid filling means for filling the bubble generation liquid into the bubble generation liquid container as well as the ink container.

As described in the foregoing, according to the first aspect of the present invention using the liquid ejecting system with the movable member, the heat generating element for generating the bubble is driven by a driving pulse divided into a prior first pulse and a later second pulse, and the pulse width of the first pulse is controlled so that pre-heating is effected to such an extent that liquid is not ejected by the first pulse. Therefore, the condition under which the pressure of the liquid is efficiently caused to act on the movable member, is established, thus further stabilizing the ejection amount and the ejection speed and thus improving the controllability of the liquid ejection.

According to a second aspect of the present invention using the liquid ejecting System with the movable member, the pulse width of the driving pulse for the heat generating element is controlled on the basis of the state quantity such as a temperature of the liquid influential to the ejection amount of the liquid, by which the ejection amount is stabilized, and the controllability of the liquid election amount can be controlled.

Figure 58:
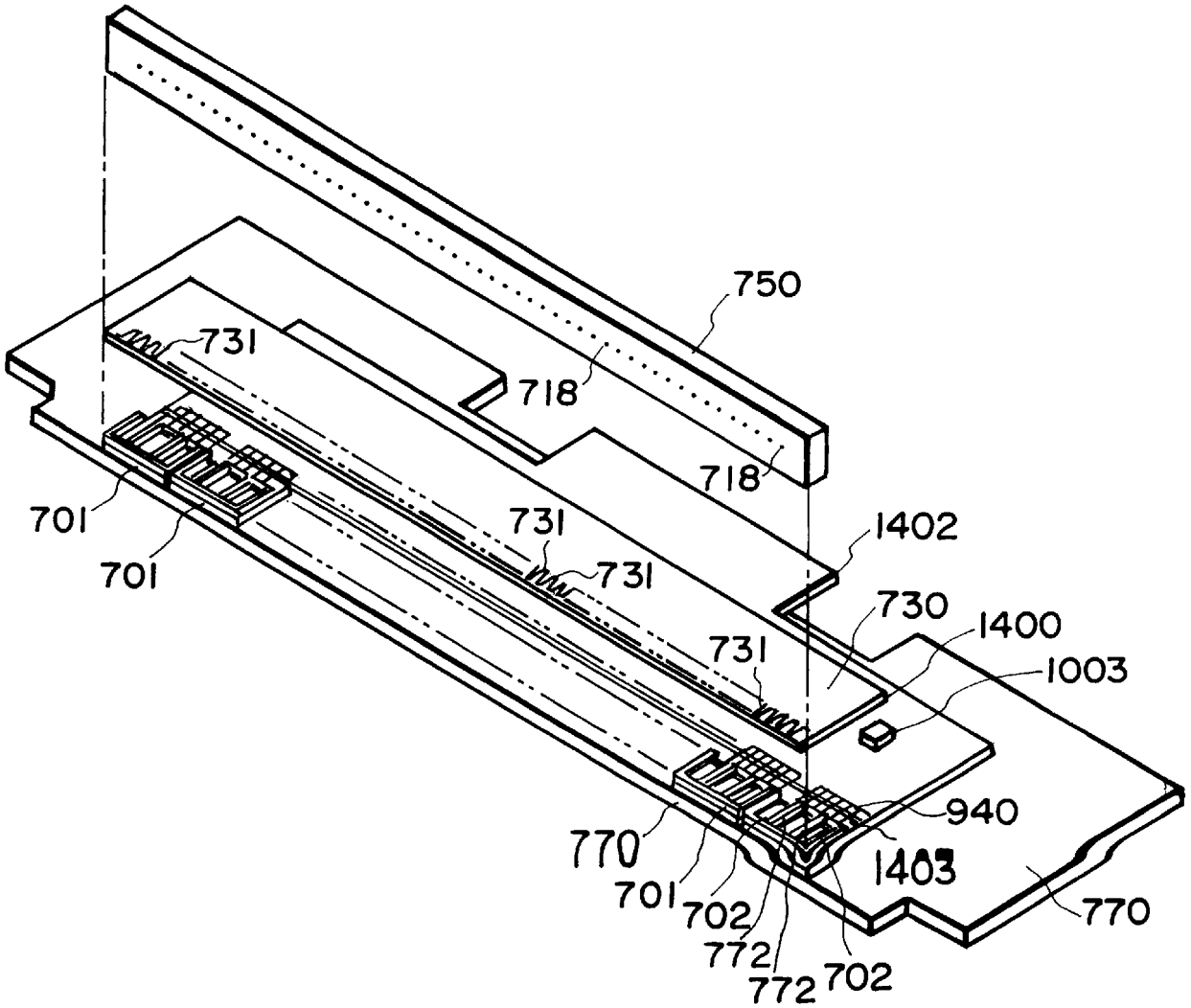
FIG. 58 is an exploded perspective view of an ink jet head according to and embodiment of the present invention.

FIG. 58 is an exploded perspective view of a schematic structure of an ink jet head according to an embodiment of the present invention.

In FIG. 58, each of the heater board (element substrate) 701 has 128 electrothermal transducer elements 702 (heat generating elements) arranged in a line at the density of 360DPI. The heater board 701 is also provided with signal pads for receiving external electric signals to drive the heat generating elements 702 at the given timing, and with a pad 1403 including electric power supply pads for supplying the electric power for the driving the heat generating elements 702, or the like. Above each heater board 701, there are provided a partition 772 for forming the second liquid flow path which will be described hereinafter, and a separation wall 730 connecting to the partition. The separation wall 730 is provided with a movable member 731 corresponding to the heat generating element 702 by which the bubble generation pressure generated in the second liquid flow path is efficiently transmitted to the first liquid flow path provided with the ink ejection outlet. Eleven heater boards 1 are provided and arranged in the direction of the arrangement of the heat generating elements 702 on the base plate 770 of aluminum as a supporting substrate. Thus, the ink jet head of this embodiment has 1408 heat generating element.

To the base plate 770, a wiring substrate 1400 is bonded, similarly to the heater board 1. The pads 1403 on the heater board 1 and the signal and electric power supply pads 1401 on the wiring substrate 1400 are arranged in a predetermined positional relation. The wiring substrate 1400 is provided with connectors 1402 for supplying the external recording signals and the driving electric power.

A top plate 750 has an integral orifice plate having formed ink ejection outlets 718, and is provided with grooves for constituting the second liquid flow paths, as will be described hereinafter. The top plate 750 is connected such that predetermined positional relation is established relative to the movable member 731 of the separation wall 730. As for the connecting method, use may be made with the mechanical confinement with spring or the like, or with the adhesive material or with the combination thereof.

The description will be made as to the ejection amount correction (bit correction) for each of the ejection outlets in the ink jet head described above.

The bit correction in this embodiment, modulates the pulse width or the like of the driving pulse (driving signal) to be applied to the heat generating element. Namely, the driving pulse used in this embodiment comprises a pre-pulse for generating thermal energy not enough for bubble generation, and a main pulse applied with a resting interval after the application of the pre-pulse. In this embodiment, the pulse width or the like of the pre-pulse modulates the resting interval or rest period to change the ejection amount. By this, the size of the dot formed on the recording material can be changed, so that sizes of the dot printed by the respective ejection outlets can be made uniform.

The description will be made as to application of the bit correction to the ink jet head in this embodiment, as compared with the application thereof to a conventional so-called bubble jet system.

Figure 59:
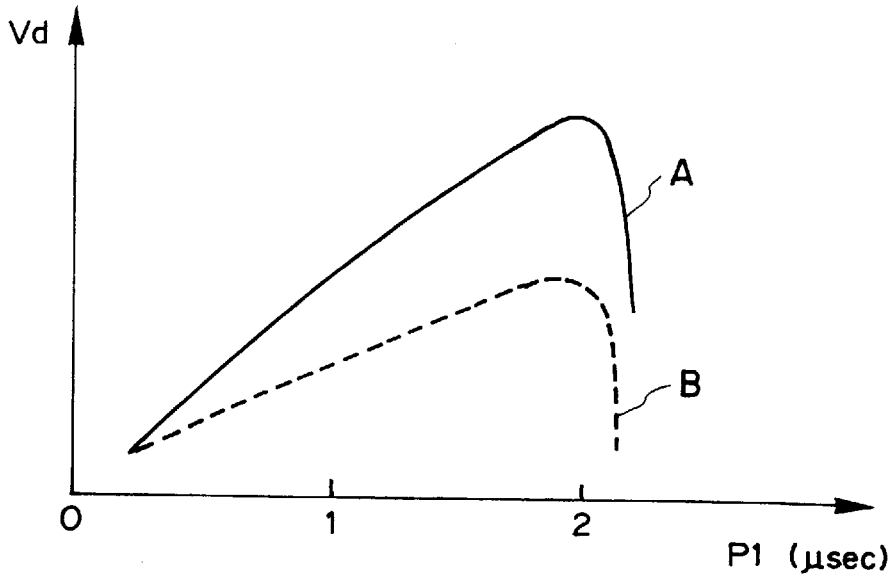
FIG. 59 is a diagram of a change in an ejection amount when a pre-pulse modulation using double pulse is used in accordance with the present invention, as compared with a conventional head.
Figure 61:
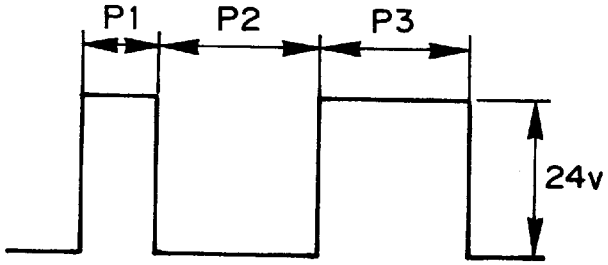
FIG. 61 schematically shows a waveform of the double pulse.

FIG. 59 shows ejection amount change A in a head according to this example when the pulse width P1 of the pre-pulse of the driving pulse (FIG. 61) is modulated, and shows ejection amount change B in a conventional head.

Figure 60:
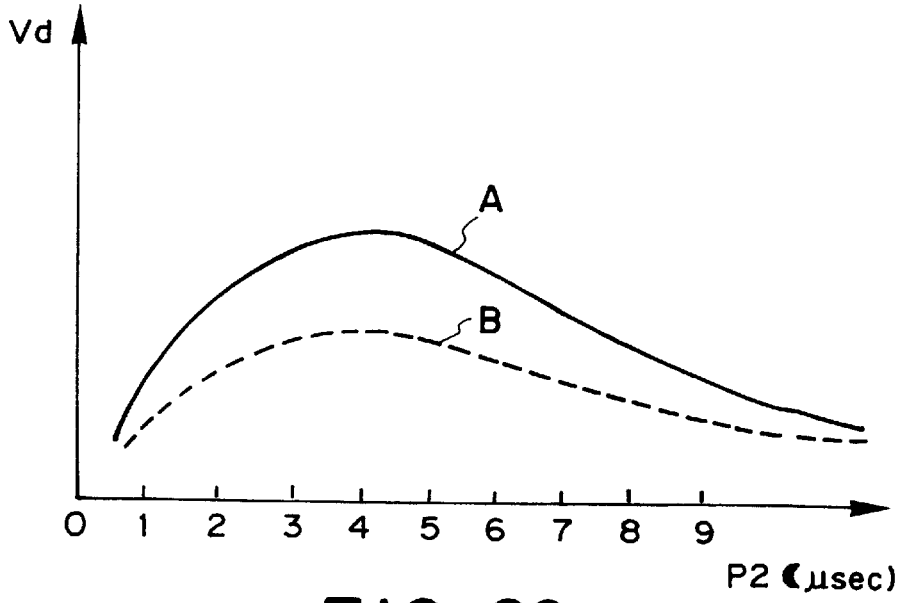
FIG. 60 is a similar diagram showing a change in the ejection amount when the rest period in the double pulse is modulation.

FIG. 60 shows ejection amount change A in a head according to this example when the rest period P2 is modulated (FIG. 61), and also shows ejection amount change B in a conventional head.

As will be understood from FIG. 59 and FIG. 60, in both of the head of this example and the conventional head, the maximum ejection amount is provided by substantially the same pre-pulse width P1 (approx. 2 μsec) and by the same rest period P2 (approx. 4 μsec), irrespective of whether the pre-pulse width P1 or the rest period P2 is modulated. However, it should be noted that ejection amount per se including the maximum ejection amount is larger in this example, and the change thereof is larger in this embodiment. As a result, when the bit correction is used for the head of this example, the larger correction width can be accomplished. In other words, even in a head which involves a relatively wide density non-uniformity, the bit correction of this embodiment can be advantageously used.

The reason for this is considered as follows.

In a conventional head, the growth, toward upstream of the liquid flow path, of the bubble generated by driving the heat generating element, is not limited by the movable member, so that smaller force is applied to the upstream ink, whereas in the head of the embodiments of the present invention, the force generated by the bubble generation is mostly prevented from escaping toward upstream by the provision of the movable member. In the conventional head, even if the supplied energy for generating the bubble is increased to increase the generated bubble volume, the escape of the bubble generation pressure toward upstream also increases correspondingly, with the result that increase of the generated bubble volume resulting from the increase of the supplied energy is not directly reflected as the increase of the ejection amount. In the case of the head of the present invention, however, the escape toward upstream can be properly suppressed, and therefore, the ejection amount can be changed more in accordance with the increase of the generated bubble volume resulting from the increase of the supplied energy.

With the head structure in the embodiments, the behavior of the ink ejection is less influenced by the structure or the like of the structure upstream of the heat generating element for the same reason, so that ejection amount or the like is determined mainly by the accuracy of the structure downstream (ejection outlet side) of the heat generating element. Thus, if the accuracy is high enough in the downstream (mainly, ejection outlet) side, the variation in the ejection amount due to the manufacturing error can be reduced even if a long size head is manufactured. According to these embodiment, such advantages are synergetically combined with the advantage of the bit correction to effectively reduce the density non-uniformity.

Figure 62:
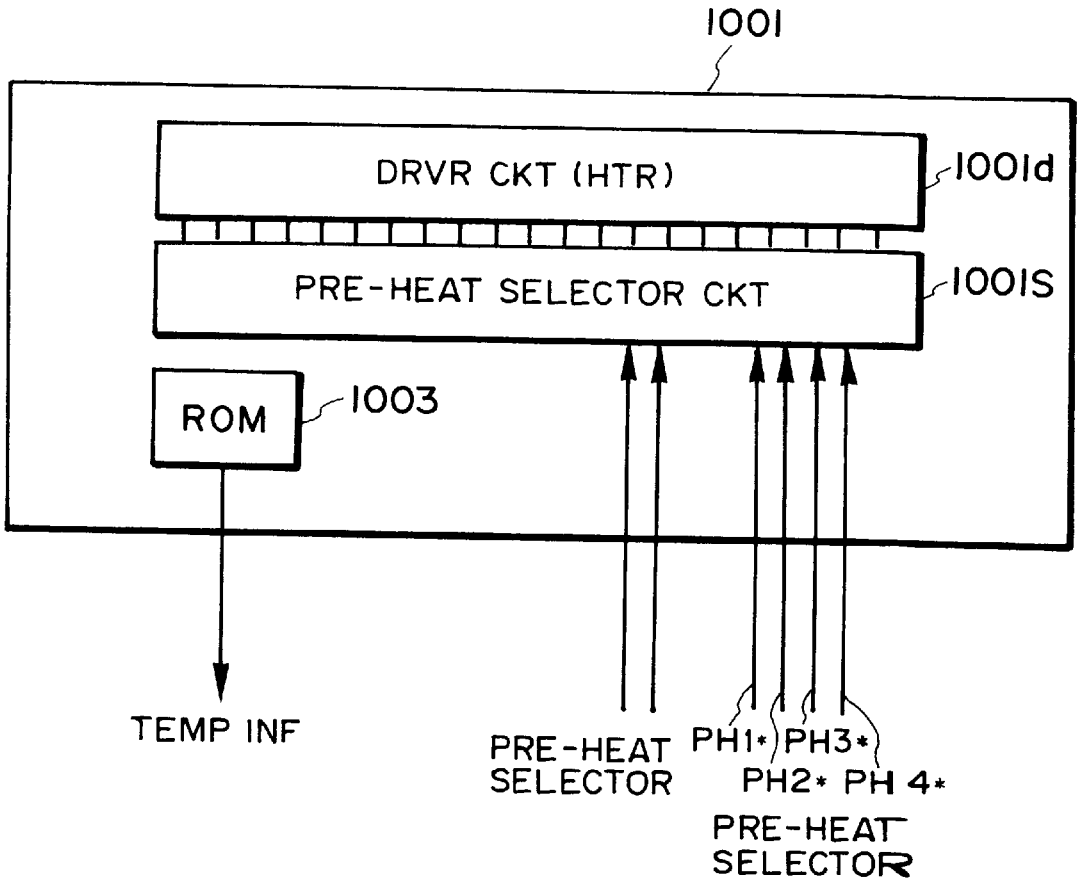
FIG. 62 is a block diagram of a structure for bit correction using a pulse width modulation for a pre-heating pulse according to an embodiment of the present invention.

FIG. 62 shows a pre-heat selecting circuit or the like formed on the heater board 1001 for the bit correction in the ink jet device according to an embodiment of the present invention. The structure shown in FIG. 62 is provided for each of the eleven heater boards (FIG. 58) of an ink jet head.

As shown in FIG. 62, ejection amount information for each ejection outlet stored in ROM1003 is read out by a CPU (unshown) of the main assembly of the device at a predetermined timing upon the record operation start or the like. The CPU effects it control operation so as to supply the pre-heat selection signal in accordance with the ejection amount information for each ejection outlet to the pre-heat selecting circuit OOIS. In this example, the election amount is modulated by controlling the pulse width of the pre-heating pulse, and therefore, one of four pre-heating widths corresponding to the four stepwise ejection amounts. Four types of pre-heat signal PH1* to PH4* are supplyable to the pre-heat selecting circuit 1001S.

Figure 63:
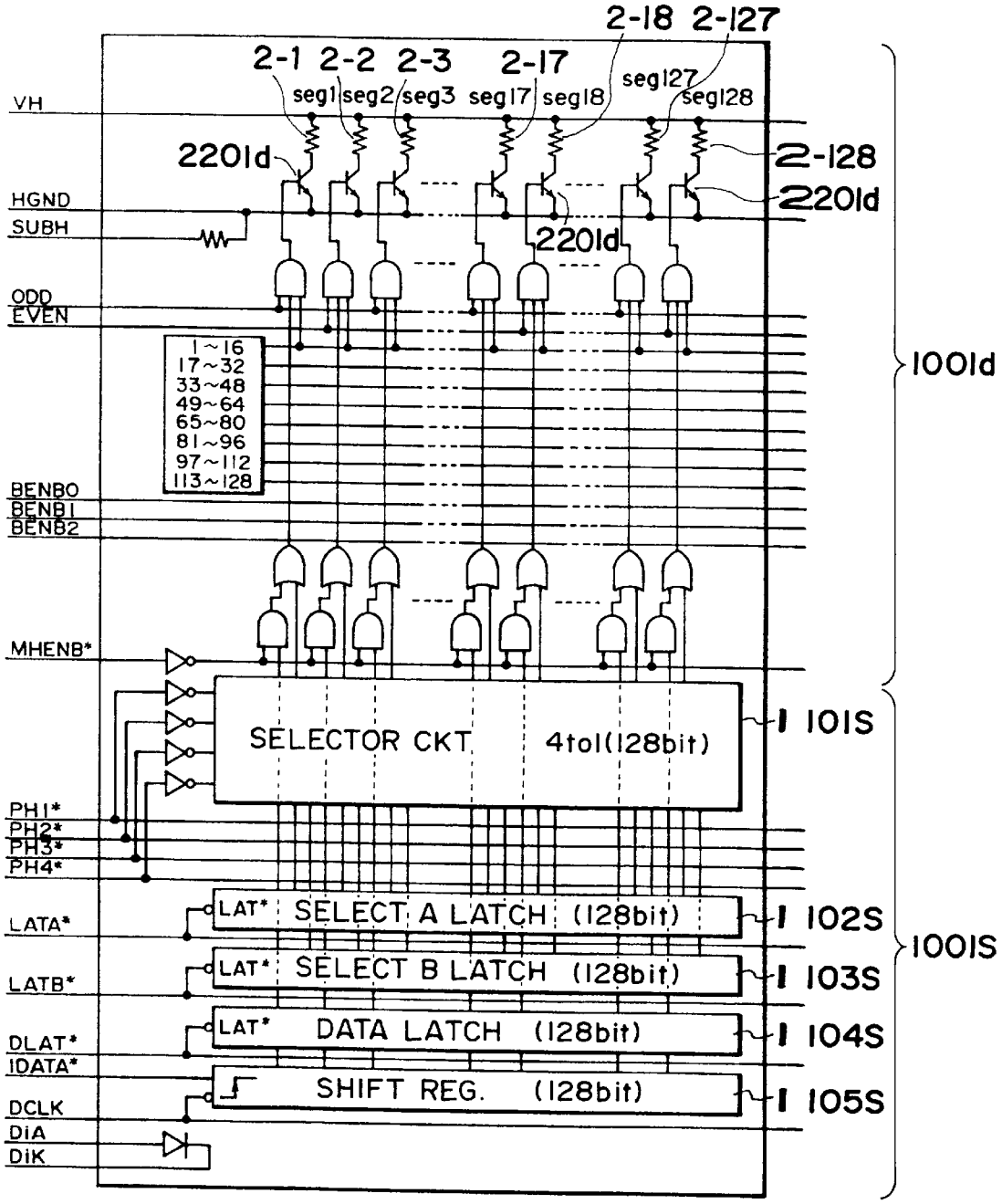
FIG. 63 is a circuit diagram of a detail of a pre-heat selecting circuit and a driver circuit of FIG. 62.

FIG. 63 shows a circuit diagram illustrating a detailed structure of a pre-heat selecting circuit 1001S and a driver circuit 1001*d*.

The driver circuit 1001*d* includes switching transistors 2201*d* for driving the heat generating elements 2-1 to 2-128, respectively, and AND element and OR element for supplying driving signals in accordance with the control signals. The AND elements are supplied with block enabling signal BENB0 to BENB2 for block divided driving (each block includes 16 heat generating elements), enabling signal ODD, EVEN for discretely driving the odd number heat generating elements and even number heat generating elements, and main heating enabling signal MHENB* for applying the main pulses to the heat generating elements.

The shift register 1105S in the pre-heat selecting circuit 1001S is supplied with pre-heat selection signal in the form of a set of 1 or 0 in accordance with the ejection amount information for each ejection outlet in series, and they are latched in a selection A latch and a select B latch in response to a latching signals LATA* and LATB*, respectively. The selecting circuit 1101S selects one of four pre-heat signal PH1* to PH4* and output the selected one in accordance with the combination of the pre-heat selection signal for each heat generating element. The selection is possible since the four kinds of combinations of the selection signal "1" and "0" are related to the pre-heat signals PH1* to PH4*, respectively. In this embodiment, the driving signal is selected for each heat generating element, but this is not limiting, and the driving signal may be selected for each plurality of the heat generating elements.

According to the structure of the driver circuit and the selecting circuit of FIG. 63, the pre-heating pulse is applied to the heat generating element independently from the ejection data, namely, irrespective of the ejection or non-ejection. Thus, occurrence of large temperature difference among the liquid flow path, can be avoided.

With the foregoing structure, a long pre-pulse having a large pulse width is applied to the heat generating element for the ejection outlet having a property of small ejection amount, so that ejection amounts of the ejection outlets are made uniform.

In this example, the information of the ejection amount of the ejection outlets, are read out of a ROM. It is a possible alternative that density non-uniformity is measured by servicemen or service women for each printer, and the information of the ejection amounts may be rewritten, and in this case, RAM is used.

As described in the foregoing, synergatic effects are provided by the combination with the liquid ejection system using the movable member, so that liquid adjacent the ejection outlet can be efficiently ejected, and therefore, the ejection efficiency is improved.

Thus, the non-uniformity in the ejection amount of the head due to the manufacturing error can be reduced by selectinig the driving signal for each heat generating element or for each plurality of heat generating elements, and in addition, even if the head per se becomes involving a non-uniformity in the ejection amount, the ejection amounts can be corrected in a wider range, and therefore, the density non-uniformity which was unable to be corrected heretofore, can be corrected. Thus, the proper liquid ejection is accomplished.

According to the present invention, even if the printer is left for a long term under the low temperature or low humidity conditions, the ejection failure can be avoided. Even if the election failure occurred, the normal state would be quickly restored through small scale refreshing process such as preliminary ejection or suction recovery. According to the present invention, the time required for the recovery can be reduced, and the loss of the liquid by the recovery operation is reduced, so that running cost can be reduced.

According to the present invention, the refilling property is improved, and therefore, the responsivity during the continuous ejection and the stabilized growth of the bubble, and the stabilization of the droplet, are accomplished. Thus, high speed and high image quality recording is accomplished.

With the head of the two-flow-path structure, the latitude of selection of the ejection liquid is wide since the bubble generation liquid may be the one with which the bubble generation is easy and with which the deposited material (burnt deposit or the like) is easily produced. Therefore, the liquids which have not been easily ejected through the conventional bubble jet ejecting method, such as high viscosity liquid with which bubble generation is difficult or a liquid which tends to produce burned deposit on the heater, can be ejected in good order.

While the invention has been described with reference to the structures disclosed herein, it is not confined to the details set forth and this application is intended to cover such modifications or changes as may come within the purposes of the improvements or the scope of the following claims.

What is claimed is:

1. A liquid ejection method, comprising the steps of:

supplying liquid along a heat generating element disposed along a flow path from upstream of the heat generating element; and applying heat generated by the heat generating element to the thus supplied liquid to generate a bubble, thus moving a free end of a movable member having the free end adjacent to an ejection outlet side by pressure produced by the generation of the bubble, said movable member being disposed faced to said heat generating element;

supplying, to a heat generating element for applying thermal energy to said bubble generating region, a driving pulse divided into a first pulse and an adjacent second pulse with interval time therebetween;

pre-heating the liquid by said first pulse to an extent insufficient to eject the liquid through said ejection outlet;

generating a bubble by heating the liquid with said second pulse to eject the liquid through said ejection outlet;

ejecting the liquid in an amount which is determined by controlling a degree of pre-heating of the liquid by changing at least one of a width of said first pulse or the interval time, wherein the change rate of the ejection amount of the liquid increases non-linearly with an increase of the width of said first pulse or an increase of the interval time period.

2. A method according to claim 1, wherein the pulse width or said interval time are changed in accordance with a temperature of said liquid ejecting head.

3. A method according to claim 1, wherein said bubble is formed by film boiling of the liquid.

4. A liquid ejection method, comprising:

preparing a head including a first liquid flow path in fluid communication with a liquid ejection outlet, a second liquid flow path having a bubble generation region and a movable member disposed between said first liquid flow path and said bubble generation region and having a free and adjacent the ejection outlet side;

generating a bubble in said bubble generation region to displace the free end of the movable member into said first liquid flow path by pressure produced by the generation of the bubble, thus guiding the pressure toward the ejection outlet of said first liquid flow path by the movement of the movable member to eject the liquid;

supplying, to a heat generating element for applying thermal energy to said bubble generating region, a driving pulse divided into a first pulse and an adjacent second pulse with interval time therebetween;

pre-heating the liquid by said first pulse to an extent not enough to eject the liquid through said ejection outlet;

generating a bubble by heating the liquid by said second pulse to eject the liquid through said ejection outlet;

ejecting the liquid in an amount which is determined by controlling a degree of pre-heating of the liquid by changing at least one of a width of said first pulse or the interval time, wherein the change rate of the election amount of the liquid increases non-linearly with an increase of the width of said first pulse or an increase of the interval time period.

5. A method according to claim 4, wherein the pulse width or said interval time are changed in accordance with a temperature of said liquid ejecting head.

6. A method according to claim 4, wherein the liquid supplied to said first liquid flow path is the same as the liquid supplied to the second liquid flow path.

7. A method according to claim 4, wherein the liquid supplied to said first liquid flow path is different from the liquid supplied to the second liquid flow path.

8. A method according to claim 4, wherein the liquid supplied to the second liquid flow path has at least one of lower viscosity, higher bubble forming property and higher thermal stability than the liquid supplied to the first liquid flow path.

9. A method according to claim 4, wherein said bubble is formed by film boiling of the liquid.

10. A liquid ejecting apparatus comprising:

a liquid ejection head including an ejection outlet for ejecting the liquid; a heat generating element for generating the bubble in the liquid by applying heat to said liquid; a liquid flow path having a supply passage for supplying the liquid to said heat generating element from upstream thereof; and a movable member disposed faced to said heat generating element and having a free end adjacent said ejection outlet, the free end of said movable member being moved by pressure produced by the generation of the bubble to guide the pressure toward said ejection outlet;

means for supplying, to a heat generating element for applying thermal energy to said bubble generating region, a driving pulse divided into a first pulse and an adjacent second pulse with interval time therebetween, thus pre-heating the liquid by said first pulse to an extent not enough to eject the liquid through said ejection outlet, and thus generating a bubble by heating the liquid by said second pulse to eject the liquid through said ejection outlet;

control means for controlling the ejection amount of the liquid by controlling a degree of pre-heating of the liquid by changing at least one of a pulse width of said first pulse or the interval time, wherein the change rate of the election amount of the liquid increases non-linearly with an increase of the width of said first pulse or an increase of the interval time period.

11. An apparatus according to claim 10, further comprising temperature detecting means for detecting a temperature of said liquid ejecting head; wherein said control means controls at least one of a width of said first pulse or said interval time in accordance with an output of said temperature detecting means.

12. An apparatus according to claim 10, wherein said bubble is formed by film boiling of the liquid.

13. A liquid ejection apparatus, comprising:

a liquid ejection head including a first liquid flow path in fluid communication with a liquid ejection outlet, a second liquid flow path having a bubble generation region and a movable member disposed between said first liquid flow path and said bubble generation region and having a free and adjacent the ejection outlet side;

wherein a bubble is generated in said bubble generation region to displace the free end of the movable member into said first liquid flow path by pressure produced by the generation of the bubble, thus guiding the pressure toward the ejection outlet of said first liquid flow path by the movement of the movable member to eject the liquid;

means for supplying, to a heat generating element for applying thermal energy to said bubble generating region, a driving pulse divided into a first pulse and an adjacent second pulse with interval time therebetween, thus pre-heating the liquid by said first pulse to an extent not enough to eject the liquid through said ejection outlet, and thus generating a bubble by heating the liquid by said second pulse to eject the liquid through said ejection outlet;

control means for controlling the ejection amount of the liquid by controlling a degree of pre-heating of the liquid by changing at least one of a pulse width of said first pulse or the interval time, wherein the change rate of the election amount of the liquid increases non-linearly with an increase of the width of said first pulse or an increase of the interval time period.

14. An apparatus according to claim 13, further comprising temperature detecting means for detecting a temperature of said liquid ejecting head; wherein said control means controls at least one of a width of said first pulse or said interval time in accordance with an output of said temperature detecting means.

15. An apparatus according to claim 13, wherein the liquid supplied to said first liquid flow path is the same as the liquid supplied to the second liquid flow path.

16. An apparatus according to claim 13, wherein the liquid supplied to said first liquid flow path is different from the liquid supplied to the second liquid flow path.

17. An apparatus according to claim 13, wherein the liquid supplied to the second liquid flow path has at least one of lower viscosity, higher bubble forming property and higher thermal stability than the liquid supplied to the first liquid flow path.

18. An apparatus according to claim 13, wherein said bubble is formed by film boiling of the liquid.

19. A liquid ejection method, comprising:

preparing a liquid ejection head including an ejection outlet for ejecting the liquid; a heat generating element for generating the bubble in the liquid by applying heat to said liquid; a liquid flow path having a supply passage for supplying the liquid to said heat generating element from upstream thereof; and a movable member disposed faced to said heat generating element and having a free end adjacent said ejection outlet, the free end of said movable member being moved by pressure produced by the generation of the bubble to guide the pressure toward said ejection outlet; and detecting means for detecting a state quantity of the liquid influential to an ejection amount of the liquid;

ejecting the liquid in an amount which is determined by controlling a pulse width of the driving pulse for said heat generating element in accordance with an output of said detecting means, wherein the change rate of the ejection amount of the liquid increases non-linearly with an increase of the width of the driving pulse.

20. A method according to claim 19, further comprising:

supplying, to said heat generating element, a driving pulse divided into first pulse and an adjacent second pulse;

pre-heating the liquid by said first pulse to an extent not enough to eject the liquid through said ejection outlet;

heating the liquid so as to eject it through said ejection outlet by said second pulse;

wherein in said control step, at least one of a pulse width of the first pulse, a pulse width of the second pulse and an interval time between the first and second pulses.

21. A method according to claim 19, wherein the pulse width of the driving pulse is controlled in accordance with a change at least one of a viscosity of the liquid and a surface tension thereof.

22. A liquid ejection method, comprising:

providing a liquid ejection head including a first liquid flow path in fluid communication with a liquid ejection outlet, a second-liquid flow path having a bubble generation region and a movable member disposed between said first liquid flow path and said bubble generation region and having a free end adjacent the ejection outlet side; wherein a bubble is generated in said bubble generation region to displace the free end of the movable member into said first liquid flow path by pressure produced by the generation of the bubble, thus guiding the pressure toward the ejection outlet of said first liquid flow path by the movement of the movable member to eject the liquid; a heat generating element for applying thermal energy to said bubble generation region upon supply thereto of a driving pulse; detecting means for detecting a state quantity of the liquid influential to an ejection amount of the liquid;

ejecting the liquid in an amount which is determined by controlling a pulse width of the driving pulse for said heat generating element in accordance with an output of said detecting means, wherein the change rate of the ejection amount of the liquid increases non-linearly with an increase of the width of the driving pulse.

23. A method according to claim 22, further comprising:

supplying, to said heat generating element, a driving pulse divided into first pulse and an adjacent second pulse;

pre-heating the liquid by said first pulse to an extent not enough to eject the liquid through said ejection outlet;

heating the liquid so as to eject it through said ejection outlet by said second pulse;

wherein in said control step, at least one of a pulse width of the first pulse, a pulse width of the second pulse and an interval time between the first and second pulses, is controlled.

24. A method according to claim 22, wherein the pulse width of the driving pulse is controlled in accordance with a change at least one of a viscosity of the liquid and a surface tension thereof.

25. A liquid ejection method, comprising:

preparing a liquid ejection head including an ejection outlet for ejecting the liquid; a heat generating element for generating the bubble in the liquid by applying heat to said liquid; a liquid flow path having a supply passage for supplying the liquid to said heat generating element from upstream thereof; and a movable member disposed faced to said heat generating element and having a free and adjacent said ejection outlet, the free end of said movable member being moved by pressure produced by the generation of the bubble to guide the pressure toward said ejection outlet; and detecting means for detecting a state to an ejection quantity of the liquid influential amount of the liquid;

predicting a state quantity of the liquid influential to an ejection amount of the liquid on the basis of a frequency of ejecting operations of the liquid;

ejecting the liquid in an amount which is determined by controlling the pulse width of a driving pulse for the heat generating element on the basis of the predicted amount, wherein the change rate of the election amount of the liquid increases non-linearly with an increase of the width of the driving pulse.

26. A method according to claim 25, wherein the state quantity is a temperature of the liquid.

27. A method according to claim 25, further comprising:

supplying, to said heat generating element, a driving pulse divided into first pulse and an adjacent second pulse;

pre-heating the liquid by said first pulse to an extent not enough to eject the liquid through said ejection outlet;

heating the liquid so as to eject it through said ejection outlet by said second pulse;

wherein in said control step, at least one of a pulse width of the first pulse, a pulse width of the second pulse and an interval time between the first and second pulses, is controlled.

28. A method according to claim 25, wherein the pulse width of the driving pulse is controlled in accordance with a change at least one of a viscosity of the liquid and a surface tension thereof.

29. A liquid ejection method, comprising:

preparing a liquid ejection-head including a first liquid flow path in fluid communication with a liquid ejection outlet, a second liquid flow path having a bubble generation region and a movable member disposed between said first liquid flow path and said bubble generation region and having a free and adjacent the ejection outlet side; wherein a bubble is generated in said bubble generation region to displace the free end of the movable member into said first liquid flow path by pressure produced by the generation of the bubble, thus guiding the pressure toward the ejection outlet of said first liquid flow path by the movement of the movable member to eject the liquid; a heat generating element for applying thermal energy to said bubble generation region upon supply thereto of a driving pulse; detecting means for detecting a state quantity of the liquid influential to an ejection amount of the liquid;

predicting a state quantity of the liquid influential to an ejection amount of the liquid on the basis of a frequency of ejecting operations of the liquid;

electing the liquid in an amount which is determined by controlling the pulse width of a driving pulse for the heat generating element on the basis of the predicted amount, wherein the change rate of the ejection amount of the liquid increases non-linearly with an increase of the width of the driving pulse.

30. A method according to claim 29, wherein the state quantity is a temperature of the liquid.

31. A method according to claim 29, wherein the liquid supplied to said first liquid flow path is the same as the liquid supplied to the second liquid flow path.

32. A method according to claim 29, wherein the liquid supplied to said first liquid flow path is different from the liquid supplied to the second liquid flow path.

33. A method according to claim 29, wherein the liquid supplied to the second liquid flow path has at least one of lower viscosity, higher bubble forming property and higher thermal stability than the liquid supplied to the first liquid flow path.

34. A method according to claim 29, further comprising:

supplying, to said heat generating element, a driving pulse divided into first pulse and an adjacent second pulse;

pre-heating the liquid by said first pulse to an extent not enough to eject the liquid through said ejection outlet;

heating the liquid so as to eject it through said ejection outlet by said second pulse;

wherein in said control step, at least one of a pulse width of the first pulse, a pulse width of the second pulse and an interval time between the first and second pulses, is controlled.

35. A method according to claim 29, wherein the pulse width of the driving pulse is controlled in accordance with a change at least one of a viscosity of the liquid and a surface tension thereof.

36. A liquid ejection method, comprising:

preparing a head including a first liquid flow path in fluid communication with a liquid ejection outlet, a second liquid flow path having a bubble generation region and a movable member disposed between said first liquid flow path and said bubble generation region and having a free end adjacent the ejection outlet side; a heat generating element for applying heat to said bubble generation region upon application of a driving pulse thereto, wherein a bubble is generated in said bubble generation region to displace the free end of the movable member into said first liquid flow path by pressure produced by the generation of the bubble, thus guiding the pressure toward the ejection outlet of said first liquid flow path by the movement of the movable member to eject the liquid; said head including detecting means for detection of a state quantity, influential to an amount of the ejection, of the liquid in one of said first and second liquid passage;

predicting a state quantity of the liquid influential to the ejection of the liquid in the other of the first and second liquid passages on the basis of an output of said detecting means;

ejecting the liquid in an amount which is determined by controlling a pulse width of a driving pulse for said heat generating element in accordance with an output of said detecting means and the predicted amount, wherein the change rate of the election amount of the liquid increases non-linearly with an increase of the width of the driving pulse.

37. A method according to claim 36, wherein said detecting means detects a temperature of the liquid, and wherein said predicting step predicts a temperature of the liquid.

38. A method according to claim 36, wherein the liquid supplied to said first liquid flow path is the same as the liquid supplied to the second liquid flow path.

39. A method according to claim 36, wherein the liquid supplied to said first liquid flow path is different from the liquid supplied to the second liquid flow path.

40. A method according to claim 36, wherein the liquid supplied to the second liquid flow path has at least one of lower viscosity, higher bubble forming property and higher thermal stability than the liquid supplied to the first liquid flow path.

41. A method according to claim 36, further comprising:

supplying, to said heat generating element, a driving pulse divided into first pulse and an adjacent second pulse;

pre-heating the liquid by said first pulse to an extent not enough to eject the liquid through said ejection outlet;

generating a bubble by heating the liquid to eject the liquid through said ejection outlet by application of said second pulse;

wherein in said control step, at least one of a pulse width of the first pulse, a pulse width of the second pulse and an interval time between the first and second pulses, is controlled.

42. A method according to claim 36, wherein the pulse width of the driving pulse is controlled in accordance with a change at least one of a viscosity of the liquid and a surface tension thereof.

43. A liquid ejection apparatus, comprising:

a liquid ejection head including an ejection outlet for ejecting the liquid; a heat generating element for generating the bubble in the liquid by applying heat to said liquid; a liquid flow path having a supply passage for supplying the liquid to said beat generating element from upstream thereof; and a movable member disposed faced to said heat generating element and having a free end adjacent said ejection outlet, the free end of said movable member being moved by pressure produced by the generation of the bubble to guide the pressure toward said ejection outlet; and detecting means for detecting a state quantity of the liquid influential to an ejection amount of the liquid;

control means for controlling the ejection amount of the liquid by controlling the pulse width of a driving pulse for the heat generating element on the basis of an output of said detecting means, wherein the change rate of the ejection amount of the liquid increases non-linearly with an increase of the width of the driving pulse.

44. An apparatus according to claim 43, further comprising driving pulse supply means for supplying, to said heat generating element, a driving pulse divided into first pulse and an adjacent second pulse to pre-heat the liquid by said first pulse to an extent not enough to eject the liquid through said ejection outlet; wherein said control means controls at least one of a pulse width of the first pulse, a pulse width of the second pulse and an interval time between the first and second pulses.

45. An apparatus according to claim 43, wherein the pulse width of the driving pulse is controlled in accordance with a change at least one of a viscosity of the liquid and a surface tension thereof.

46. A liquid ejection apparatus, comprising:

a liquid ejection head including a first liquid flow path in fluid communication with a liquid ejection outlet, a second liquid flow path having a bubble generation region and a movable member disposed between said first liquid flow path and said bubble generation region and having a free end adjacent the ejection outlet side; wherein a bubble is generated in said bubble generation region to displace the free end of the movable member into said first liquid flow path by pressure produced by the generation of the bubble, thus guiding the pressure toward the ejection outlet of said first liquid flow path by the movement of the movable member to eject the liquid; a heat generating element for applying thermal energy to said bubble generation region upon supply thereto of a driving pulse; and detecting means for detecting a state quantity of the liquid influential to an ejection amount of the liquid;

control means for controlling the ejection amount of the liquid by controlling the pulse width of a driving pulse for the heat generating element on the basis of an output of said detecting means, wherein the change rate of the election amount of the liquid increases non-linearly with an increase of the width of the driving pulse.

47. An apparatus according to claim 46, further comprising driving pulse supply means for supplying, to said heat generating element, a driving pulse divided into first pulse and an adjacent second pulse to pre-heat the liquid by said first pulse to an extent not enough to eject the liquid through said ejection outlet; wherein said control means controls at least one of a pulse width of the first pulse, a pulse width of the second pulse and an interval time between the first and second pulses.

48. An apparatus according to claim 46, wherein the pulse width of the driving pulse is controlled in accordance with a change at least one of a viscosity of the liquid and a surface tension thereof.

49. A liquid ejection apparatus, comprising:

a liquid ejection head including an ejection outlet for ejecting the liquid; a heat generating element for generating the bubble in the liquid by applying heat to said liquid; a liquid flow path having a supply passage for supplying the liquid to said heat generating element from upstream thereof; and a movable member disposed faced to said heat generating element and having a free end adjacent said ejection outlet, the free and of said movable member being moved by pressure produced by the generation of the bubble to guide the pressure toward said ejection outlet;

predicting means for predicting a state quantity of the liquid influential to an ejection amount of the liquid on the basis of a frequency of ejecting operations of the liquid; and control means for controlling the ejection amount of the liquid by controlling a pulse width of a driving pulse for said heat generating element on the basis of an output of said predicting means, wherein the change rate of the ejection amount of the liquid increases non-linearly with an increase of the width of the driving pulse.

50. An apparatus according to claim 49, wherein said predicting step predicts a temperature of the liquid.

51. An apparatus according to claim 50, further comprising driving pulse supply means for supplying, to said heat generating element, a driving pulse divided into first pulse and an adjacent second pulse to pre-heat the liquid by said first pulse to an extent not enough to eject the liquid through said ejection outlet: wherein said control means controls at least one of a pulse width of the first pulse, a pulse width of the second pulse and an interval time between the first and second pulses.

52. An apparatus according to claim 49, wherein the pulse width of the driving pulse is controlled in accordance with a change at least one of a viscosity of the liquid and a surface tension thereof.

53. A liquid ejection apparatus, comprising:

a liquid ejection head including a first liquid flow path in fluid communication with a liquid ejection outlet, a second liquid flow path having a bubble generation region and a movable member disposed between said first liquid flow path and said bubble generation region and having a free end adjacent the ejection outlet side; wherein a bubble is generated in said bubble generation region to displace the free end of the movable member into said first liquid flow path by pressure produced by the generation of the bubble, thus guiding the pressure toward the ejection outlet of said first liquid flow path by the movement of the movable member to eject the liquid: a heat generating element for applying thermal energy to said bubble generation region upon supply thereto of a driving pulse;

predicting means for predicting a state quantity of the liquid influential to an ejection amount of the liquid on the basis of a frequency of ejecting operations of the liquid; and control means for controlling the ejection amount of the liquid by controlling a pulse width of a driving pulse for said heat generating element on basis of an output of said predicting means, wherein the change rate of the election amount of the liquid increases non-linearly with an increase of the width of the driving pulse.

54. An apparatus according to claim 53, wherein said predicting step predicts a temperature of the liquid as a state quantity influential to the amount of ejection of the liquid.

55. An apparatus according to claim 53, wherein the liquid supplied to said first liquid flow path is the same as the liquid supplied to the second liquid flow path.

56. An apparatus according to claim 53, wherein the liquid supplied to said first liquid flow path is different from the liquid supplied to the second liquid flow path.

57. An apparatus according to claim 53, wherein the liquid supplied to the second liquid flow path has at least one of lower viscosity, higher bubble forming property and higher thermal stability than the liquid supplied to the first liquid flow path.

58. An apparatus according to claim 53, further comprising driving pulse supply means for supplying, to said heat generating element, a driving pulse divided into first pulse and an adjacent second pulse to pre-heat the liquid by said first pulse to an extent not enough to eject the liquid through said ejection outlet; wherein said control means controls at least one of a pulse width of the first pulse, a pulse width of the second pulse and an interval time between the first and second pulses.

59. An apparatus according to claim 53, wherein the pulse width of the driving pulse is controlled in accordance with a change at least one of a viscosity of the liquid and a surface tension thereof.

60. A liquid ejection apparatus comprising:

a liquid ejection head including a first liquid flow path in fluid communication with a liquid ejection outlet, a second liquid flow path having a bubble generation region and a movable member disposed between said first liquid flow path and said bubble generation region and having a free and adjacent the ejection outlet side; a heat generating element for applying heat to said bubble generation region upon application of a driving pulse thereto, wherein a bubble is generated in said bubble generation region to displace the free end of the movable member into said first liquid flow path by pressure produced by the generation of the bubble, thus guiding the toward the ejection outlet of said first liquid flow path by the movement of the movable member to eject the liquid; said head including detecting means for detection of a state quantity, influential to an amount of the ejection, of the liquid in one of said first and second liquid passage;

predicting means for predicting a state quantity of the liquid influential to the ejection of the liquid in the other of the first and second liquid passages on the basis of an output of said detecting means;

control means for controlling the election amount of the liquid by controlling a pulse width of a driving pulse for said heat generating element on the basis of an output of said predicting means and the output of said detecting means, wherein the change rate of the election amount of the liquid increases non-linearly with an increase of the width of the driving pulse.

61. An apparatus according to claim 60, wherein said detecting means is temperature detecting means, provided in said head, for detecting a temperature of the liquid, wherein said predicting means predictions the temperature of the liquid influential to the ejection amount of the liquid.

62. An apparatus according to claim 60, wherein the liquid supplied to said first liquid flow path is the same as the liquid supplied to the second liquid flow path.

63. An apparatus according to claim 60, wherein the liquid supplied to said first liquid flow path is different from the liquid supplied to the second liquid flow path.

64. An apparatus according to claim 60, wherein the liquid supplied to the second liquid flow path has at least one of lower viscosity, higher bubble forming property and higher thermal stability than the liquid supplied to the first liquid flow path.

65. An apparatus according to claim 60, further comprising driving pulse supply means for supplying, to said heat generating element, a driving pulse divided into first pulse and an adjacent second pulse to pre-heat the liquid by said first pulse to an extent not enough to eject the liquid through said ejection outlet; wherein said control means controls at least one of a pulse width of the first pulse, a pulse width of the second pulse and an interval time between the first and second pulses.

66. An apparatus according to claim 60, wherein the pulse width of the driving pulse is controlled in accordance with a change at least one of a viscosity of the liquid and a surface tension thereof.

* * * * *

UNITED STATES PATENT AND TRADEMARK OFFICE

CERTIFICATE OF CORRECTION

PATENT NO. : 6,252,616 B1
DATED : June 26, 2001
INVENTOR(S) : Takeshi Okazaki et al.

It is certified that error appears in the above-identified patent and that said Letters Patent is hereby corrected as shown below:

Title page,
Item [30], Foreign Application Priority Data, "Jul. 5, 1996 (JP)…….8-178939" should read -- Jul. 5, 1996 (JP)……8-176939 --.

Column 1,
Line 45, "With such" should read -- Such --.

Column 2,
Line 20, "stick" should read -- were stuck --;
Line 29, "is not contributable" should read -- does not contribute --;
Line 32, "make" should read -- made --; and
Line 44, "it" should be deleted.

Column 3,
Line 5, "the some" should read -- some --; and
Line 41, "refiling" should read -- refilling --.

Column 4,
Line 35, "concerns" should read -- concern --; and "ejecting" should read -- ejection --; and
Line 66, "and" should read -- end --.

Column 5,
Line 5, "provides" should read -- provided --.

Column 6,
Line 3, "and" should read -- end- --;
Line 17, "ejection-head" should read -- ejection head --; and
Line 21, "and" should read -- end --; and
Line 35, "b y" should read -- by --.

Column 7,
Line 26, "to-displace" should read -- to displace --; and
Line 50, "and" should read -- end --.

Column 8,
Line 17, "on" should read -- on the --;
Line 26, "and" should read -- end --;
Line 33, "the toward" should read -- the pressure toward --; and
Line 37, "passage." should read -- passages. --.

UNITED STATES PATENT AND TRADEMARK OFFICE

CERTIFICATE OF CORRECTION

PATENT NO. : 6,252,616 B1
DATED : June 26, 2001
INVENTOR(S) : Takeshi Okazaki et al.

It is certified that error appears in the above-identified patent and that said Letters Patent is hereby corrected as shown below:

Column 9,
Line 27, "FIGS. 1(*a*)-(*d*) are is a" should read -- FIGS. 1(*a*)-1(*d*) are --; and
Line 49, "FIGS. 9(*a*)-(*c*) are is a" should read -- FIGS. 9(*a*)-9(*c*) are --.

Column 10,
Line 29, "chart" should read -- charts --; and
Line 47, "an the" should be deleted.

Column 11,
Line 47, "and" should read -- an --.

Column 13,
Line 19, "of the" should be deleted;
Line 25, "it" should read -- it is --; and
Line 67, "of of" should read -- of --.

Column 14,
Line 53, "(FIG., (*c*))," should read -- (FIG. 1(*c*)), --.

Column 16,
Line 43, "like-can" should read -- like can --.

Column 17,
Line 34, "side side" should read -- side --.

Column 18,
Line 65, "the" should read -- The --.

Column 21,
Line 35, "is illustrates" should read -- illustrates --.

Column 22,
Line 36, "property" should read -- property, or --.

Column 23,
Line 35, "difference" should read -- differences --.

Column 24,
Line 34, "then" should read -- more than --; and
Line 37, "to" should be deleted.

UNITED STATES PATENT AND TRADEMARK OFFICE

CERTIFICATE OF CORRECTION

PATENT NO. : 6,252,616 B1
DATED : June 26, 2001
INVENTOR(S) : Takeshi Okazaki et al.

It is certified that error appears in the above-identified patent and that said Letters Patent is hereby corrected as shown below:

Column 25,
Line 4, "store" should read -- stored --;
Line 35, "increase" should read -- an increase --; and
Line 37, "than" should read -- above that --.

Column 26,
Line 20, "A" should be deleted.

Column 28,
Line 19, "temperature" should read -- temperatures --;
Line 22, "are" should be deleted; and
Line 28, “increase.” should read -- increase --.

Column 29,
Line 1, "influenced by the" should be deleted; and
Line 5, "temperature" should read -- temperatures --.

Column 30,
Line 16, "PWM controlled" should read -- PWM-controlled --; and
Line 33, "three step" should read -- three-step --.

Column 31,
Line 58, "can-be" should read -- can be --.

Column 32,
Line 56, "by" should read -- By --.

Column 33,
Line 4, "wider-fulcrum" should read -- wider fulcrum --;
Line 19, "slit-can" should read -- slit can --; and
Line 53, "-material," should read -- material, --.

Column 34,
Line 18, "fro" should read -- for --.

Column 35,
Line 27, "the" should be deleted; and "with" should read -- of --;
Line 28, "with" should read -- of --; and
Line 30, "area." should read -- areas. --.

UNITED STATES PATENT AND TRADEMARK OFFICE

CERTIFICATE OF CORRECTION

PATENT NO. : 6,252,616 B1
DATED : June 26, 2001
INVENTOR(S) : Takeshi Okazaki et al.

It is certified that error appears in the above-identified patent and that said Letters Patent is hereby corrected as shown below:

Column 37,
Line 30, "electrode." should read -- electrodes. --;
Line 42, "chamber," should read -- chambers, --; and
Line 43, "reduces" should read -- reduced --.

Column 38,
Line 14, "S" should be deleted; and
Line 15, "dividing the grooved by" should read -- providing --.

Column 39,
Line 48, "includes:" should read -- include: --.

Column 40,
Line 20, "Bubble generation liquid 1:" should be deleted; and
Line 24, "Ethanol" should read -- Bubble generation liquid 1: ¶ Ethanol --.

Column 41,
Lines 2, 8 and 38, "substratel" should read -- substrate 1 --;
Line 16, "is a" should read -- are --; and "view" should read -- views --;
Line 45, "from," should read -- from --; and
Line 46, "KAISHA)," should read -- KAISHA, --.

Column 42,
Line 13, "boardl and" should read -- board 1, --;
Line 26, "massproduction" should read -- mass production --; and
Line 34, "is a" should read -- are --; and "view" should read -- views --.

Column 43,
Line 18, "is a" should read -- are --; and "view" should read -- views --;
Line 27, "(*b*)," should read -- FIG. 25 (*b*), --;
Line 34, "(*c*)," should read -- FIG. 25 (*c*), --;
Line 39, "(*d*)," should read -- FIG. 25 (*d*), --;
Line 42, "board1," should read -- board 1, --; and
Line 56, "masspro-" should read -- mass pro- --.

Column 44,
Line 27, "side" should read -- sides --;
Line 51, "in" should read -- In --;
Line 61, "(liquid" should read -- (Liquid --;
Line 62, "show" should read -- shows --; and
Line 65, "the" should read -- The --.

UNITED STATES PATENT AND TRADEMARK OFFICE

CERTIFICATE OF CORRECTION

PATENT NO. : 6,252,616 B1
DATED : June 26, 2001
INVENTOR(S) : Takeshi Okazaki et al.

It is certified that error appears in the above-identified patent and that said Letters Patent is hereby corrected as shown below:

Column 45,
Line 2, "the" should read -- The --; and "In" should read -- in --;
Line 12, "carriage." should read -- carriage --;
Line 29, "an" should read -- a --;
Line 40, "CPU302" should read -- CPU 302 --; and
Line 50, "ORP" should read -- OHP --.

Column 46,
Line 29, "the each" should read -- each --;
Lines 33 and 36, "election" should read -- ejection --; and
Line 34, "CPU302" should read -- CPU 302 --.

Column 47,
Line 24, "A" should be deleted;
Line 38, "So" should read -- so --; and
Line 63, "System" should read -- system --.

Column 48,
Line 6, "each of the" should read -- each --; and
Line 26, "element." should read -- elements. --.

Column 49,
Line 47, "embodiment," should read -- embodiments, --;
Line 56, "ROM1003" should read -- ROM 1003 --;
Line 59, "it" should read -- its --;
Line 62, "OOIS" should read -- 1001S --; and "election" should read -- ejection --; and
Line 66, "signal" should read -- signals --.

Column 50,
Lines 8, 10, 21, 23 and 25, "signal" should read -- signals --;
Line 20, "a" should be deleted;
Line 36, "path," should read -- paths, --;
Line 48, "synergatic" should read -- synergetic --;
Line 55, "selectinig" should read -- selecting --;
Line 57, "involving a" should read -- involved in a --; and
Line 66, "election" should read -- ejection --.

Column 51,
Line 29, "element; and" should read -- element; --;
Line 45, "outlet;" should read -- outlet; and --;
Line 54, "are" should read -- is --; and
Line 64, "and" should read -- end --.

UNITED STATES PATENT AND TRADEMARK OFFICE

CERTIFICATE OF CORRECTION

PATENT NO. : 6,252,616 B1
DATED : June 26, 2001
INVENTOR(S) : Takeshi Okazaki et al.

It is certified that error appears in the above-identified patent and that said Letters Patent is hereby corrected as shown below:

Column 52,
Lines 13 and 58, "outlet;" should read -- outlet; and --; and
Line 22, "are" should read -- is --.

Column 53,
Line 13, "and" should read -- end; --; and
Line 29, "outlet;" should read -- outlet; and --.

Column 54,
Lines 3 and 42, "liquid;" should read -- liquid; and --;
Lines 14 and 53, "outlet;" should read -- outlet; and --;
Line 19, "pulses." should read -- pulses, is controlled. --;
Line 28, "second-liquid" should read -- second liquid --; and
Line 62, "change" should read -- change in --.

Column 55,
Lines 6 and 44, "and" should read -- end --;
Lines 14 and 59, "liquid;" should read -- liquid; and --;
Line 27, "outlet;" should read -- outlet; and --;
Line 36, "change" should read -- change in --;
Line 39, "ejection-head" should read -- ejection head --;
Line 54, "pulse;" should read -- pulse; and --; and
Line 60, "electing" should read -- ejecting --.

Column 56,
Line 15, "pulse;" should read -- pulse; and --;
Line 24, "change" should read -- change in --;
Line 44, "passage;" should read -- passages; --;
Line 49, "means;" should read -- means; and --; and
Line 54, "electron" should read -- ejection --.

Column 57,
Line 8, "outlet;" should read -- outlet; and --;
Lines 18 and 51, "change" should read -- change in --;
Line 57, "beat" should read -- heat --; and
Line 33, "liquid;" should read -- liquid; and --.

UNITED STATES PATENT AND TRADEMARK OFFICE

CERTIFICATE OF CORRECTION

PATENT NO. : 6,252,616 B1
DATED : June 26, 2001
INVENTOR(S) : Takeshi Okazaki et al.

It is certified that error appears in the above-identified patent and that said Letters Patent is hereby corrected as shown below:

Column 58,
Line 4, "liquid;" should read -- liquid; and --;
Lines 22 and 59, "change" should read -- change in --;
Line 32, "and" should read -- end --; and
Line 53, "outlet:" should read -- outlet; --.

Column 59,
Line 8, "liquid:" should read -- liquid; and --;
Line 17, "on" should read -- on the --;
Line 19, "election" should read -- ejection --; and
Line 46, "change" should read -- change in --.

Column 60,
Line 7, "the toward" should read -- the pressure toward --;
Line 12, "passage;" should read -- passages; --;
Line 16, "means;" should read -- means; and --;
Lines 17 and 21, "election" should read -- ejection --;
Line 27, "predictions" should read -- predicts --; and
Line 51, "change" should read -- change of --.

Signed and Sealed this

Nineteenth Day of August, 2003

JAMES E. ROGAN
*Director of the United States Patent and Trademark Office*